US010278470B2

(12) United States Patent
Takata et al.

(10) Patent No.: US 10,278,470 B2
(45) Date of Patent: May 7, 2019

(54) COSMETIC TOOL

(71) Applicant: SHISEIDO CO., LTD., Tokyo (JP)

(72) Inventors: Motoki Takata, Yokohama (JP); Akihito Torii, Yokohama (JP); Tomochika Fujioka, Tokyo (JP); Yusuke Okamoto, Ibaraki (JP); Kosuke Matsuo, Ibaraki (JP); Akira Tanbaji, Ibaraki (JP); Mayumi Nakamura, Ibaraki (JP); Eiji Sakata, Ibaraki (JP)

(73) Assignee: SHISEIDO CO., LTD., Tokyo (JP)

( * ) Notice: Subject to any disclaimer, the term of this patent is extended or adjusted under 35 U.S.C. 154(b) by 729 days.

(21) Appl. No.: 14/433,173

(22) PCT Filed: Sep. 25, 2013

(86) PCT No.: PCT/JP2013/075949

§ 371 (c)(1),
(2) Date: Aug. 6, 2015

(87) PCT Pub. No.: WO2014/054489

PCT Pub. Date: Apr. 10, 2014

(65) Prior Publication Data

US 2015/0327648 A1 Nov. 19, 2015

(30) Foreign Application Priority Data

Oct. 4, 2012 (JP) ..... 2012-222336
Oct. 4, 2012 (JP) ..... 2012-222337
(Continued)

(51) Int. Cl.
*A45D 2/48* (2006.01)
*A45D 40/26* (2006.01)
*A45D 34/04* (2006.01)

(52) U.S. Cl.
CPC ..... *A45D 2/48* (2013.01); *A45D 34/042* (2013.01); *A45D 40/265* (2013.01); *A45D 2200/155* (2013.01); *A45D 2200/157* (2013.01)

(58) Field of Classification Search
CPC ..... A45D 2200/157; A45D 2200/155; A45D 2006/005; A45D 20/12; A45D 20/122; A45D 20/124; A45D 20/48
(Continued)

(56) References Cited

U.S. PATENT DOCUMENTS 8,707,969 B2 * 4/2014 Seng ..... A45D 1/28 132/211
2005/0258172 A1 * 11/2005 Gueret ..... A45D 40/00 219/732
(Continued)

FOREIGN PATENT DOCUMENTS

JP 2005-006837 A 1/2005
JP 2006-167148 A 6/2006
(Continued)

OTHER PUBLICATIONS

International Search Report for PCT/JP2013/075949.

*Primary Examiner* — Tatiana L Nobrega
(74) *Attorney, Agent, or Firm* — Muncy, Geissler, Olds & Lowe, P.C.

(57) ABSTRACT

Provided is a mascara applicator for shaping eyelashes while heating the eyelashes and applying mascara liquid while heating the mascara liquid to a suitable temperature so that application of makeup on the eyelashes can be carried out in a short time in total.

The mascara applicator includes: a container 1 for housing mascara liquid; an application body 2 to be attached to and detached from the container 1; and a shaping body 3 to be attached to and detached from the application body 2. The application body 2 includes an application rod 11 in a shape of a hollow shaft to be inserted into the container 1 and an application portion 12 provided at an end portion of the application rod 11. The shaping body 3 includes a shaping rod 21 to be housed by insertion into the application rod 11,
(Continued)

a heating shaping portion 22, and a heater 29. The heater 29 can be switched between an OFF state and two stages of ON states. A heat generating temperature of the heater 29 in a state in which the shaping body 3 is attached to the application body 2 is set to be lower than a heat generating temperature of the heater 29 in a state in which the shaping body 3 is detached from the application body 2.

13 Claims, 62 Drawing Sheets

(30) Foreign Application Priority Data

Oct. 4, 2012 (JP) ..... 2012-222338
Oct. 4, 2012 (JP) ..... 2012-222339
Oct. 4, 2012 (JP) ..... 2012-222340

(58) Field of Classification Search
USPC ..... 132/216, 218; 401/1
See application file for complete search history.

(56) References Cited

U.S. PATENT DOCUMENTS

2008/0216857 A1 9/2008 Tranchant et al.
2009/0020133 A1* 1/2009 Gueret ..... A45D 40/26
132/201
2011/0015463 A1* 1/2011 Legendre ..... A45D 40/00
600/9
2011/0186072 A1* 8/2011 Cho ..... A45D 2/48
132/217
2012/0009002 A1* 1/2012 Lo ..... A45D 40/265
401/6
2012/0170961 A1* 7/2012 Bouix ..... A45D 40/0087
401/1

FOREIGN PATENT DOCUMENTS

WO 2007-114551 A1 10/2007
WO WO2007143430 * 12/2007 ..... A46B 11/08
WO 2011-119855 A2 9/2011
WO WO2011131554 * 10/2011 ..... A45D 2/48
WO WO2012092032 * 7/2012 ..... A45D 34/04

* cited by examiner

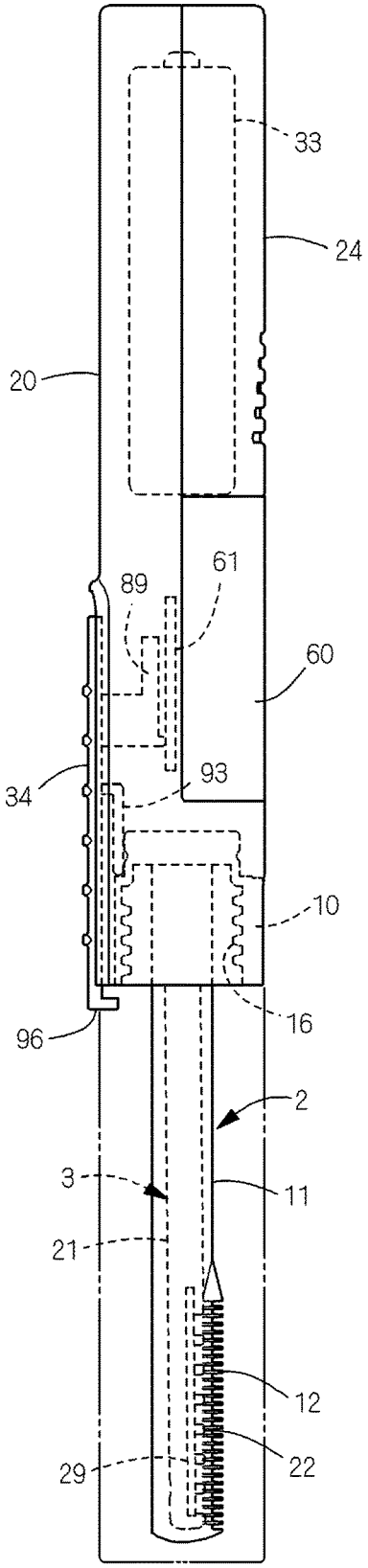
Fig.2
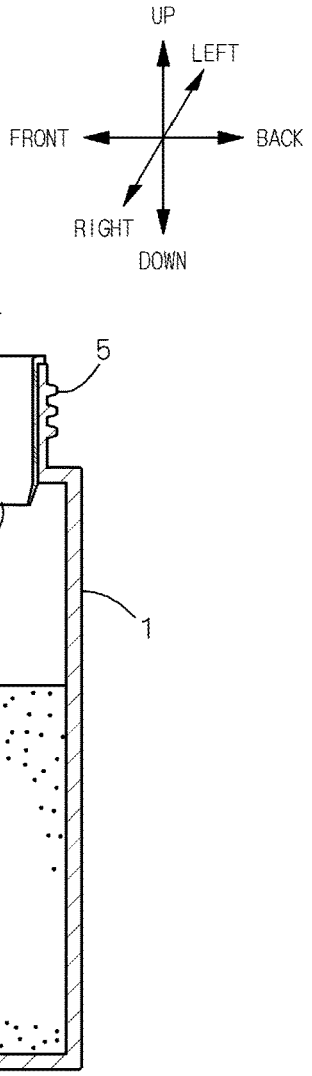

21
21a
21b
3
81
29
81
22
75
82
77
28
83
76
78
80
29
79

20
92
89
95
98
61
90
94
34
63
69
64
57
54
55
93
56
52
16
10
11
21
96

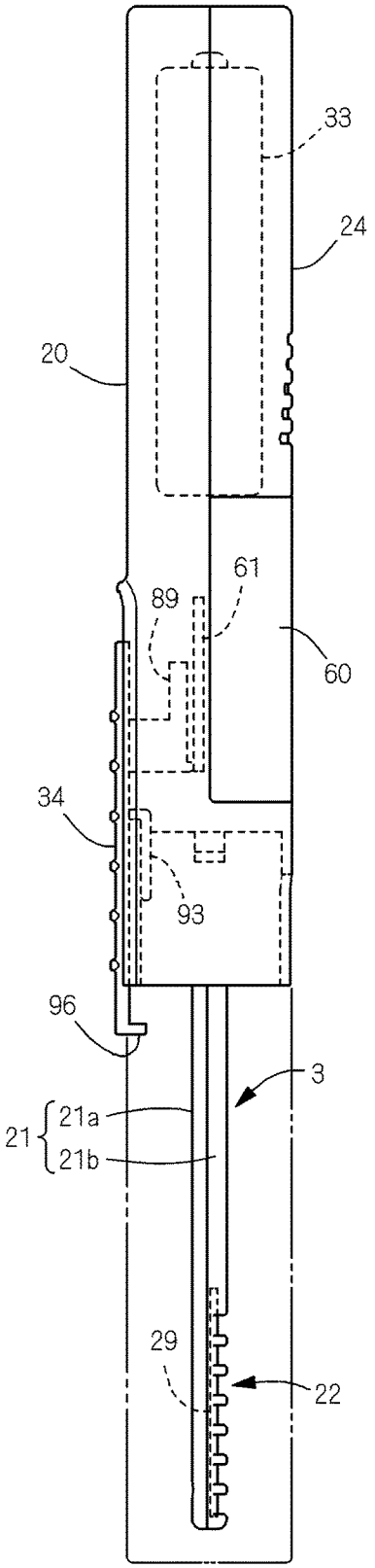
Fig.15
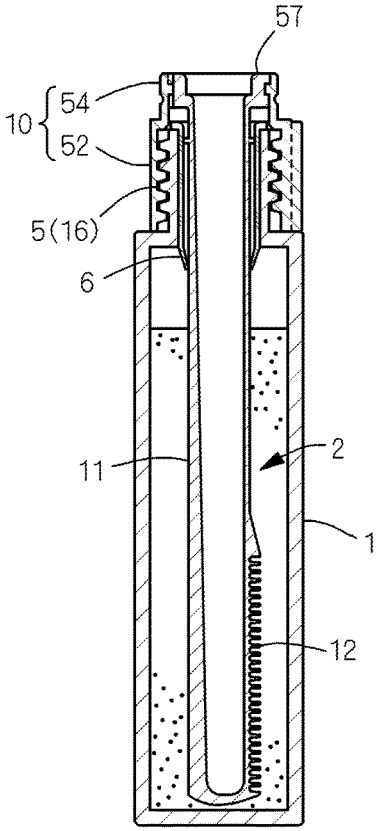

1
2
3
4
5
6
7
10
11
12
13
14
15
16
17
20
21
22
23
24
25
28
29
33
34

20
15
3
17(25)
10
2
13
16
14
V
V
21
11
11
12
32
18
21
IV
IV
28
18
22
22
29
12

63
20
69
95
64
70(72)
34
93
55
VI
VI
56
54
10
52
92
57
VIII
58
VIII
53
16
96
11
UP
FRONT
BACK
DOWN
194
187
11
3
G2
2
188
21
21a
21b
2
194
186
21a
186
21b
3
θ1
θ2
12
28
29
188
22
29
28
185
G1
18
191
190
VII
VII
22
185
28
18
12
t2
187
t1

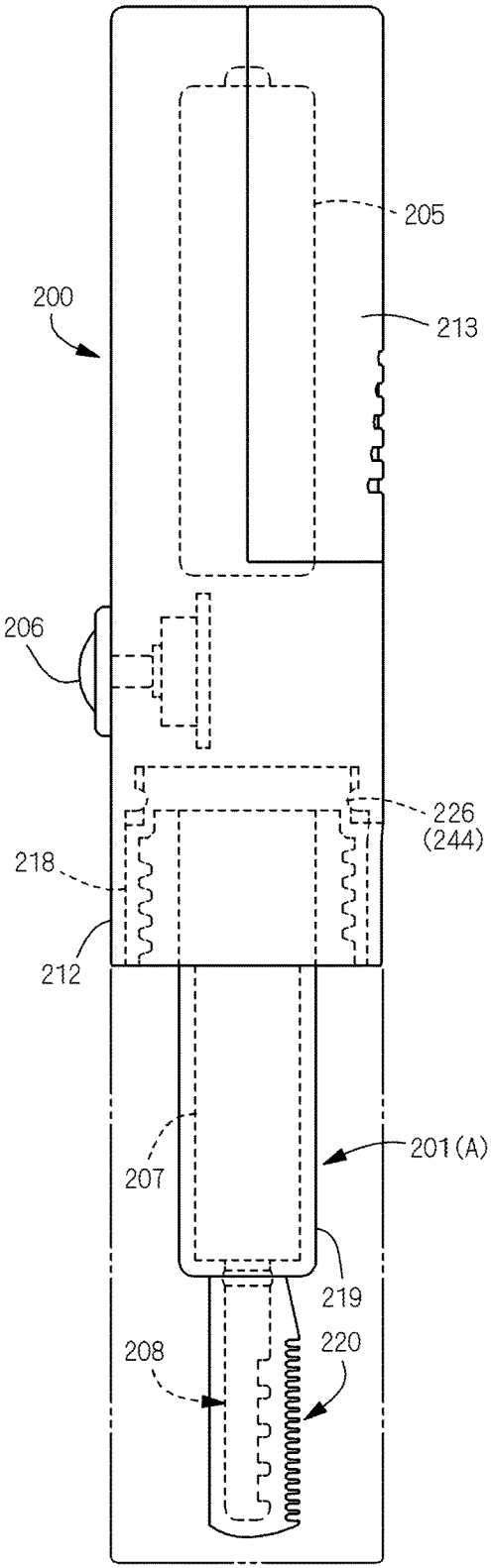
Fig.70
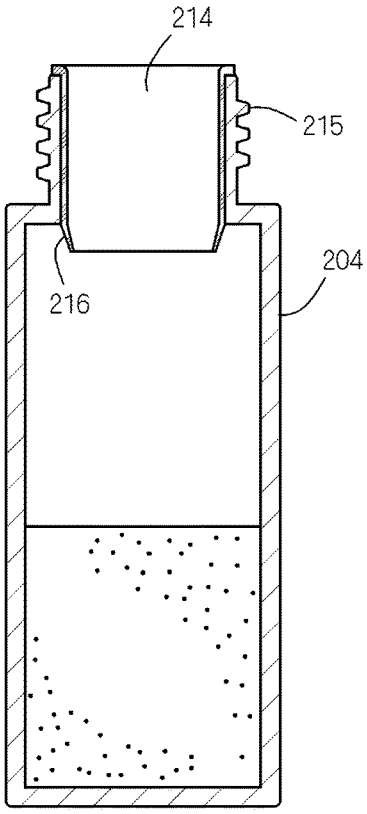

COSMETIC TOOL

TECHNICAL FIELD

The present invention relates to a cosmetic tool such as a mascara applicator. The cosmetic tool can be used as a lip applicator, an eye liner applicator, an eye shadow applicator, a cleansing device, and the like besides the mascara applicator. The cosmetic tool is formed by three members for performing different functions and these members can be connected and used as a single cosmetic tool. Another cosmetic tool is formed by a cosmetic tool having an application body for applying cosmetic material and especially a cosmetic tool for applying the cosmetic material while reducing viscosity of the cosmetic material by heating. Yet another cosmetic tool is a cosmetic tool for performing heating and shaping by shaping an object to be treated while applying heat to the object and especially a cosmetic tool to which an attachment having a function of giving a cosmetic treatment such as heating and shaping or application can be attached in such a manner as to cover a heating shaping portion.

BACKGROUND ART

In relation to the cosmetic tool in the present invention, there is a known application tool in Patent Document 1, in which the application tool is formed by a container for housing mascara liquid and a cap, an applicator having an application head, a heating device for heating the application head, and the like. Inside the cap which serves also as a knob, a battery for powering the heating device is disposed. Inside the application head of the applicator integrated with the cap, a resistance heat-generating element is disposed. If the cap screwed into the container is detached from the container, a circuit for power feeding is closed so that the resistance heat-generating element can generate heat. With this heat, the mascara liquid adhering to a surface of a base portion of the application head can be heated and applied to eyelashes in a uniformly diffused and flowing state.

Similarly, there is a mascara package including a heat-generating element as disclosed in Patent Document 2, in which the mascara package is formed by a container and for housing mascara liquid and a grip (cap), a brush wand protruding from a lower portion of the grip, a heat-generating application portion provided to a lower portion of the brush wand, a battery housed inside the grip, and the like. A switch knob is provided to an outer face of the grip, the heat-generating element is energized to heat the heat-generating application portion by turning on of the knob, and the mascara liquid adhering to bristles on an outer face of the heat-generating application portion can be applied in a heated state to eyelashes. Furthermore, by turning on the switch knob in a state in which the heat-generating application portion is housed in the container, it is possible to heat the low-temperature mascara liquid to reduce viscosity of the mascara liquid.

PRIOR ART DOCUMENTS

Patent Documents

Patent Document 1: Japanese Patent Application Laid-Open No. 2008-212688 (paragraphs 0031, 0032, and FIG. 2)

Patent Document 2: Japanese Patent Application National Publication No. 2009-532083 (paragraphs 0033, 0034, and FIG. 2)

SUMMARY OF THE INVENTION

Problems to be Solved by the Invention

According to the mascara applicator in Patent Document 1, the resistance heat-generating element can generate the heat in synchronization with the detaching operation of the cap from the container and the mascara liquid adhering to the application head can be heated and applied to the eyelashes in the uniformly diffused and flowing state. However, the mascara applicator in Patent Document 1 merely has the function of applying the mascara liquid to the eyelashes. Therefore, to carry out a preceding operation of curling the eyelashes and a succeeding operation of removing clumps (mascara clumps) adhering to the eyelashes, it is necessary to separately have an eyelash shaper and a mascara comb, which complicates the series of operations and requires much work for putting on makeup. Moreover, because the application head and the cap are formed integrally, the application head cannot be repaired or replaced when it gets broken and the entire cosmetic tool excluding the container has to be discarded, which is not economical.

In that respect, in the mascara applicator in Patent Document 2, the heat-generating application portion is provided with the comb for curling the eyelashes and the brush for applying the mascara liquid and therefore it is possible to carry out the series of operations with less work. However, the comb for curling the eyelashes is immersed in the mascara liquid in the container together with the brush and therefore it is necessary to remove the mascara liquid adhering to the comb to curl the eyelashes, which requires extra work. This is disadvantageous in that the mascara liquid is wasted.

As described above, conventional cosmetic tools have room for improvement in that it takes work to carry out cosmetic treatments in an orderly sequence or that the cosmetic material is wasted. After repeated study for solving these problems, the present inventors have found that it is possible to form a multifunctional cosmetic tool with improved usability by forming the cosmetic tool by using three members capable of performing different functions. In order to prevent the respective members from being stored separately or slipping into different storage spaces, the respective members can be connected and treated as a single cosmetic tool when they are not used. However, if the respective members are connected and used as the single cosmetic tool, the member to be used may not be properly detached from the connection mating member and the member which is not to be used may be detached instead. The present inventors found that it was essential to give consideration to that point. Moreover, if the respective members are connected and formed as the single multifunctional cosmetic tool, the respective members may be erroneously attached to each other. The present inventors found that it was essential to give consideration to that point as well.

With the mascara applicator in Patent Document 2, it is possible to suitably curl the eyelashes with the comb by setting a temperature of the heat-generating application portion to a high temperature. However, if the mascara liquid is heated at the temperature suitable for curling the eyelashes, the mascara liquid is heated excessively and deteriorates or solvent evaporates. On the other hand, by setting the temperature of the heat-generating application portion to a low temperature, it is possible to reduce the viscosity of the mascara liquid while preventing deterioration of the mascara liquid, though it is impossible to sufficiently heat the eyelashes, which results in much work and time for curling the eyelashes. Such a problem is caused by a large difference between the temperature suitable for curling the eyelashes and the temperature suitable for reducing the viscosity of the mascara liquid. Direct heating of the comb and the mascara liquid with heat of the heat-generating application portion also contributes this problem.

Moreover, because the mascara applicator in Patent Document 2 is formed so that the heat-generating application portion can be detached from the brush wand, the heat-generating application portion can be easily replaced or cleaned when it gets broken or stains are stuck to it. However, the heat-generating application portion is disposed at a distance from the heat-generating body and the heat generated by the heat-generating body is transferred by a support member to the heat-generating application portion. Therefore, it takes time before the heat-generating application portion is heated and the temperature of the mascara liquid reaches the temperature suitable for application and generation of a waiting time in the application of the mascara liquid is unavoidable.

As described before, in relation to carrying out the cosmetic treatments in the orderly sequence, if a cosmetic tool is formed by a member having a function of shaping the eyelashes and a member having a function of applying mascara liquid and each of the members can be used in a heated state as necessary, it is possible to deftly carry out the cosmetic treatments in an orderly sequence. However, the members to be used in the heated states need to be at different temperatures according to the functions of the respective members and there are large differences in the structure and heat conduction between the respective members. The present inventors have studied how to solve these problems and come to propose the present invention.

It is an object of an invention in a first invention group to provide a cosmetic tool including a shaping body for shaping and curling eyelashes and an application body for applying mascara liquid, with which it is possible to shape the eyelashes while heating the eyelashes to a suitable temperature or to heat the mascara liquid to a suitable temperature to reduce viscosity while preventing deterioration.

It is an object of an invention in the first invention group to provide a multifunctional cosmetic tool with which it is possible to successively carry out shaping and curling of eyelashes and application of mascara liquid with less work.

It is an object of an invention in the first invention group to provide a cosmetic tool with which it is possible to obtain different heat-generating states of a heater to achieve temperatures suitable for shaping of eyelashes with a shaping body and application of mascara liquid with an application body to thereby effectively carry out the shaping of the eyelashes and the application of the mascara liquid, respectively.

It is an object of an invention in a second invention group to provide a cosmetic tool in which a member to be used can be detached from a connection mating member as intended by a user and with which it is possible to deftly carry out a series of cosmetic treatments with less work.

It is an object of an invention in a third invention group to provide a cosmetic tool in which members capable of performing different functions are prevented from being attached to wrong attachment mating members and the respective members can be used properly.

It is an object of an invention in a fourth invention group to provide a cosmetic tool which can swiftly heat mascara liquid held by an application portion to thereby shorten a waiting time until the mascara liquid is heated to a suitable temperature.

It is an object of an invention in a fourth invention group to provide a cosmetic tool which can swiftly heat mascara liquid and in which an application body can be easily replaced or cleaned when the application body gets broken or a stain is stuck to the application body.

It is an object of an invention in a fifth invention group to provide a multifunctional cosmetic tool in which a plurality of members for performing different functions are formed as attachments so that it is possible to deftly carry out cosmetic treatments which are to be carried out in an orderly sequence.

It is an object of an invention in a fifth invention group to provide a cosmetic tool which can maintain the respective members formed as attachments at suitable temperatures according to functions and structures of the respective members so that it is possible to suitably carry out a series of cosmetic treatments.

Solutions to the Problems

As shown in FIG. 19, a cosmetic tool according to a first invention group includes: a container 1 for housing mascara liquid; an application body 2 to be attached to and detached from the container 1; and a shaping body 3 to be attached to and detached from the application body 2. The application body 2 includes an application rod 11 in a shape of a hollow shaft to be inserted into the container 1 and an application portion 12 provided at an end portion of the application rod 11. The shaping body 3 includes a heating shaping portion 22 for shaping eyelashes while heating the eyelashes with heat of a heater 29. The heating shaping portion 22 of the shaping body 3 is housed inside the application rod 11 of the application body 2 in a state in which the shaping body 3 is attached to the application body 2.

An application grip (cap) 10 to be attached to and detached from an inlet/outlet 4 of the container 1 is provided to the application body 2. A shaping grip 20 to be attached to and detached from the application grip 10 is provided to the shaping body 3. A peripheral face of the application grip 10 and a peripheral face of the shaping grip 20 are continuous with each other in a state in which the application body 2 is attached to the container 1 and the shaping body 3 is attached to the application body 2.

The shaping body 3 includes a shaping rod 21 and the heating shaping portion 22 provided to a protruding end portion of the shaping rod 21. As shown in FIG. 21, the shaping rod 21 of the shaping body 3 is inserted into the application rod 11 and the heating shaping portion 22 is housed inside the application portion 12 of the application body 2 in the state in which the shaping body 3 is attached to the application body 2.

The container 1, the application body 2, and the shaping body 3 are formed to have substantially the same sectional shapes and diameters and disposed in a straight line to be adjacent to each other in the described order.

A vertical length of the shaping grip 20 is set to be greater than a vertical length of the application grip (cap) 10 and a plurality of positions of the application grip 10 and the shaping grip 20 can be supported by a thumb and (a) finger (s) in the state in which the shaping body 3 is attached to the application body 2.

The shaping grip 20 is housed inside the application grip (cap) 10 in the state in which the shaping body 3 is attached to the application body 2 (see FIG. 27).

As shown in FIG. 2, another cosmetic tool according to the first invention group includes an application body 2 and a shaping body 3 to be attached to and detached from the application body 2. As shown in FIG. 1, the application body 2 includes an application rod 11 in a shape of a hollow shaft and an application portion 12 provided at an end portion of the application rod 11. The shaping body 3 includes a shaping rod 21 to be housed by insertion into the application rod 11, a heating shaping portion 22 provided at an end portion of the shaping rod 21, and a heater 29 provided inside the heating shaping portion 22. An energization state of the heater 29 can be switched between an OFF state and at least two steps of ON states with high and low different heat generating temperatures. The heat generating temperature of the heater 29 in a state in which the shaping body 3 is attached to the application body 2 is set to be lower than the heat generating temperature of the heater 29 in a state in which the shaping body 3 is detached from the application body 2.

A cap 10 for supporting the application rod 11 and a shaping grip 20 for supporting the shaping rod 21 are detachably provided. As shown in FIG. 17, a sensor switch 110 for sensing that the shaping body 3 is attached to the application body 2 is provided to a contact portion between the cap 10 and the shaping grip 20. A heat generating state of the heater 29 is set to be a low temperature state based on a sensing signal of the sensor switch 110.

A cap 10 for supporting the application rod 11 and a shaping grip 20 for supporting the shaping rod 21 are detachably provided. A switch knob 34 for switching the energization state of the heater 29 is provided to the shaping grip 20. The switch knob 34 can be switched between a first ON state in which a heat generating state of the heater 29 is set to be a low temperature state and a second ON state in which the heat generating state of the heater 29 is set to be a high temperature state. A restricting portion 56 for restricting a switching operation of the switch knob 34 is provided to the cap 10 facing a movement locus of the switch knob 34. As shown in FIG. 1, the switch knob 34 switched into the first ON state is received by the restricting portion 56 so that the heat generating state of the heater 29 is set to be the low temperature state in the state in which the shaping body 3 is attached to the application body 2.

The application body 2 is detachably attached to a container 1 for housing mascara liquid and the application rod 11 is inserted into the container 1. A connection portion for the container 1 and a connection portion for the shaping body 3 are provided to the cap 10 of the application body 2. The restricting portion 56 is provided to the connection portion for the container 1.

The switch knob 34 and a stopper 93 provided on an inner face side of the knob 34 are guided for sliding by a knob seat 92 provided to the shaping grip 20. The restricting portion 56 is provided to the connection portion for the container 1 facing a sliding locus of the stopper 93.

The connection portion for the container 1 provided to the cap 10 is formed by a threaded cap 52. The restricting portion 56 is formed at a shoulder wall of the threaded cap 52 facing the sliding locus of the stopper 93.

The connection portion for the shaping body 3 is formed by a connection boss 54 continuous with the threaded cap 52 and a connection groove 55 provided to a periphery of the connection boss 54. A connection ring 64 having a plurality of elastic connection arms 68 to be engaged and caught in the connection groove 55 is disposed inside the shaping grip 20. A guide recessed portion 69 for guiding the stopper 93 for sliding is formed at a periphery of the connection ring 64.

As shown in FIG. 30, a cosmetic tool according to a second invention group includes: a first member 1; a second member 2; and a third member 3 for performing different functions. The first member 1 and the second member 2 are detachably connected by a first connection structure and the second member 2 and the third member 3 are detachably connected by a second connection structure to form the single cosmetic tool. The first connection structure and the second connection structure are different connection structures so as to be different in an operating direction and/or an operating force in canceling of a connected state.

As the connection structures different in the operating direction in canceling of the connected state, the first connection structure is formed by a thread structure and the second connection structure is formed by a pressure fitting engagement structure, for example. Alternatively, the first connection structure is formed by a right-hand thread structure and the second connection structure is formed by a left-hand thread structure. As the connection structures different in the operating force in canceling of the connected state, the first connection structure and the second connection structure are respectively formed by thread structures and thread diameters of one of the connection structures are set to be smaller than those of the other. By setting larger and smaller different thread pitches or leads of threads or by forming one of the connection structures by a multiple thread and by forming the thread intermittently, the thread structures may be different in the operating force in canceling of the connected state. Similarly, if the first connection structure and the second connection structure are respectively formed by pressure fitting engagement structures, one of the pressure fitting engagement structures may be different in a diameter or an engagement width so that larger and smaller different operating forces are required to cancel the connected states.

A connection strength of the first connection structure in a state in which the first member 1 and the second member 2 are connected is set to be greater than a connection strength of the second connection structure in a state in which the second member 2 and the third member 3 are connected so that a detaching operation of the third member 3 can be carried out prior to detaching operations of the first member 1 and the second member 2.

The first connection structure is formed by a thread structure and the second connection structure is formed by a pressure fitting engagement structure.

The first member 1 is formed by a container for housing mascara liquid or a protective cap. The second member 2 is formed by an application body to be attached to and detached from the container 1 or the protective cap. The third member 3 is formed by a shaping body to be attached to and detached from the application body 2. The application body 2 includes a cap 10 to be attached to and detached from the container 1, an application rod 11 in a shape of a hollow shaft to be inserted into the container 1, and an application portion 12 provided at an end portion of the application rod 11. The shaping body 3 includes a shaping grip 20 to be attached to and detached from the application body 2, a shaping rod 21 to be housed by insertion into the application rod 11, a heating shaping portion 22 provided at an end portion of the shaping rod 21, and a heater 29 provided inside the heating shaping portion 22. The heating shaping portion 22 of the shaping body 3 is housed inside the application portion 12 of the application rod 11 in the state in which the shaping body 3 is attached to the application body 2.

The first connection structure is formed by a threaded shaft 5 provided at an inlet/outlet 4 of the container 1 or the protective cap and a threaded cap 52 provided to the cap 10 and the second connection structure is formed by the pressure fitting engagement structure including a connection groove 55 formed in an annular shape in a peripheral face of a connection boss 54 provided to the cap 10 and a plurality of elastic connection arms 68 provided inside a shaping grip 20.

As shown in FIG. 45, a cosmetic tool according to a third invention group includes: a container 1 for housing cosmetic material; an application body 2 for applying the cosmetic material in the container 1; and a treatment body 3 having a different function from the application body 2. An application rod 11 of the application body 2 is housed inside the container 1 and a treatment rod 21 of the treatment body 3 is housed inside the application rod 11 in a state in which the container 1, the application body 2, and the treatment body 3 are connected. An insertion preventing structure for restricting insertion of the treatment body 3 into the container 1 is provided between the container 1 and the treatment body 3 or between the application body 2 and the treatment body 3.

The application body 2 includes the application rod 11 having an application portion 12 and a cap 10 for supporting the application rod 11. The treatment body 3 includes the treatment rod 21 having a treatment portion 22 and a grip 20 for supporting the treatment rod 21. The container 1 and the application body 2 are connected by a first connection structure provided between the container 1 and the cap 10. The application body 2 and the treatment body 3 are connected by a second connection structure provided between the cap 10 and the grip 20. The insertion preventing structure is formed by a shield wall 62 provided to a portion of the grip 20 to be connected to the cap 10. An outer face of the cap 10 is covered with the shield wall 62 in a state in which the application body 2 and the treatment body 3 are connected.

The application body 2 includes the application rod 11 having an application portion 12 and a cap 10 for supporting the application rod 11. The container 1 and the application body 2 are connected by a first connection structure provided between the container 1 and the cap 10. The insertion preventing structure is formed by a shield wall 65 provided at a periphery of an inlet/outlet 4 of the container 1. An outer face of the cap 10 is covered with the shield wall 65 in a state in which the container 1 and the application body 2 are connected.

The application body 2 includes the application rod 11 having an application portion 12 and a cap 10 for supporting the application rod 11. The treatment body 3 includes the treatment rod 21 having a treatment portion 22 and a grip 20 for supporting the treatment rod 21. The container 1 and the application body 2 are detachably connected by a first connection structure provided between the container 1 and the cap 10. The application body 2 and the treatment body 3 are detachably connected by a second connection structure provided between the cap 10 and the grip 20. The insertion preventing structure is formed by an inner shield wall 62 provided to a connected portion of the grip 20 and an outer shield wall 65 provided at a periphery of an inlet/outlet 4 of the container 1. An outer face of the cap 10 is covered with the inner shield wall 62 and an outer face of the inner shield wall 62 is covered with the outer shield wall 65 in a state in which the container 1, the application body 2, and the treatment body 3 are connected.

The treatment body 3 includes the treatment rod 21 having a treatment portion 22 and a grip 20 for supporting the treatment rod 21. The insertion preventing structure is formed by an insertion preventing chip 310 supported by the treatment rod 21 to be displaced between an insertion allowing attitude and an insertion preventing attitude and a spring 311 for biasing and displacing the insertion preventing chip 310 into the insertion preventing attitude. The insertion preventing chip 310 is formed so as to satisfy an expression ($F1<E<F2$) when an opening dimension of an inlet/outlet 4 of the container 1 is F1, an opening dimension of an inlet/outlet 313 of the application rod 11 of the application body 2 is F2, and a span dimension when the insertion preventing chip 310 is displaced into the insertion preventing attitude is E.

The treatment body 3 includes the treatment rod 21 having a treatment portion 22 and a grip 20 for supporting the treatment rod 21. The insertion preventing structure is formed by a first magnet 316 disposed at an inlet/outlet 4 of the container 1 and a second magnet 317 disposed at an end portion of the treatment rod 21. Magnetic poles of the first magnet 316 and the second magnet 317 are set to have polarities repelling each other.

As shown in FIG. 55, a cosmetic tool according to a fourth invention group includes an application body 2 and a heating body 3 to be detachably connected to the application body 2. The application body 2 includes a cylindrical application rod 11 in which a housing hole 187 is formed along a central axis. The application rod 11 is formed by a treatment portion 185 and a stem portion 186 continuous with the treatment portion 185 and an application portion 12 for holding cosmetic material is provided at an end portion of the treatment portion 185. The heating body 3 includes a heating rod 21 provided at one end of the grip 20 and a heating portion 22 provided at an end portion of the heating rod 21 and a heater 29 is provided inside the heating portion 22. The heating portion 22 of the heating rod 21 is positioned inside the treatment portion 185 of the application rod 11 in a state in which the heating body 3 is connected to the application body 2 and the heating rod 21 is housed in the housing hole 187.

The application portion 12 is formed on one side of an outer face of the treatment portion 185. The heating rod 21 is formed by a stem portion 194 and the heating portion 22 provided at an end portion of the stem portion 194. A gap G1 between an inner face 188 of the treatment portion 185 and the heating portion 22 is set to be smaller than a gap G2 between an inner face 188 of the stem portion 186 of the application rod 11 and the stem portion 194 of the heating rod 21 in a state in which the heating body 3 is connected to the application body 2.

The treatment portion 185 includes an application portion side cylindrical wall 190 on which the application portion 12 is formed and an opposed cylindrical wall 191 opposed to the application portion side cylindrical wall 190. A thickness t1 of the application portion side cylindrical wall 190 is set to be smaller than a thickness t2 of the opposed cylindrical wall 191.

An outer diameter D2 of the stem portion 194 of the heating rod 21 is set to be smaller than an outer diameter D1 of the heating portion 22. A heat insulating space S1 is formed between an outer face of the stem portion 194 of the heating rod 21 and the inner face 188 of the stem portion 186 of the application rod 11.

One or more division walls 195 for dividing the heat insulating space S1 into a plurality of spaces are formed in annular shapes on a peripheral face of the stem portion 194 of the heating rod 21.

The inner faces 188 of at least the application portion side cylindrical wall 190 and the opposed cylindrical wall 191 of the application rod 11 are tapered from a base end side toward an end portion side.

The heater 29 is disposed while displaced toward the application portion side cylindrical wall 190 with respect to a central axis O of the application rod 11.

A lower step portion 196 is formed at the heating portion 22 facing the opposed cylindrical wall 191 and a heat insulating space S2 is provided between the opposed cylindrical wall 191 and the heating portion 22.

The stem portion 186 of the heating rod 21 is made of foamable resin.

The cosmetic tool includes a container 1 for housing mascara liquid, the application body 2 to be detachably attached to the container 1, and the heating body 3 detachably connected to the application body 2. The heating rod 21 of the heating body 3 is housed inside the application rod 11 inserted into the container 1 in a state in which the container 1, the application body 2, and the heating body 3 are connected.

As shown in FIG. 64, in a cosmetic tool according to a fifth invention group, a heating rod 207 is provided at one end of a main body portion 200 and a heating portion 208 including a heater 210 is provided to the heating rod 207. The cosmetic tool includes an attachment A to be detachably attached to the main body portion 200 or the heating rod 207 to cover an outer face of the heating portion 208 in an attached state. A sensor structure is provided to a connection portion between the main body portion 200 and the attachment A to sense whether or not the attachment A is attached to the main body portion 200 or the heating rod 207. A heat generating temperature of the heater 210 is switched between a temperature state adapted to the heating portion 208 and a temperature state adapted to the attachment A attached to the heating portion 208 based on a sensing result of the sensor structure.

The heating portion is disposed at the end portion of the heating rod 207 and formed as a heating shaping portion 208 for shaping eyelashes. The attachment A is formed as an application body 201 for applying mascara liquid. The application body 201 includes a cap 218 to be attached to the main body portion 200 by a first connection structure, an application rod 219 in a shape of a hollow shaft supported by the cap 218, and an application portion 220 provided at an end portion of the application rod 219. The outer face of the heating shaping portion 208 is covered with the application portion 220 in a state in which the application body 220 is attached to the main body portion 200.

The heating portion is disposed at the end portion of the heating rod 207 and formed as a heating shaping portion 208 for shaping eyelashes. The attachment A is formed as an eyelash shaping body 202, 203 for shaping the eyelashes. The eyelash shaping body 202, 203 includes a comb frame 230, 237 to be attached to the heating shaping portion 208 by a second connection structure and a shaping comb portion 231, 238 provided to an outer face of the comb frame 230, 237 to shape the eyelashes. The outer face of the heating shaping portion 208 is covered with the comb frame 230, 237 in a state in which the eyelash shaping body 202, 203 is attached to the heating shaping portion 208.

The sensor structure is formed by paired connection terminals 248, 255, 257 provided to the main body portion 200 and a conductive terminal 249, 256, 258 provided to the attachment A. The conductive terminal 249, 256, 258 makes the paired connection terminals 248, 255, 257 electrically continuous with each other so that an attached state of the attachment A is sensed in a state in which the attachment A is attached to the main body portion 200 or the heating rod 207.

The sensor structure is formed by a light sensor 261 provided to the main body portion 200 and a light shielding body 262 provided to the attachment A. A light receiving state of the light sensor 261 is switched by the light shielding body 262 so that an attached state of the attachment A is sensed in a state in which the attachment A is attached to the main body portion 200.

The sensor structure is formed by a reed switch 281 provided to the main body portion 200 and a magnet 282 provided to the attachment A. The reed switch 281 is switched by the magnet 282 so that an attached state of the attachment A is sensed in a state in which the attachment A is attached to the main body portion 200.

Effects of the Invention

In the cosmetic tool according to the first invention group, the mascara applicator is formed by the container 1, the application body 2, and the shaping body 3 and the heating shaping portion 22 of the shaping body 3 is housed inside the application rod 11 of the application body 2 in the state in which the shaping body 3 is attached to the application body 2. According to the mascara applicator including the application body 2 and the shaping body 3 in this manner, it is possible to shape the eyelashes while heating the eyelashes with the heating shaping portion 22 of the shaping body 3 by detaching the shaping body 3 from the application body 2. Moreover, by using the heating shaping portion 22 in the state in which the heating shaping portion 22 is housed inside the application rod 11 of the application body 2, it is possible to apply the mascara liquid held by the application portion 12 to the eyelashes. Moreover, if an ambient temperature is low, it is possible to heat the heating shaping portion 22 to apply the mascara liquid held by the application portion 12 while heating the mascara liquid with the heat. Therefore, it is possible to effectively apply the mascara liquid. Moreover, by heating the heating shaping portion 22 in a state in which the application portion 12 and the heating shaping portion 22 are housed in the container 1, it is possible to indirectly heat the mascara liquid through the application portion 12. Therefore, it is possible to reduce viscosity of the mascara liquid while preventing deterioration of the mascara liquid due to excessive heating.

Because the application body 2 is used to house the shaping body 3 in an unused state, it is possible to effectively prevent the shaping body 3 from getting mixed with or lost among other makeup tools and it is also possible to protect the heating shaping portion 22 provided to the shaping body 3 with the application rod 11. Furthermore, by preparing a plurality of containers 1 for housing mascara liquids of different colors and features and a plurality of application bodies 2 and replacing the shaping body 3 with each of the application bodies 2 to use the mascara applicator, it is possible to apply each of the plurality of kinds of mascara liquids in a heated state.

If the application grip 10 is provided to the application body 2 and the shaping grip 20 is provided to the shaping body 3, it is possible to apply the mascara liquid while holding the application grip 10 and it is possible to shape the eyelashes while holding the shaping grip 20. Moreover, in the state in which the application body 2 and the shaping body 3 are integrated with each other, it is possible to use the application body 2 while holding both the grips 10 and 20 to apply the mascara liquid. In this manner, a user can bring the respective grips 10 and 20 into its favorite state to carry out application of the mascara liquid with the application body 2 and shaping of the eyelashes with the shaping body 3, which improves usability of the mascara applicator. Moreover, if the peripheral faces of the application grip 10 and the shaping grip 20 are continuous with each other in the state in which the application body 2 and the shaping body 3 are integrated with each other, a sense of unity between the grips 10 and 20 can be emphasized. Therefore, the entire mascara applicator can give a simple and high-class impression.

If the shaping rod 21 and the heating shaping portion 22 are provided to the shaping body 3 and the heating shaping portion 22 is housed inside the application portion 12 of the application body 2 as shown in FIG. 21 in the state in which the shaping body 3 is attached to the application body 2, it is possible to efficiently transfer heat of the heating shaping portion 22 to the application portion 12. In this way, it is possible to effectively heat the mascara liquid held by the application portion 12 to evenly and properly apply the mascara liquid in a uniformly diffused and flowing state to the eyelashes.

If the container 1, the application body 2, and the shaping body 3 are formed to have substantially the same sectional shapes and diameters and disposed in the straight line to be adjacent to each other in the described order, it is possible to easily carry out the application of the mascara liquid by supporting the application body 2 and the shaping body 3 in the same gripping manner as holding of a pencil with one hand. In other words, it is possible to easily apply the mascara liquid while holding the application portion 12 in a stable state. Moreover, because the three members, i.e., the container 1, the application body 2, and the shaping body 3 are disposed in the straight line to be adjacent to each other in the described order, the entire mascara applicator can give a simpler, slim, and high-class impression.

According to the mascara applicator in which the vertical length of the shaping grip 20 is set to be greater than the vertical length of the application grip 10, it is possible to lightly carry out the application of the mascara liquid by detaching the shaping body 3 and pinching the application grip 10. Furthermore, it is possible to carry out the application of the mascara liquid in a stable state in which the shaping body 3 is attached to the application body 2 and a plurality of positions of the application grip 10 and the shaping grip 20 are supported by a thumb and (a) finger(s), i.e., by gripping the application grip 10 and shaping grip 20 in the same manner as holding of a pencil with one hand.

If the shaping grip 20 is housed inside the application grip 10 in the state in which the shaping body 3 is attached to the application body 2, it is possible to reduce an entire length of the mascara applicator by a length of the shaping grip 20 to make the mascara applicator compact. Moreover, while providing a round stick-shaped simple external appearance, it is possible to reduce a difference between vertical and lateral dimensions to thereby improve a design. Furthermore, because a battery 33 housed inside the shaping grip 20 can be protected by the application grip 10, it is possible to enhance durability of the mascara applicator.

In another cosmetic tool according to the first invention group, the mascara applicator is formed by the application body 2 and the shaping body 3 and the heating shaping portion 22 of the shaping body 3 is housed inside the application rod 11 of the application body 2 in the state in which the shaping body 3 is attached to the application body 2. According to the mascara applicator including the application body 2 and the shaping body 3 in this manner, it is possible to shape the eyelashes while heating the eyelashes with the heating shaping portion 22 of the shaping body 3 by detaching the shaping body 3 from the application body 2. Moreover, by using the heating shaping portion 22 in the state in which the heating shaping portion 22 is housed inside the application rod 11 of the application body 2, it is possible to apply the mascara liquid held by the application portion 12 to the eyelashes. Therefore, according to the mascara applicator of the present invention, it is possible to provide the multifunctional mascara applicator which can successively carry out shaping and curling of the eyelashes and application of the mascara liquid with less work in a process of application of makeup on the eyelashes.

The heat generating temperature of the heater 29 in the state in which the shaping body 3 is attached to the application body 2 is set to be lower than the heat generating temperature of the heater 29 in the state in which the shaping body 3 is detached from the application body 2. Therefore, it is possible to bring the heater 29 into the temperature states respectively suitable for the shaping of the eyelashes with the shaping body 3 and the application of the mascara liquid with the application body 2. The heat generating temperature is set to the low temperature in the application of the mascara liquid and therefore it is possible to prevent wasteful evaporation of a volatile constituent such as solvent included in the mascara liquid adhering to the application portion 12. In this way, it is possible to reduce the viscosity of the mascara liquid while preventing alteration and deterioration of the mascara liquid and it is possible to cause the uniformly diffused mascara liquid having a suitable degree of fluidity to adhere to the application portion 12 to suitably carry out the application of the mascara liquid to the eyelashes. Furthermore, because the heat generating temperature of the heater 29 is set to the higher temperature in the shaping of the eyelashes with the shaping body 3 than in the application of the mascara liquid with the application body 2, it is possible to properly shape and curl the eyelashes. As a result, it is possible to effectively carry out the shaping of the eyelashes and the application of the mascara liquid, respectively.

If a sensor switch 110 is provided to the contact portion between the cap 10 and the shaping grip 20 and the heat generating state of the heater 29 is set to be the low temperature state based on the sensing signal of the switch 110, it is possible to bring the heat generating state of the heater 29 into a suitable temperature state by only attaching the shaping body 3 to the application body 2. Therefore, as compared with leaving switching of the heat generating state of the heater 29 to a user, it is possible to reduce work in use of the mascara applicator to improve the usability. Moreover, it is possible to completely avoid an excessively high or insufficient heat generating state of the heater 29 due to an error made by the user.

If the switch knob 34 is received by the restricting portion 56 provided to the cap 10 to maintain the heat generating state of the heater 29 in the low temperature state in the state in which the shaping body 3 is attached to the application body 2, it is possible to maintain the heater 29 in the suitable temperature state while reliably preventing incorrect operations, even if the switch knob 34 can be manually switched by the user. Because the restricting portion 56 mechanically prevents the switch knob 34 from being switched into the second ON state, it is possible to continue to prevent switching of the switch knob 34 unless the user attaches the application body 2 to the container 1 and detaches the shaping body 3 from the application body 2.

If a connection portion for the container 1 provided to the cap 10 of the application body 2 is used to provide the restricting portion 56, the restricting portion 56 can be provided in the vicinity of a junction between the application body 2 and the shaping body 3, which simplifies the structure for preventing movement of the switch knob 34. Moreover, because the restricting portion 56 is provided to the cap 10 having large structural strength, the restricting portion 56 can perform the function of preventing the movement of the switch knob 34 for a long period in a stable state.

If the switch knob 34 and the stopper 93 are guided for sliding by the knob seat 92 and the restricting portion 56 is provided to the connection portion for the container 1 facing the sliding locus of the stopper 93, it is possible to hide the structure for preventing the movement of the switch knob 34 under the switch knob 34 and the knob seat 92. Therefore, an external appearance of the mascara applicator can give a simple and high-class impression. Moreover, the stopper 93 is guided for sliding by an inner wall of the knob seat 92 and therefore it is possible to smoothly guide the stopper 93 for sliding in switching the switch knob 34 from the OFF state into the first and second ON states.

If the connection portion for the container 1 is formed by the threaded cap 52 and the shoulder wall of the threaded cap 52 is used as the restricting portion 56, it is unnecessary to separately provide a structure corresponding to the restricting portion 56 to the cap 10. Therefore, it is possible to simplify the structure to thereby reduce a manufacturing cost of the mascara applicator by a cost of the corresponding structure. Furthermore, because the restricting portion 56 is provided to the shoulder wall of the threaded cap 52 facing the sliding locus of the stopper 93, it is possible to firmly receive the stopper 93 with the restricting portion 56 to thereby reliably prevent switching of switch knob 34 from the first ON state into the second ON state.

If the connection portion for the shaping body 3 is formed by the connection boss 54 and the connection groove 55 and the connection ring 64 having the plurality of elastic connection arms 68 is disposed inside the shaping grip 20, it is possible to easily detach the shaping body 3 from the application body 2 by only pulling out the shaping body 3 in the state in which the application body 2 is attached to the container 1 by screwing. Moreover, by only inserting the shaping body 3 into the application body 2, it is possible to integrate the shaping body 3 with the application body 2 and it is possible to easily attach and detach the shaping body 3 to and from the application body 2 on the whole. Moreover, if the guide recessed portion 69 provided to the connection ring 64 guides the stopper 93 for sliding, it is possible to further smoothly guide the stopper 93 for sliding while sandwiching the stopper 93 between the knob seat 92 and the guide recessed portion 69 on the outer and inner sides in switching the switch knob 34 from the OFF state into the first and second ON states.

The cosmetic tool according to the second invention group is formed by the first member 1, the second member 2, and the third member 3 for performing different functions and therefore it is possible to make the cosmetic tool multifunctional to improve usability. Because the respective members 1, 2, and 3 can be treated as the single cosmetic tool in the state in which they are connected by the first connection structure and the second connection structure, it is possible to prevent the respective members from becoming separated from each other when stored and from slipping into different storage spaces. Moreover, the first connection structure and the second connection structure are different in the operating direction or the operating force in canceling of the connected state. Therefore, to use any one of the respective members 1, 2, and 3, the member to be used can be properly detached from the connection mating member as intended by a user. In this way, it is possible to provide the cosmetic tool with which a series of cosmetic treatments can be deftly carried out with less work on the whole.

If the connection strength of the first connection structure is set to be greater than the connection strength of the second connection structure, the detaching operation of the third member 3 can be carried out prior to the detaching operations of the first member 1 and the second member 2. For example, even if the first connection structure and the second connection structure are respectively formed by the thread structures or the pressure fitting engagement structures, the detaching operation of the third member 3 can be carried out prior to the detaching operations of the other members. Therefore, by forming one of the members 1, 2, and 3, which is used the most frequently, as the third member 3, it is possible to quickly attach and detach the member, which improves usability.

If the first connection structure is formed by the thread structure and the second connection structure is formed by the pressure fitting engagement structure, it is possible to attach and detach the third member 3 to and from the second member 2 by pulling out and insertion which are much simpler than operations (screwing operations) for attaching and detaching the first member 1 and the second member 2 to and from each other. Therefore, it is possible to further easily attach and detach the third member 3 which is used with high frequency.

The cosmetic tool for mascara application is formed by the container 1 or the protective cap, the application body 2, and the shaping body 3 and the heating shaping portion 22 of the shaping body 3 is housed inside the application rod 11 of the application body 2 in the state in which the shaping body 3 is attached to the application body 2. According to the cosmetic tool for the mascara application and including the application body 2 and the shaping body 3 in this manner, it is possible to shape the eyelashes while heating the eyelashes with the heating shaping portion 22 of the shaping body 3 by detaching the shaping body 3 from the application body 2. Moreover by using the cosmetic tool in the state in which the heating shaping portion 22 is housed inside the application rod 11 of the application body 2, it is possible to apply the mascara liquid held by the application portion 12 to the eyelashes. Because the application body 2 is used to house the shaping body 3 in the unused state, it is possible to effectively prevent the shaping body 3 from getting mixed with or lost among other makeup tools and it is also possible to protect the heating shaping portion 22 provided to the shaping body 3 with the application rod 11. Furthermore, if the ambient temperature is low, it is possible to cause the heater 29 provided to the heating shaping portion 22 to generate heat to apply the mascara liquid held by the application portion 12 while heating the mascara liquid with the heat. Therefore, it is possible to effectively apply the mascara liquid.

If the first connection structure is formed by the threaded shaft 5 and the threaded cap 52 and the second connection structure is formed by the pressure fitting engagement structure including the connection groove 55 and the plurality of elastic connection arms 68, it is possible to attach and detach the third member 3 to and from the second member 2 by pulling out and insertion which are much simpler than operations (screwing operations) for attaching and detaching the first member 1 and the second member 2 to and from each other. Moreover, because the elastic connection arms 68 are engaged and disengaged in and from the connection groove 55 while elastically deformed, it is possible to lightly attach and detach the third member 3 with small forces.

In the cosmetic tool according to the third invention group, the insertion preventing structure is provided between the container 1 and the treatment body 3 or between the application body 2 and the treatment body 3 to prevent insertion of the treatment body 3 into the container 1. For example, it is possible to prevent the shaping body 3 for shaping the eyelashes from being inserted into the container 1 for housing the mascara liquid by mistake. Therefore, according to the cosmetic tool of the present invention, it is possible to provide the cosmetic tool in which the container 1, the application body 2, and the treatment body 3 for performing the different functions are prevented from being attached to wrong attachment mating members and the respective members 1, 2, and 3 can be used correctly. In the state in which the three members, i.e., the container 1, the application body 2, and the treatment body 3 are connected, the application rod 11 of the application body 2 is housed inside the container 1 and the treatment rod 21 of the treatment body 3 is housed inside the application rod 11. Therefore, the respective members can be connected and used as the single cosmetic tool when they are not used. In this way, it is possible to provide the multifunctional cosmetic tool in which the respective members 1, 2, and 3 from becoming separated from each other when stored and from slipping into different storage spaces.

With the insertion preventing structure which is formed by the shield wall 62 provided to the portion of the grip 20 to be connected to the cap 10 and with which the outer face of the cap 10 is covered with the shield wall 62 in the state in which the application body 2 and the treatment body 3 are connected, it is impossible to detach the cap 10 covered with the shield wall 62 from the container 1 by operating only the cap 10. Therefore, even if the treatment body 3 is pulled out of the application body 2, the inlet/outlet 4 of the container 1 remains covered with the cap 10. In this way, it is possible to correctly use the application body 2 and the treatment body 3 while preventing the treatment rod 21 from being directly inserted into the container 1 by mistake. Although the application body 2 can be detached from the container 1 in the state in which the application body 2 and the treatment body 3 are connected, the treatment rod 21 is housed inside the application rod 11 in this case and it is impossible to insert the application rod 11 into the container 1. If the application body 2 and the treatment body 3 connected to each other are detached from the container 1, it is not impossible to pinch the application rod 11 to pull the treatment body 3 out of the application body 2 and the treatment body 3 detached from the application body 2 may be inserted into the container 1 in this case. However, the application rod 11 is thin and the mascara liquid is adhering to the application portion 12 and a surface of the rod, which makes a user to hesitate to dirty its hand to try to carry out the above-described detaching operation. Therefore, by providing the insertion preventing structure for covering the outer face of the cap 10 with the shield wall 62, it is possible to reliably prevent the treatment body 3 from being pulled out of the application body 2 to thereby prevent the treatment body 3 from being inserted into the container 1.

With the insertion preventing structure which is formed by the shield wall 65 provided at the periphery of the inlet/outlet 4 of the container 1 and with which the outer face of the cap 10 attached to the container 1 is covered with the shield wall 65, it is impossible to detach the cap 10 covered with the shield wall 65 from the container 1 by operating only the cap 10 in the state in which the treatment body 3 is detached from the application body 2. Therefore, even if the treatment body 3 is pulled out of the application body 2, the inlet/outlet 4 of the container 1 remains covered with the cap 10. In this way, it is possible to correctly use the application body 2 and the treatment body 3 while preventing the treatment rod 21 from being directly inserted into the container 1 by mistake.

With the insertion preventing structure which is formed by the inner shield wall 62 provided to the connected portion of the grip 20 and the outer shield wall 65 provided at the periphery of the inlet/outlet 4 of the container 1, the periphery of the cap 10 is surrounded with inner and outer two shield walls 62 and 65, which further complicates the detaching operation of the application body 2 from the container 1 to properly prevent the treatment body 3 from being inserted into the container 1 by mistake.

With the insertion preventing structure which is formed by the insertion preventing chip 310 and the spring 311 for displacing and biasing the insertion preventing chip 310 into the insertion preventing attitude, it is possible to structurally prevent the treatment rod 21 from being inserted into the container 1 by receiving the insertion preventing chip 310 by an opening end portion of the inlet/outlet 4 of the container 1. Therefore, even in the state in which the application body 2 is detached from the container 1, it is possible to correctly use the cosmetic tool while preventing the treatment rod 21 from being inserted into the container 1. To house the treatment rod 21 into the application rod 11, it is possible to insert the treatment rod 21 into the application rod 11 to attach the treatment body 3 to the application body 2 without hindrance by only bringing the insertion preventing chip 310 into the insertion allowing attitude against the biasing force of the spring 311.

If the insertion preventing structure is formed by the first magnet 316 and the second magnet 317 set to have polarities repelling each other, both the magnets 316 and 317 repel each other when a lower portion of the treatment rod 21 approaches the vicinity of the opening of the inlet/outlet 4 to call user's attention to thereby prevent an operation for inserting the treatment rod 21. Therefore, it is possible to restrict the operation for inserting the treatment rod 21 when the user tries to insert the treatment body 3 into the container 1 on purpose with a mischievous intention, not to mention when the user tries to insert the treatment body 3 into the container 1 by mistake.

In the cosmetic tool according to the fourth invention group, the heating portion 22 of the heating rod 21 is positioned inside the treatment portion 185 of the application rod 11 in the state in which the heating body 3 is connected to the application body 2 and the heating rod 21 is housed in the housing hole 187. If the heating portion 22 is positioned inside the treatment portion 185 in this manner, it is possible to efficiently transfer the heat generated by the heating portion 22 to the treatment portion 185 to thereby swiftly heat the application portion 12. Therefore, it is possible to quickly heat the cosmetic material held by the application portion 12 to thereby shorten a waiting time until the cosmetic material is heated to a temperature suitable for application. Moreover, because the application body 2 and the heating body 3 are detachably connected by a connection structure, it is possible to easily detach the application body 2 from the heating body 3. Therefore, the application body 2 can be easily replaced when the application body gets broken. If stains are stuck to the application body 2, the application body 2 can be easily washed with hot water and the like and can be used again.

If the gap G1 between the inner face 188 of the treatment portion 185 and the heating portion 22 is set to be smaller than the gap G2 between the respective stem portions 186 and 194 of the application rod 11 and the heating rod 21 in the state in which the heating body 3 is connected to the application body 2, it is possible to suppress heat transfer between the respective stem portions 186 and 194. More specifically, it is possible to make transfer of the heat from the stem portion 194 of the heating rod 21 to the stem portion 186 of the application rod 11 smaller than that from the heating portion 22 to the treatment portion 185 by utilizing heat insulating effect of an air space between the respective stem portions 186 and 194. Therefore, it is possible to improve heat transfer efficiency from the heating portion 22 to the treatment portion 185 to thereby swiftly heat the application portion 12.

If the thickness t1 of the application portion side cylindrical wall 190 is set to be smaller than the thickness t2 of the opposed cylindrical wall 191, it is possible to swiftly transfer heat generated by the heating portion 22 to a surface of the application portion side cylindrical wall 190 due to the smaller thickness of the cylindrical wall. Therefore, it is possible to swiftly heat the application portion 12. Moreover, a volume of the application portion side cylindrical wall 190 having the smaller thickness is smaller than a volume of the opposed cylindrical wall 191 and therefore a heat capacity of the application portion side cylindrical wall 190 is small and, as a result, it is possible to further swiftly heat the application portion 12.

If the outer diameter D2 of the stem portion 194 of the heating rod 21 is set to be smaller than the outer diameter D1 of the heating portion 22, it is possible to suppress a heat quantity to be transferred from the heating portion 22 to a grip 20 via the stem portion 194. Therefore, it is possible to efficiently transfer heat of the heating portion 22 to the treatment portion 185 to further swiftly heat the application portion 12. Furthermore, if the heat insulating space S1 is formed between both the stem portions 186 and 194, the air space serves as heat insulating material to suppress the heat transfer from the stem portion 194 of the heating rod 21 to the stem portion 186 of the application rod 11. As a result, most of the heat generated by the heating portion 22 can be transferred to the application portion 12, which suppresses power consumption of the heater 29.

If one or more division walls 195 are provided to the stem portion 194 of the heating rod 21 to divide the heat insulating space S1 into the plurality of spaces in the vertical direction, convection of air in the vertical direction in the heat insulating space S1 can be divided by the division walls 195. Therefore, it is possible to suppress transfer of the heat of the heating portion 22 to the stem portion 186 of the application rod 11 and the grip 20 due to the convection of the air in the heat insulating space S1 to thereby efficiently heat the application portion 12 with the heating portion 22.

If the inner faces 188 of at least the application portion side cylindrical wall 190 and the opposed cylindrical wall 191 of the application rod 11 are tapered from the base end side toward the end portion side, a sectional area of a face orthogonal to the central axis of the application rod 11 can be increased toward the end portion. In this way, a volume per unit length is larger at the treatment portion 185 than at the stem portion 186 so that a storage of heat of the heated treatment portion 185 is large and that the treatment portion 185 is less liable to become cold. If at least the application portion side cylindrical wall 190 and the opposed cylindrical wall 191 are tapered from the base end side toward the end portion side, it is possible to make the gap G1 between the inner face 188 of the treatment portion 185 and the heating portion 22 smaller than the gap G2 between the respective stem portions 186 and 194 of the application rod 11 and the heating rod 21 in the state in which the heating body 3 is connected to the application body 2. In this way, it is possible to make transfer of the heat from the stem portion 194 of the heating rod 21 to the stem portion 186 of the application rod 11 smaller than that from the heating portion 22 to the treatment portion 185 by utilizing heat insulating effect of the air space between the respective stem portions 186 and 194. Therefore, it is possible to improve heat transfer efficiency from the heating portion 22 to the treatment portion 185 to thereby swiftly heat the application portion 12.

If the heater 29 is disposed while displaced toward the application portion side cylindrical wall 190 with respect to the central axis O of the application rod 11, the heater 29 can be brought close to the inner face 188 of the application portion side cylindrical wall 190. Therefore, it is possible to efficiently transfer the heat to the application portion side cylindrical wall 190 to thereby swiftly heat the application portion 12.

If the lower step portion 196 is formed at the heating portion 22 facing the opposed cylindrical wall 191 and the heat insulating space S2 is provided between the opposed cylindrical wall 191 and the heating portion 22, it is possible to effectively suppress transfer of the heat from the heating portion 22 to the opposed cylindrical wall 191 facing the heating portion 22 with the heat insulating space S2 interposed therebetween by using the heat insulating space S2 to thereby swiftly heat the application portion 12.

If the stem portion 194 of the heating rod 21 is made of foamable resin, it is possible to effectively suppress transfer of the heat of the heating portion 22 to the grip 20 via the stem portion 194 of the heating rod 21. Therefore, it is possible to efficiently transfer the heat of the heating portion 22 to the treatment portion 185 to thereby swiftly heat the application portion 12. Moreover, the foamable resin serves as heat insulating material to suppress transfer of the heat from the stem portion 194 of the heating rod 21 to the stem portion 186 of the application rod 11. Therefore, most of the heat generated by the heating portion 22 is transferred to the application portion 12, which suppresses power consumption of the heater 29.

The cosmetic tool includes the container 1 for housing the mascara liquid, the application body 2 to be detachably attached to the container 1, and the heating body 3 detachably connected to the application body 2. The heating rod 21 of the heating body 3 is housed inside the application rod 11 inserted into the container 1 in the state in which the container 1, the application body 2, and the heating body 3 are connected. In this way, by only taking the application body 2 out of the container 1 together with the heating body 3, the mascara liquid is held by the application portion 12 and it is possible to apply the mascara liquid heated to the suitable temperature to the eyelashes. Moreover, in the state in which the heating body 3 is detached from the application body 2, it is possible to use the heating portion 22 to carry out a different cosmetic treatment from that carried out with the application body 2.

In the cosmetic tool according to the fifth invention group, the members for performing the different functions are provided as the attachments and the attachments are respectively attached to the heating portion 208 of the main body portion 200 and replaced by each other to make the cosmetic tool multifunctional. Therefore, by replacing the attachments A according to the cosmetic treatments carried out in an orderly sequence, it is possible to deftly carry out the series of cosmetic treatments. Because the attachment A attached to the main body portion 200 or the heating portion 208 is sensed by the sensor structure and the temperature state of each of the attachments A is controlled to be the temperature suitable to the cosmetic treatment, it is possible to properly and suitably carry out the cosmetic treatment by using each of the attachments A. Moreover, because the attachment A attached to the main body portion 200 or the heating portion 208 can be identified by the sensor structure, it is only necessary for a user to attach each of the attachments A in a predetermined attitude into a predetermined position to heat each of the attachments A to a suitable temperature without the necessity of carrying out complicated operations such as switching of a switch.

According to the cosmetic tool in which the heating shaping portion 208 for shaping the eyelashes is provided to the main body portion 200 and the application body 201 for applying the mascara liquid is formed as the attachment A, it is possible to attach the application body 201 to the main body portion 200 to carry out application of the mascara liquid after carrying out shaping of the eyelashes with the heating shaping portion 208. Moreover, in carrying out the shaping of the eyelashes with the heating shaping portion 208 and in carrying out the application of the mascara liquid with the application body 201, the temperature states of the heating shaping portion 208 and the application body 201 are suitably adapted to the respective treatments. Therefore, it is possible to deftly carry out the series of cosmetic treatments for the mascara application.

According to the cosmetic tool in which the heating shaping portion 208 for shaping the eyelashes is provided to the main body portion 200 and the eyelash shaping bodies 202 and 203 for shaping the eyelashes are formed as the attachments A, it is possible to divide the shaping treatment of the eyelashes into a plurality of treatments to suitably carry out them. For example, after roughly shaping the eyelashes with the heating shaping portion 208, the eyelash shaping body 202 or 203 is attached to the heating shaping head 208 to more finely shape the upper eyelashes or to more finely shape the lower eyelashes.

According to the sensor structure in which the conductive terminal 249, 256, 258 provided to the attachment A makes the paired connection terminals 248, 255, 257 provided to the main body portion 200 electrically continuous with each other so that an attached state of the attachment A is sensed, it is possible to clearly sense whether or not the attachment A is attached to the heating portion 208. If the connection terminals 248, 255, and 257 and the conductive terminals 249, 256, and 258 are provided to correspond to the respective attachments A, it is possible to identify the attachment A attached to the heating portion 208. Therefore, the control circuit can identify the attachment A attached to the heating portion 208 to automatically heat the attachment A to the suitable temperature.

According to the sensor structure formed by the light sensor 261 and the light shielding body 262, it is possible to sense whether or not the attachment A is attached to the heating portion 208 without contact. Therefore, it is unnecessary to consider wearing and a loose connection as compared with the sensor structure using the contact terminals as the sensor elements, which increases reliability.

According to the sensor structure in which the reed switch 281 and the magnet 282 are used as the sensor elements, it is possible to further stabilize the sensing operation. If needed, the reed switch 281 and the magnet 282 can be provided in embedded states, which further increases reliability of the sensor structure.

BRIEF DESCRIPTION OF THE DRAWINGS

FIG. 2 is a side view of the cosmetic tool with an application portion detached from a container.

FIG. 15 is a partially cutaway side view of the cosmetic tool in shaping of the eyelashes.

FIG. 70 is a partially cutaway side view showing a mode of use of another attachment.

Figure 1:
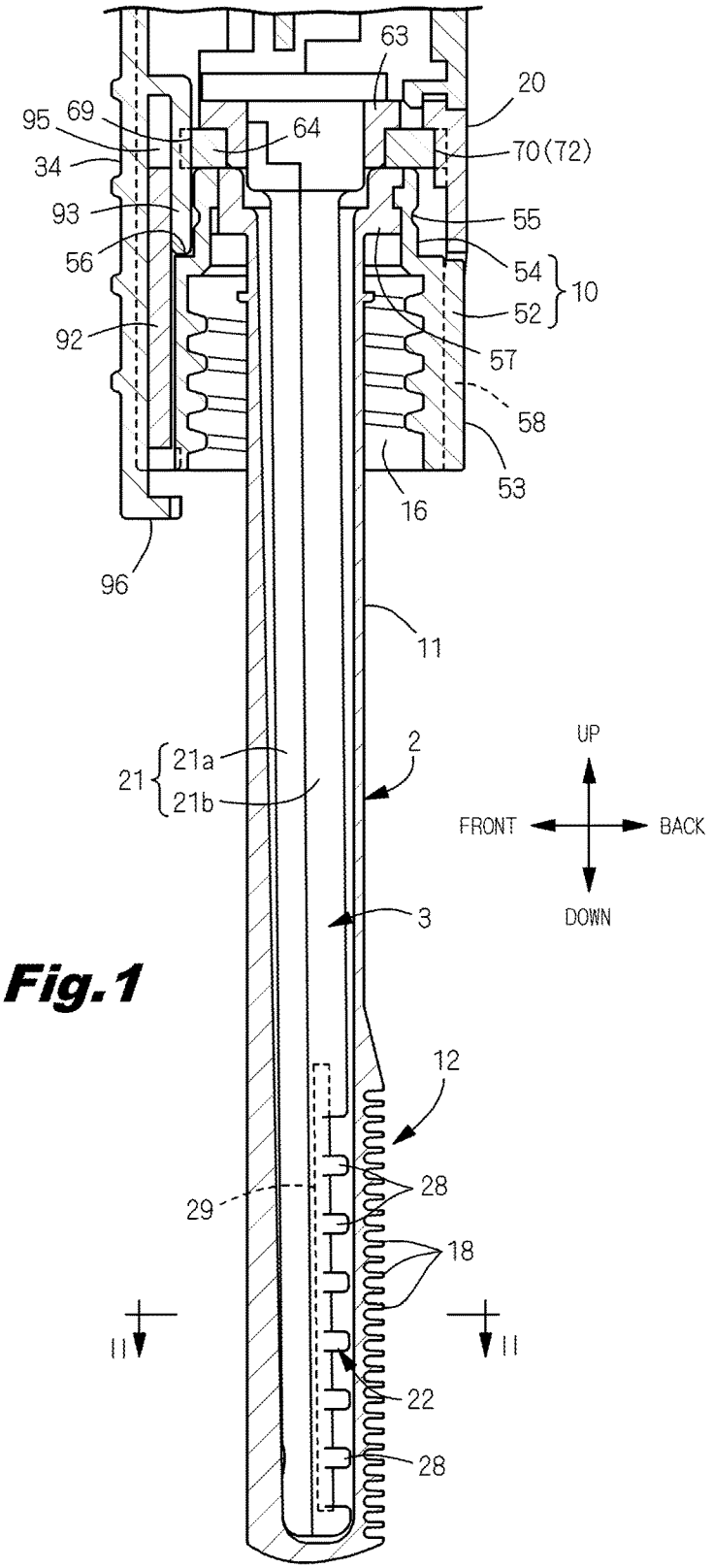
FIG. 1 is a vertical sectional side view showing a structure of an application body of a cosmetic tool according to a first invention group.

MODES FOR CARRYING OUT THE INVENTION ( Embodiments of Cosmetic Tool according to First Invention Group)

FIGS. 1 to 16 show embodiments in which a cosmetic tool according to the present invention is applied to mascara applicators. In the present invention, "front", "back", "left", "right", "up", and "down" conform to crossed arrows shown in FIGS. 1 and 2 and indications, "front", "back", "left", "right", "up", and "down" shown close to the respective arrows. These definitions of the directions are applied to cosmetic tools according to the second to fifth invention groups. In FIG. 2, the mascara applicator is formed by a container 1 for housing mascara liquid, an application body 2 to be attached to and detached from the container 1, a shaping body 3 to be attached to and detached from the application body 2, and the like.

The container 1 is formed into a circular cylindrical shape and an inlet/outlet 4 for the application body 2 is open in an upper end of the container 1. A threaded shaft 5 is formed on a peripheral face of the inlet/outlet 4 and a wiper 6 for squeezing the surplus attached mascara liquid is provided on an inner face of the inlet/outlet 4. The wiper 6 is formed by a cylindrical body made of rubber or plastic material and a squeezing opening 7 is formed in a bottom wall of the cylindrical body.

In FIG. 1, the application body 2 is formed by a cylindrical cap (application grip) 10 to be attached to and detached from the inlet/outlet 4 in the container 1, an application rod 11 in a shape of a hollow shaft having a closed tip end to be inserted into the container 1, and an application portion 12 provided to a lower end portion of the application rod 11. The cap 10 is provided with a connection portion for the container 1 and a connection portion for the shaping body 3. The connection portion for the container 1 is formed by a threaded cap 52 occupying a most part of the cap 10 and a threaded hole 16 corresponding to the above-described threaded shaft 5 is formed on an inner face of the threaded cap 52. On an outer face of the cap 10, a positioning rib 53 which is long in a vertical direction is formed.

Figure 7:
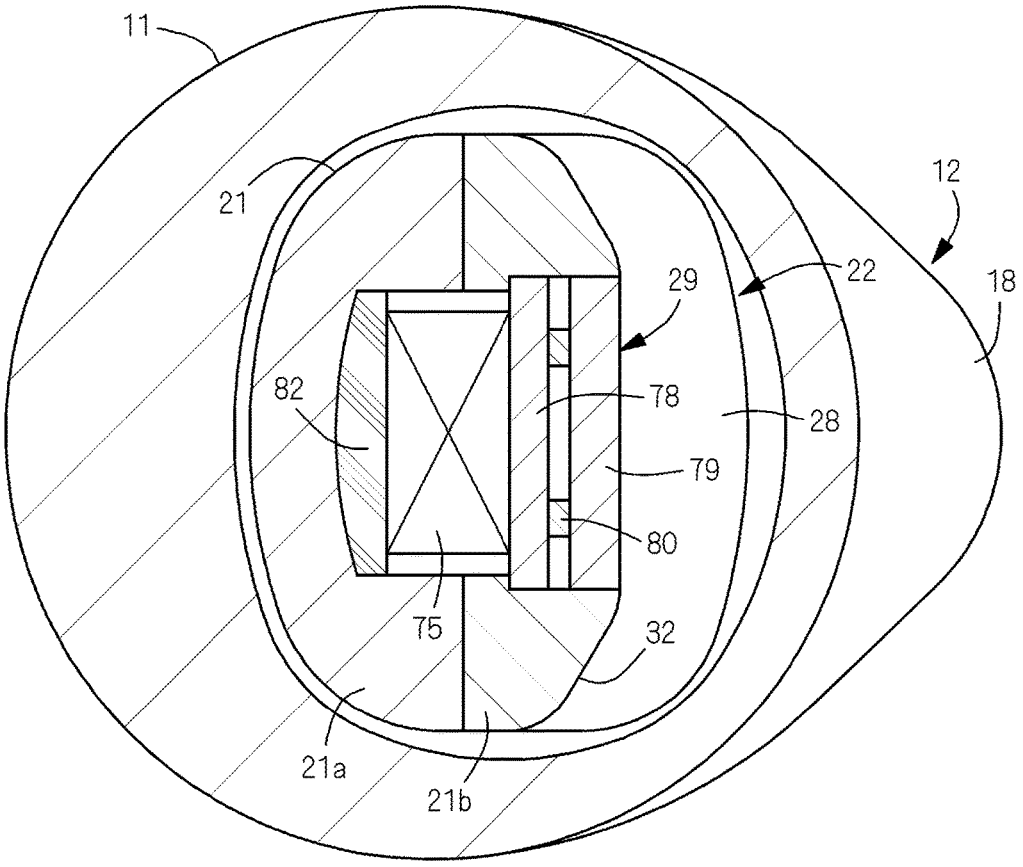
FIG. 7 is a sectional view taken along line II-II in FIG. 1.

The connection portion for the shaping body 3 is formed by a connection boss 54 continuous with an upper portion of the threaded cap 52 and a connection groove 55 formed in an annular shape in a peripheral face of the connection boss 54. An outer diameter of the connection boss 54 is set to be smaller than an outer diameter of the threaded cap 52 and a shoulder wall between a base end of the connection boss 54 and the threaded cap 52 functions as a restricting portion 56 of a stopper 93 (described later). By fitting and engaging a rod boss 57 provided to an upper end of the above-described application rod 11 with an inner face of the connection boss 54 with pressure, the application rod 11 is integrated with the cap 10 so as not to be detachable. As shown in FIG. 1, the application portion 12 is formed by a group of comb teeth (application elements) 18 formed on a side of a periphery of the application rod 11 and can hold the mascara liquid between the adjacent comb teeth 18. As shown in FIG. 7, each of the comb teeth 18 is formed into a shape of a tongue chip with a rounded tip end. In order to swiftly heat the entire application portion 12 with heat of a heater 29, a peripheral wall of the application portion 12 supporting the comb teeth 18 is formed to be thinner than the other peripheral wall.

The shaping body 3 is formed by a circular cylindrical shaping grip 20 serving also as a main body case of the mascara applicator, a hollow shaping rod 21 protruding downward from a lower end of the shaping grip 20, a heating shaping portion 22 provided to a lower end (protruding end) of the shaping rod 21, and the like. A battery lid 24 in a shape of a gutter is detachably provided to one side of an upper half of the shaping grip 20 and a board cover 60 in a shape of a gutter is disposed on a lower side of the battery lid 24. Inside the shaping grip 20, a battery 33, a control board 61, a switch structure, and the like are housed. A switch knob 34 for turning on and off energization of the heater 29 is provided to one side of a lower end portion of the shaping grip 20 and a positioning groove 58 for receiving the above-described positioning rib 53 is formed on the other side. A lower end of the switch knob 34 faces a contact portion between the shaping grip 20 and the cap 10.

Figure 4:
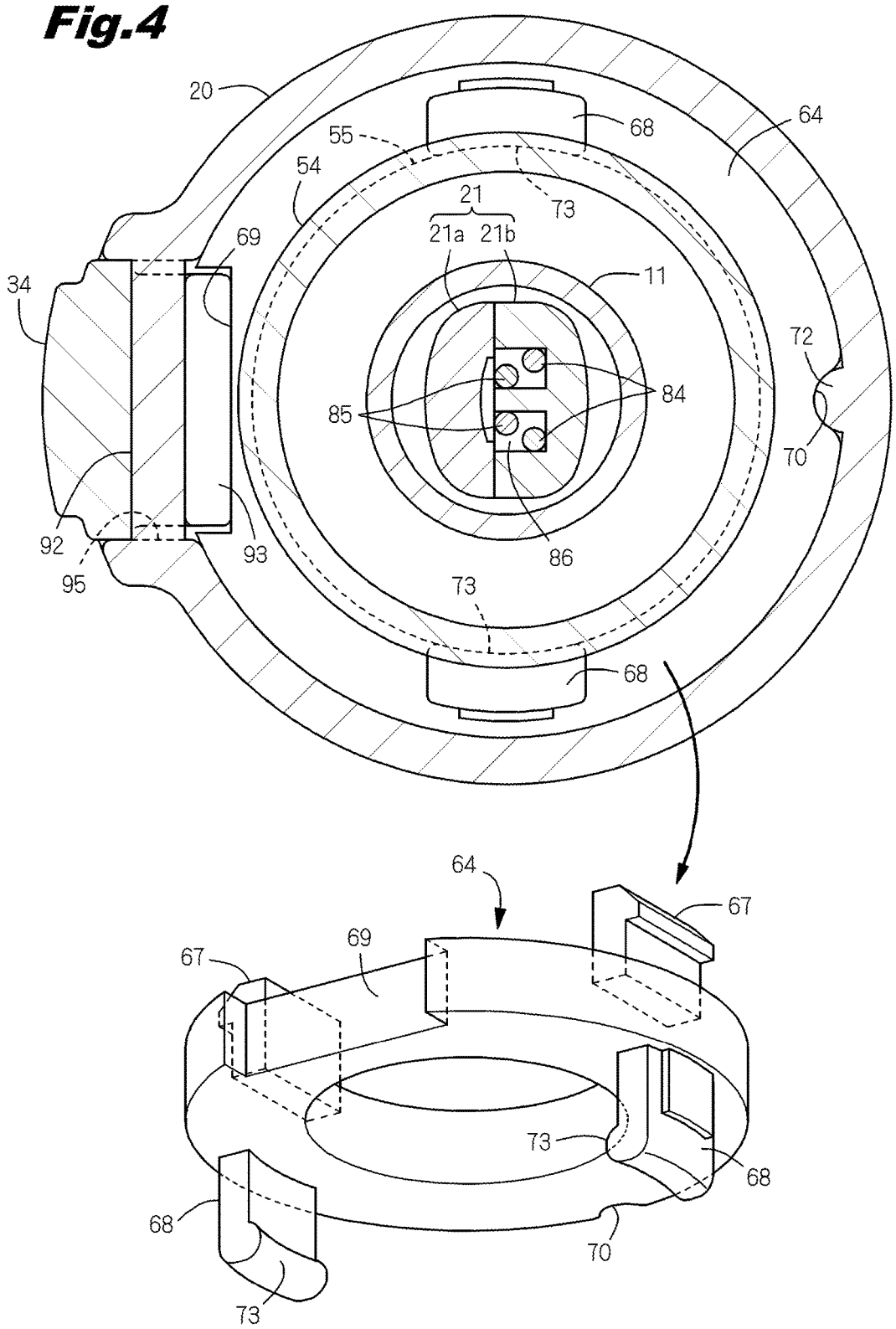
FIG. 4 is a sectional view taken along line I-I in FIG. 8.

As shown in FIG. 1, inside the shaping grip 20, a ring-shaped mounting boss 63 is integrally formed with a lower end of an area of the shaping grip 20 housing the control board 61 and an upper portion of the shaping rod 21 is attached to the mounting boss 63 by fitting with pressure. A connection ring 64 for making the connection boss 54 of the cap 10 detachable is fixed to the mounting boss 63. As shown in FIG. 4, from right and left opposed positions of an upper face and a lower face of the connection ring 64, paired engagement lugs 67 and paired elastic connection arms 68 protrude. Moreover, at front and back opposed positions of a peripheral face of the connection ring 64, a guide recessed portion 69 for guiding sliding of the stopper 93 (described later) and a positioning recessed portion 70 are formed.

Figure 5:
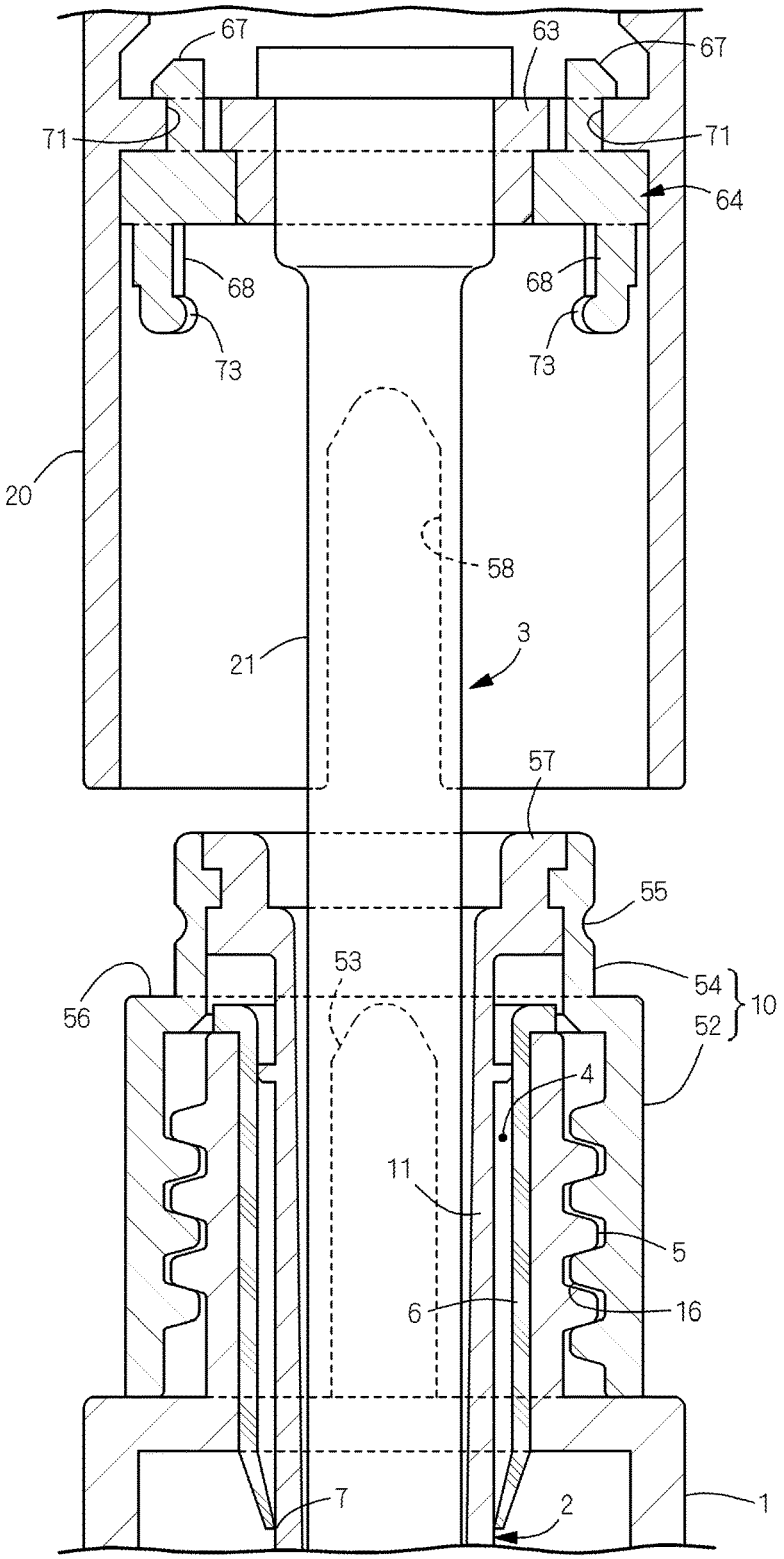
FIG. 5 is a vertical sectional front view of a state in which an application body and a shaping body are detached from each other.

As shown in FIG. 5, by engaging the paired engagement lugs 67 in an engagement groove 71 formed in the above-described mounting boss 63 from a lower face side, the connection ring 64 is fixed to the mounting boss 63 so as not to be detachable. At this time, the positioning recessed portion 70 is positioned by a positioning protrusion 72 provided to an inner face of the shaping grip 20 (see FIG. 4). A connection lug 73 having a semicircular section is provided to an inner face of a lower end of each of the elastic connection arms 68. By engaging and disengaging the connection lugs 73 in and from the connection groove 55 in the connection boss 54, the application body 2 and the shaping body 3 can be integrated with each other or the shaping body 3 can be detached from the application body 2.

Figure 6:
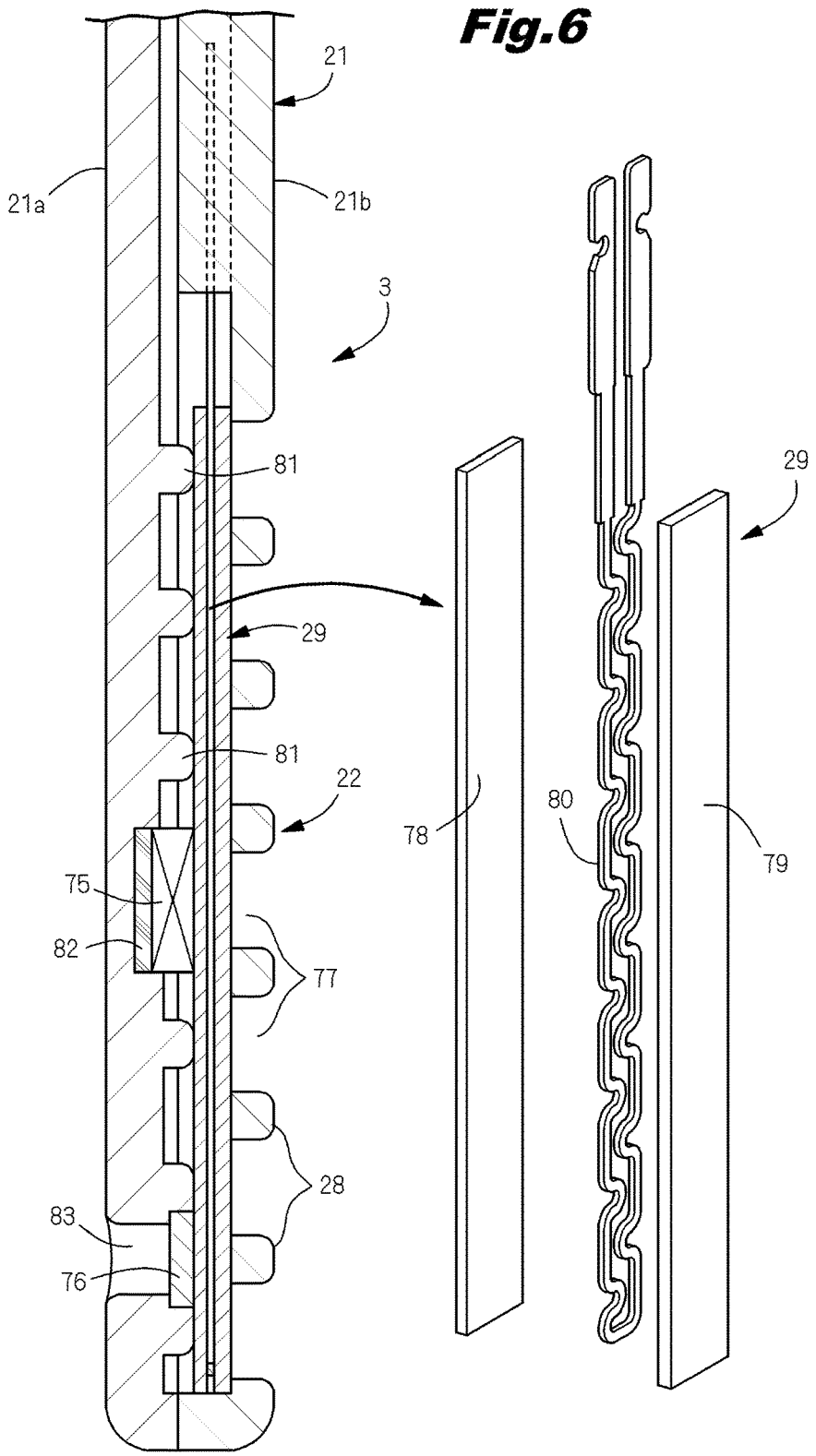
FIG. 6 is a vertical sectional side view of a heating shaping portion.

As shown in FIG. 6, the shaping rod 21 is formed by joining a left rod body 21*a* and a right rod body 21*b* to each other in a lid-fitting manner. The heating shaping portion 22 is provided to a lower end of the right rod body 21*b* and formed by a large number of comb teeth 28 disposed at constant intervals in the vertical direction and the heater 29, a thermistor 75, and a thermochromic element 76 are disposed inside the heating shaping portion 22. Heating windows 77 are open between the comb teeth 28 and an outer surface of the heater 29 is exposed through the respective heating windows 77. As shown in FIG. 7, each of the comb teeth 28 is formed into a petal shape having a left-right dimension sufficiently greater than its protruding dimension.

In FIG. 6, the heater 29 is formed as a sheet heater by paired inner and outer insulating sheets 78 and 79 and a heater element 80 sandwiched and retained between the opposite insulating sheets 78 and 79 and these three members are integrally fixed by thermosetting adhesive material. In order to firmly fix and retain the heater 29 with the front and back rod bodies 21*a* and 21*b*, heater support protrusions 81 are formed at a large number of positions of an inner face of the left rod body 21*a* and inner and outer faces of the heater 29 are sandwiched between the protrusions 81 and the comb teeth 28.

The thermistor 75 is disposed at a central portion in the vertical direction of the heater 29 and moved and biased by a heat-resisting sponge (elastic body) 82 disposed between the inner face of the left rod body 21*a* and the thermistor 75 to come in close contact with an inner face of the heater 29. In order to visually recognize a state of color change of the thermochromic element 76, a visual recognition window 83 is open near a lower end of the left rod body 21*a*. A user can know that the temperature of the heater 29 has reached the suitable temperature by recognizing a color given by the thermochromic element 76 through the visual recognition window 83. As shown in FIG. 4, in the right rod body 21*b*, lead wire grooves 86 for housing lead wires 84 for the heater element 80 and lead wires 85 for the thermistor 75 are formed with a division wall interposed therebetween.

Figure 3:
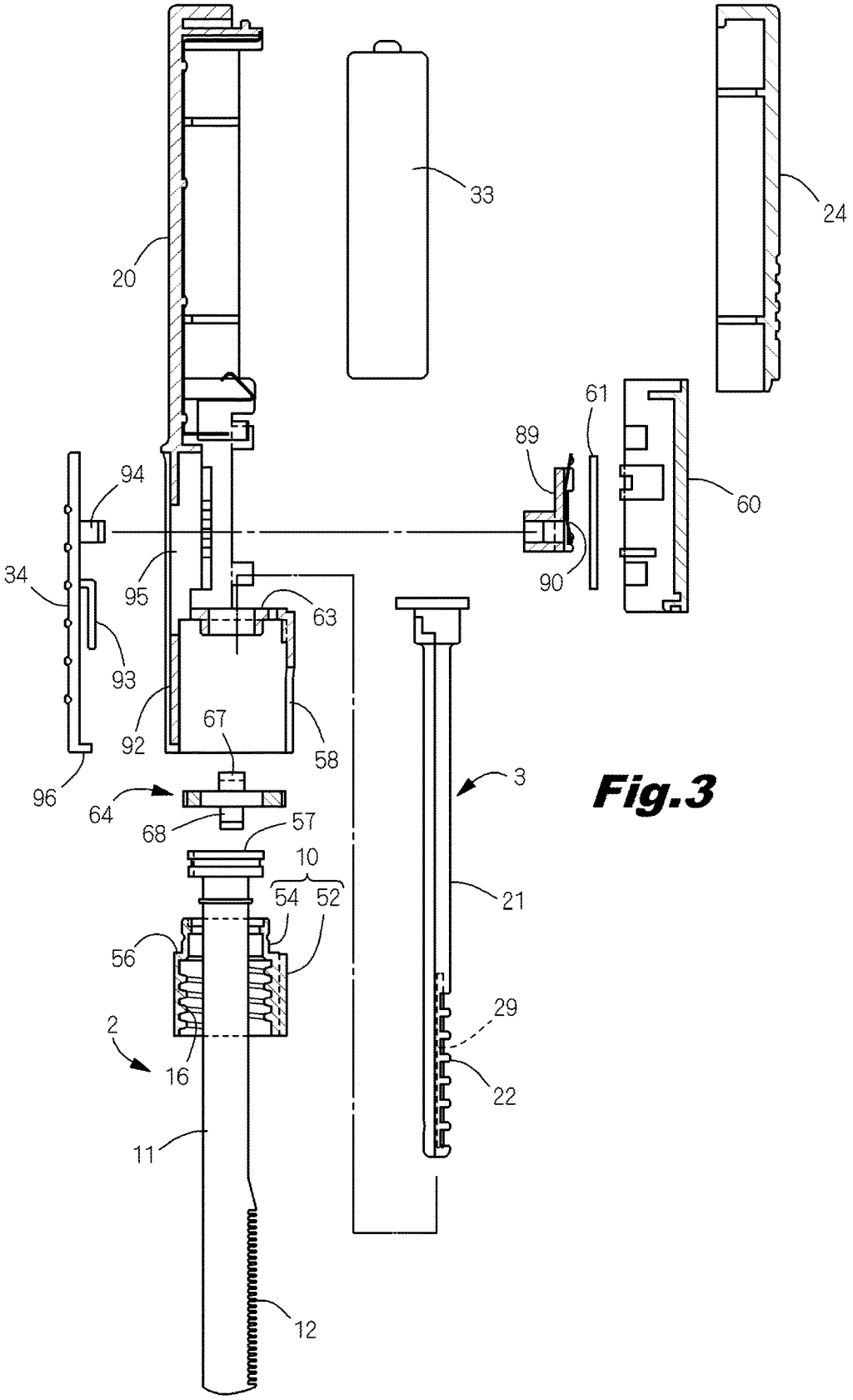
FIG. 3 is an exploded sectional view of a cosmetic tool.
Figure 8:
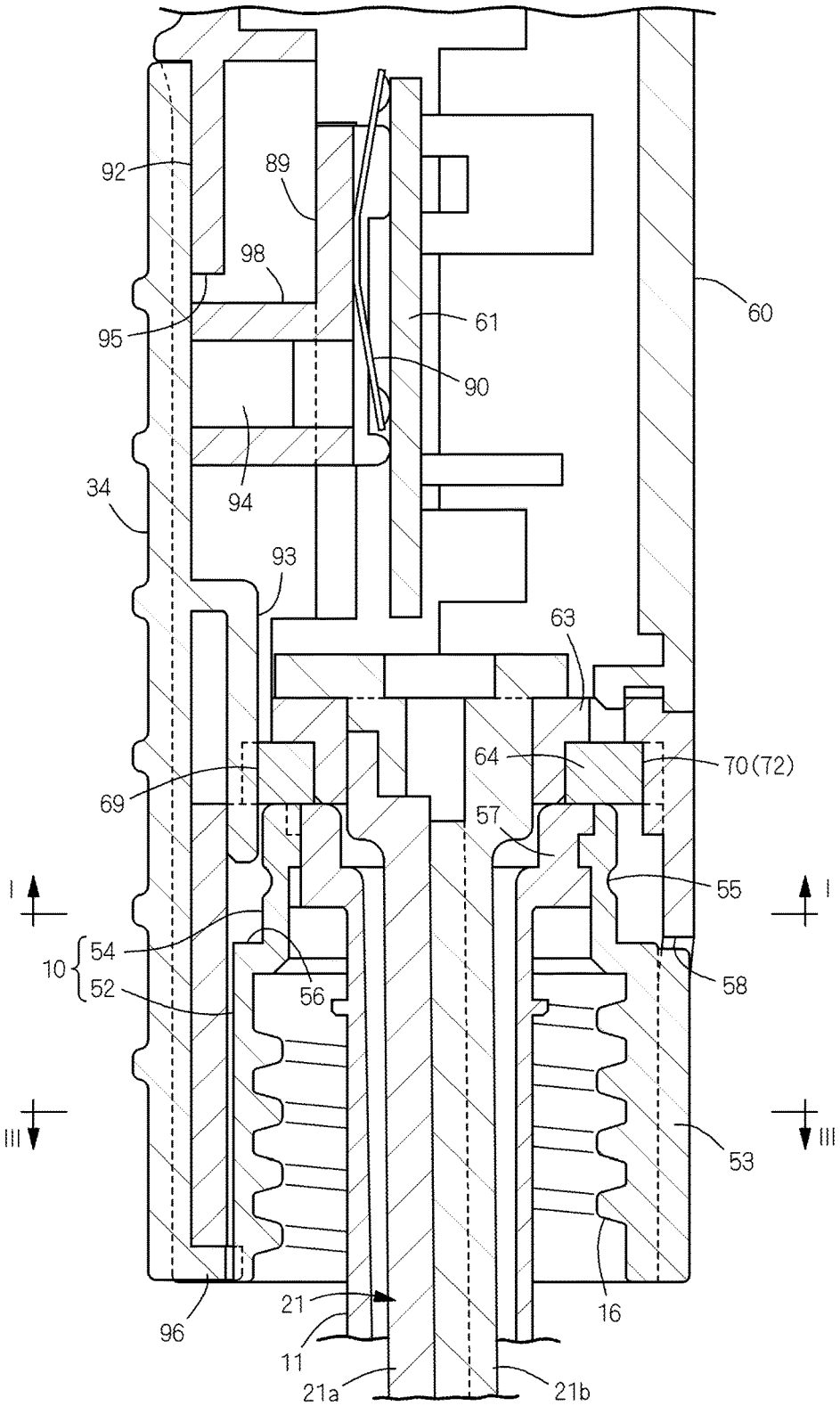
FIG. 8 is a vertical sectional side view in a state in which the application body and the shaping body are connected.

In FIGS. 8 and 3, the switch structure is formed by a terminal plate 89 to be slid by the switch knob 34, paired movable terminals 90 fixed to the terminal plate 89, a fixed terminal (not shown) provided to the control board 61, a tactile structure, and the like. The switch knob 34 is guided and supported by a knob seat 92 on a side face of the shaping grip 20 to be able to slide up and down and a stick-shaped stopper 93 and paired operation lugs 94 are provided to an inner face of the switch knob 34. In order to allow sliding of the stopper 93 and the operation lugs 94, a slide opening 95 is formed in the knob seat 92. An inner wall of the knob seat 92 functions also as a guide wall for guiding sliding of the stopper 93.

From a lower end of the switch knob 34, a restricting chip 96 for preventing switching of the switch knob 34 into an ON state in an unused state sticks out inward. The unused state here refers to a state in which the threaded hole 16 of the application body 2 to which the shaping body 3 is attached is completely screwed over the threaded shaft 5 of the container 1 and the restricting chip 96 in this state is received by the shoulder wall of the container 1. If the switch knob 34 has been switched into the ON state, the restricting chip 96 is pushed up by the shoulder wall of the container 1 as the application body 2 is screwed over the threaded shaft 5 and therefore the switch knob 34 is forcibly switched into an OFF state.

Figure 9:
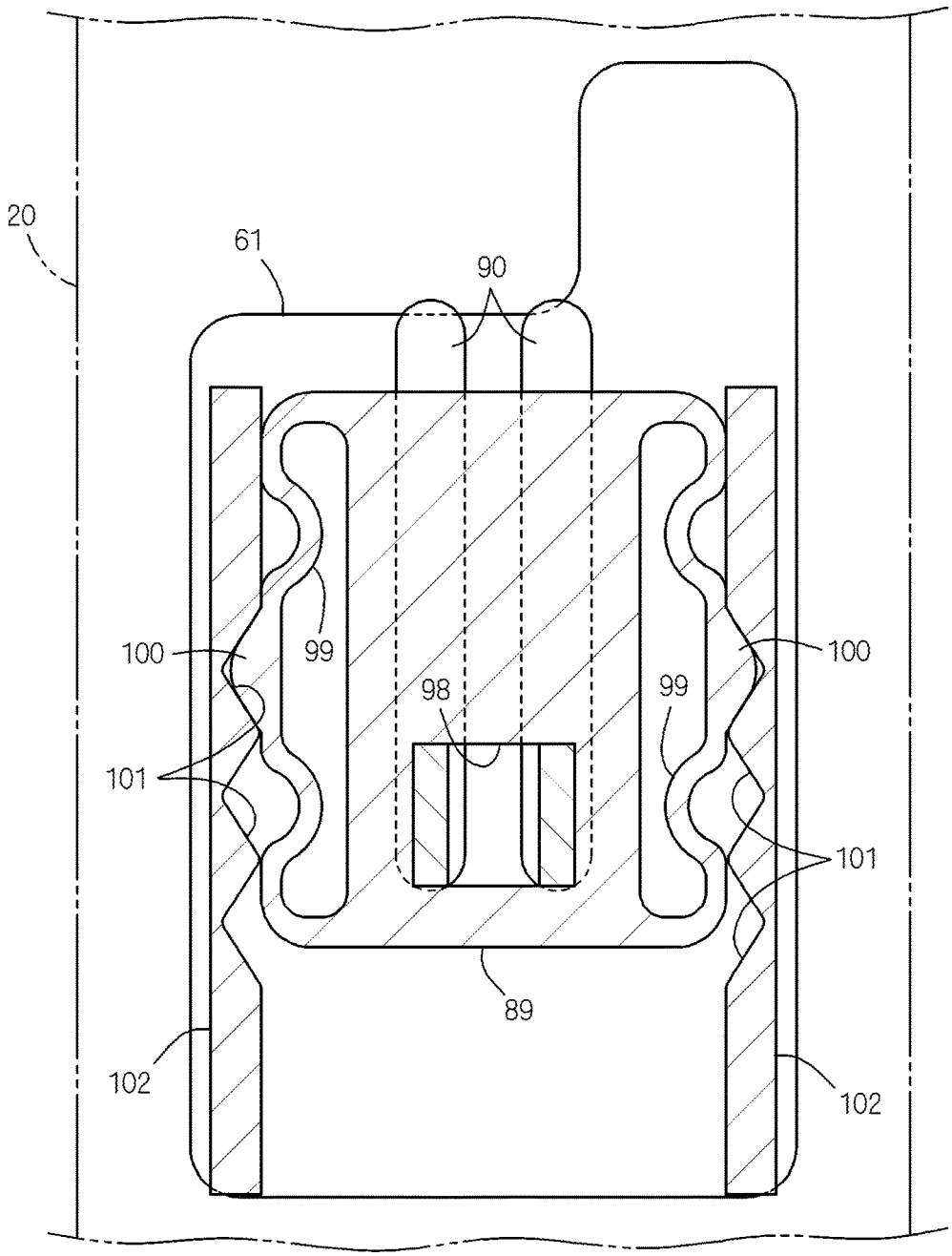
FIG. 9 is a cross-sectional front view of a tactile structure applied to a switch structure.
Figure 10:
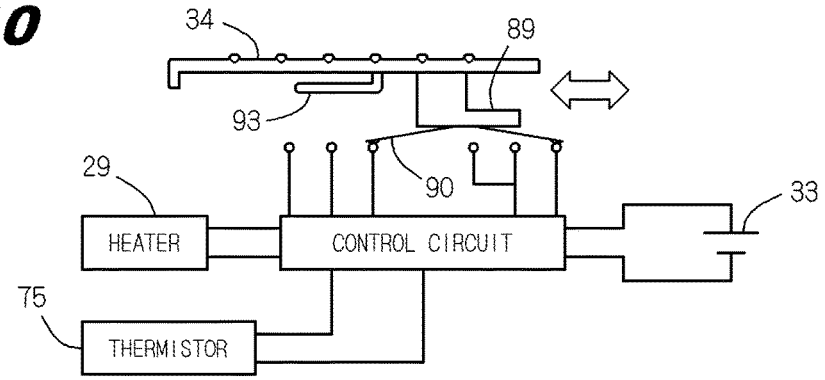
FIG. 10 is an explanatory view showing a relationship between a switch knob and a control circuit.

A rectangular engagement boss 98 to be engaged with the operation lugs 94 is provided to a face of the terminal plate 89 facing the switch knob 34 and the terminal plate 89 is supported by the switch knob 34 by fitting of the paired operation lugs 94 with the engagement boss 98. In FIG. 9, the tactile structure is formed by elastic arms 99 formed integrally with long side portions of the terminal plate 89, tactile protrusions 100 provided to outer faces of centers of the elastic arms 99, and paired fixed walls 102 having three tactile recessed portions 101, and the like. The fixed walls 102 are integrally molded with an inner face of a peripheral wall of the shaping grip 20.

In order to respectively bring a temperature state of the heating shaping portion 22 in shaping the eyelashes by using the shaping body 3 and a temperature state of the application portion 12 in applying the mascara liquid to the eyelashes by using the application body 2 into suitable states, the switch structures can be switched among three states by use of the switch knob 34. To put it concretely, a state in FIG. 8 in which the switch knob 34 is positioned at an upper end of the knob seat 92 is the OFF state and a state in FIG. 13 in which the switch knob 34 is slid down a step from the OFF state is a first ON state. A state in FIG. 14 in which the switch knob 34 is slid down another step from the first ON state is a second ON state.

Figure 11:
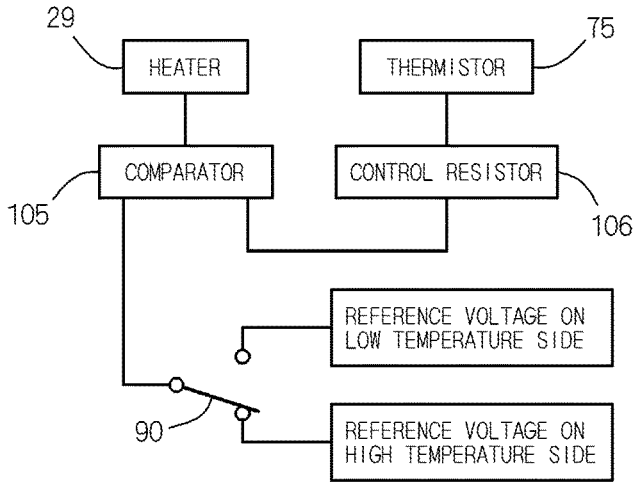
FIG. 11 is a block diagram showing a manner of temperature control of a heater.
Figure 12:
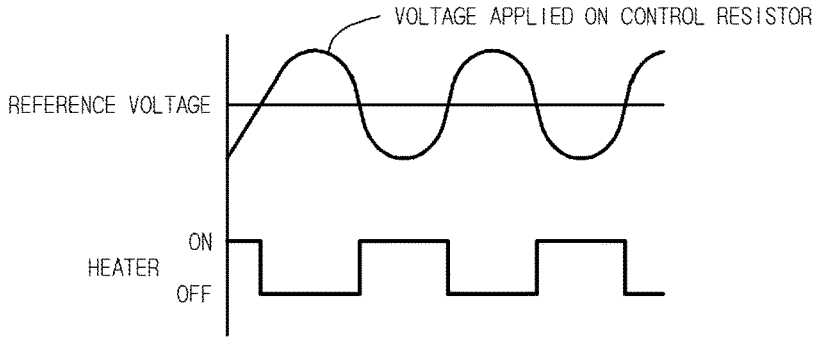
FIG. 12 is a timing chart showing an operating principle of a comparator.

In the first ON state, a heater drive signal is output from a comparator 105 shown in FIG. 11 to a switching element and a drive current is supplied from the battery 33 to the heater element 80 to increase the temperature of the heater 29. As a result, a temperature of the thermistor 75 increases and a resistance decreases and therefore a voltage applied to the thermistor 75 decreases and a voltage applied to a control resistor connected in series to the thermistor 75 increases. When the voltage applied to the control resistor exceeds a reference voltage (reference voltage on a low-temperature side) shown in FIG. 12, output of the comparator 105 is stopped, supply of the drive current to the heater element 80 is stopped, and the temperature of the heater 29 decreases. If the temperature of the heater 29 decreases, the temperature of the thermistor 75 decreases and the resistance increases. Therefore, the voltage applied to the thermistor 75 increases and the voltage applied to the above-described control resistor decreases. When the voltage applied to the control voltage decreases below the reference voltage (reference voltage on the low-temperature side), the heater drive signal is output from the comparator 105 to the switching element and the supply of the drive current to the heater element 80 is resumed. After that, these steps are repeated to maintain a heat generating state of the heater 29 in a low-temperature state (40° C.). The heat generating state of the heater 29 may be set according to composition, viscosity characteristics, and the like of the mascara liquid and the low-temperature state may be temperatures other than 40° C.

In the second ON state, the reference voltage is switched to a reference voltage on a high-temperature side based on which control similar to the above-described control is carried out to maintain the heat generating state of the heater 29 in a high-temperature state (70° C.). A power supply section for supplying the reference voltage on the low-temperature side and the reference voltage on the high-temperature side, the comparator 105, and the like are provided to the control board 61.

In the unused state of the mascara applicator, the threaded hole 16 provided to the cap 10 is screwed over the threaded shaft 5 and the application body 2 and the container 1 are integrated with each other. The application rod 11 and the application portion 12 in this state are immersed in the mascara liquid housed in the container 1. The shaping rod 21 of the shaping body 3 is housed inside the application rod 11 of the application body 2 and the connection groove 55 provided to the connection boss 54 of the application body 2 is engaged with and caught by the elastic connection arms 68 of the connection ring 64. Because the shaping rod 21 in this state is housed inside the application rod 11 having a closed structure, the entire shaping rod 21 including the heating shaping portion 22 is not immersed in the mascara liquid. Therefore, in the unused state, the mascara liquid in the container 1 does not adhere to the shaping rod 21. In the unused state, the restricting chip 96 of the switch knob 34 is received by the shoulder wall of the container 1 and downward movement is restricted. Therefore, it is possible to reliably prevent an accidental switch of the switch knob 34 into the first ON state or the second ON state. Moreover, as described above, if the switch knob 34 has been switched into the ON state, the restricting chip 96 is pushed up by the shoulder wall of the container 1 as the application body 2 is screwed over the threaded shaft 5 and therefore the switch knob 34 is forcibly switched into the OFF state shown in FIG. 8.

Figure 14:
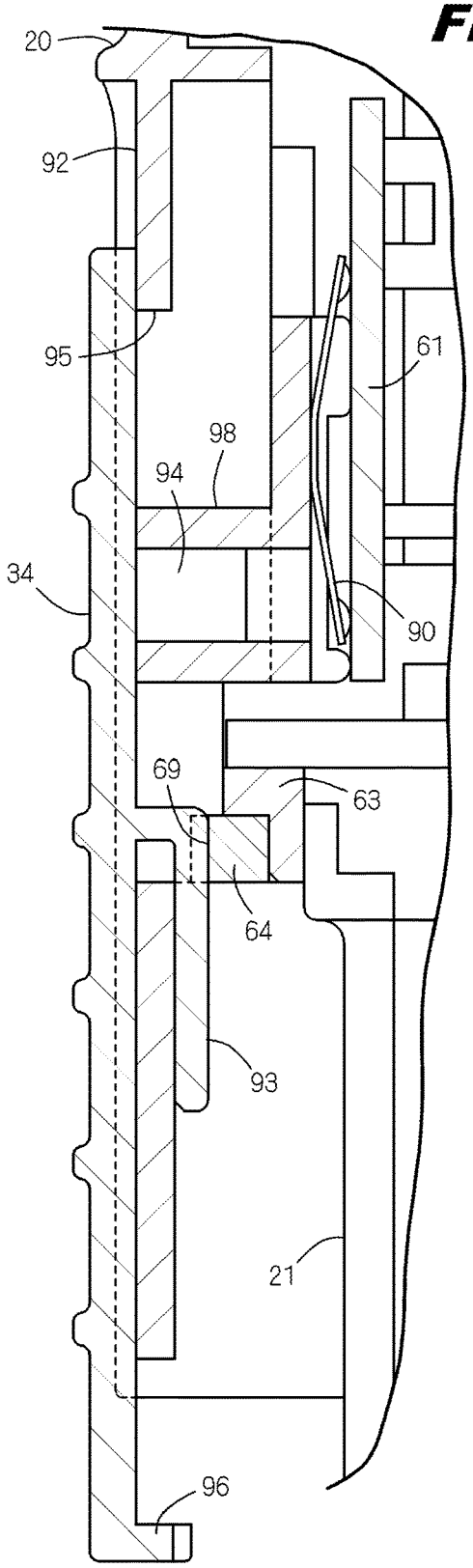
FIG. 14 is a vertical sectional side view showing a state of the switch knob in shaping of eyelashes.

In the use of the mascara applicator, by alternatively using the shaping body 3 and the application body 2, it is possible to carryout the operation for shaping and curling the eyelashes and the operation for applying the mascara liquid. To shape and curl the eyelashes, as shown in FIG. 15, the shaping body 3 is pulled out of the application body 2 in such a direction as to disengage the connection groove 55 of the connection boss 54 and the elastic connection arms 68 from each other and the heating shaping portion 22 is exposed from the application rod 11. In this state, the switch knob 34 is slid and switched into the second ON state to cause the heater 29 to generate heat. After a while, it is found that the heat generating state of the heater 29 has reached the suitable temperature (70° C.) based on a change in the color given by the thermochromic element 76. Because the cap 10 is attached to the container 1 together with the application rod 11 in the state in which the switch knob 34 has been switched into the second ON state, the stopper 93 is not received by the restricting portion 56 of the cap 10. The restricting chip 96 in this state is positioned below an opening in a lower face of the shaping grip 20 as shown in FIG. 14.

Next, the eyelashes are brought in contact with an outer surface of the heater 29 while the shaping rod 21 is supported horizontally with the comb teeth 28 oriented upward and the comb teeth 28 are combed through central portions of curves of the eyelashes. In this state, the eyelashes are scooped upward and the heating windows 77 are further turned toward an eyebrow to curl the eyelashes. Furthermore, by pushing the entire heating shaping portion 22 upward while heating the curled portions with the heater 29, it is possible to reliably curl the eyelashes to their tips. Similarly, it is possible to curl the eyelashes near an inner corner and an outer corner of an eye with the heating shaping portion 22. In curling the eyelashes, it is possible to restrict lateral movement of the caught eyelashes along a curling face 32 with the comb teeth 28 to thereby properly curl the group of eyelashes caught by the adjacent comb teeth 28.

Figure 16:
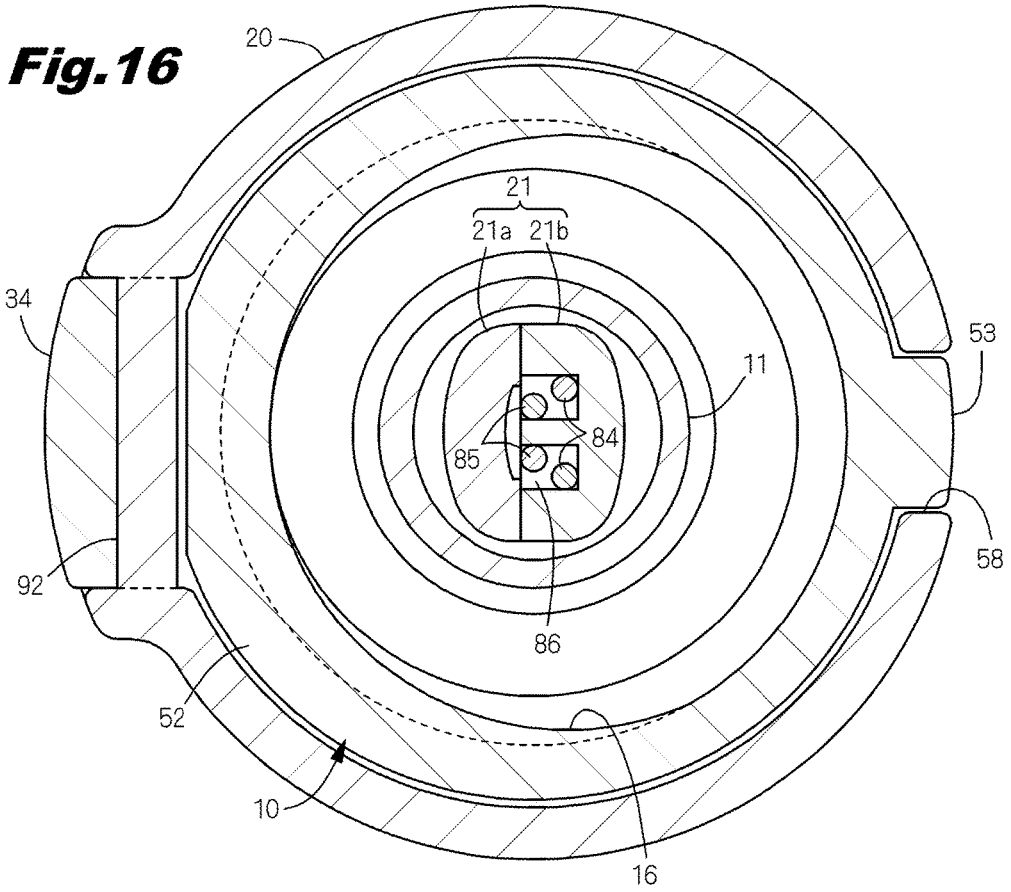
FIG. 16 is a sectional view taken along line III-III in FIG. 8.

To apply the mascara liquid, by connecting the shaping body 3 to the application body 2 to house the heating shaping portion 22 into the application rod 11, the shaping body 3 is integrated with the application body 2 again. In this state, as shown in FIG. 16, the positioning rib 53 provided to the threaded cap 52 is engaged with the positioning groove 58 formed in the shaping grip 20. Therefore, by turning the shaping grip 20 in a loosening direction, a screwed state of the threaded cap 52 and the threaded shaft 5 with each other is canceled and the application body 2 can be detached from the container 1 as shown in FIG. 2. The cap 10 at this time is engaged with and caught by the elastic connection arms 68 of the connection ring 64.

If the switch knob 34 it turned on in the state in which the application body 2 is detached from the container 1, the switch structure is switched into the first ON state to cause the heater 29 to generate heat to maintain the application portion 12 at a suitable temperature (40° C.). In this way, it is possible to increase a temperature of the mascara liquid adhering to the application portion 12 to adjust a state of the mascara liquid so that the mascara liquid is likely to be uniformly diffused and flow to thereby allow the mascara liquid held between the comb teeth 18 to adhere to the eyelashes. If an amount of the mascara liquid is insufficient, the application portion 12 is put into and taken out of the container 1 a few times to cause the mascara liquid to adhere to the application portion 12, the surplus mascara liquid adhering to a periphery of the application portion 12 is squeezed off by use of the wiper 6, and the mascara liquid is caused to adhere to the eyelashes again. Lastly, by combing the eyelashes a few times by using the mascara comb, it is possible to arrange the curled shapes of the eyelashes. Because the application portion 12 when it is put into and taken out of the container 1 is merely put into and taken out of the container 1 in the vertical direction, the application portion 12 is not inserted further downward after end portions of the threaded shaft 5 and the threaded hole 16 come in contact with each other and therefore the switch knob 34 is not returned to the OFF position.

If an ambient temperature is low, after the shaping grip 20 is turned a few times in the loosening direction to secure such a clearance that the restricting chip 96 can move down between the threaded cap 52 and the shoulder portion of the container 1, the switch knob 34 is turned on to cause the heater 29 to generate heat to heat the application portion 12. In this case, the application portion 12 is heated to 40° C. by the heater 29 and therefore it is possible to heat the mascara liquid in the container 1 to reduce the viscosity of the mascara liquid and impart fluidity to the mascara liquid.

Figure 13:
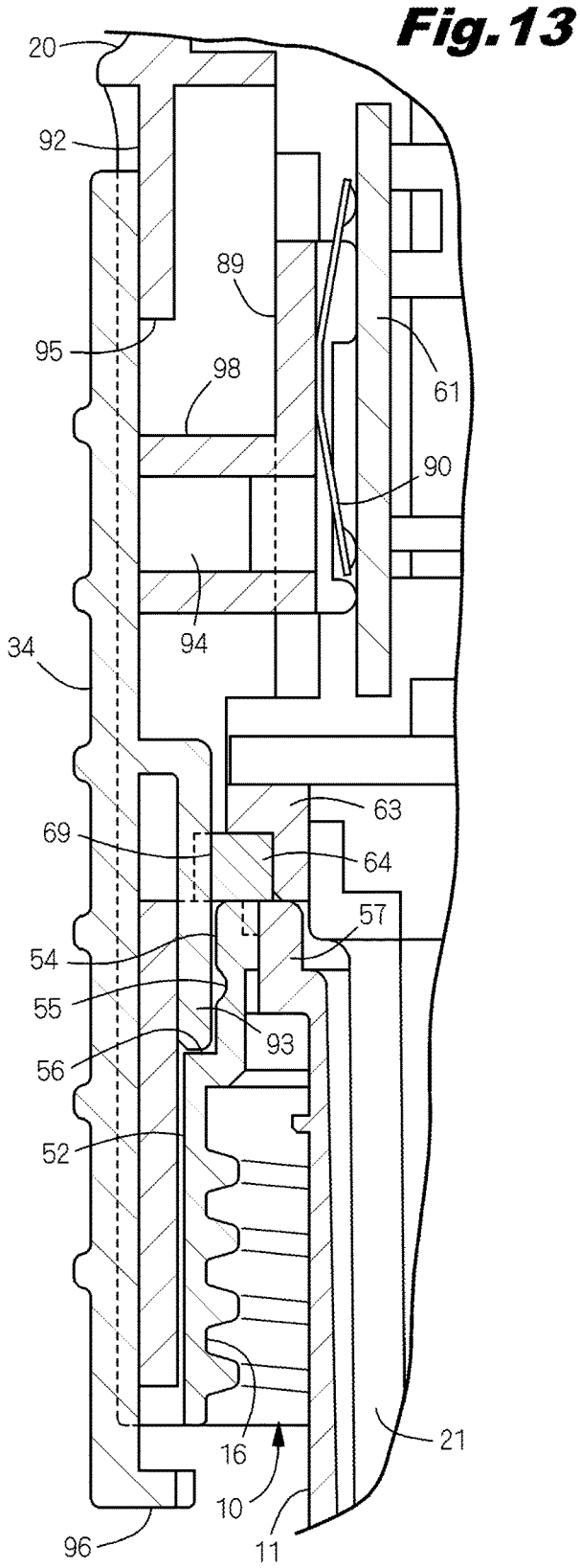
FIG. 13 is a vertical sectional side view showing a state of the switch knob in an unused state.

As described above, in the state in which the switch knob 34 has been switched into the first ON state, as shown in FIG. 13, a tip end of the stopper 93 is received by the restricting portion 56 provided to the shoulder portion of the threaded cap 52. Therefore, the shaping body 3 is not switched into the second ON state across the first ON state and it is possible to maintain the temperature of the application portion 12 at 40° C.

As described above, by setting the heat generating temperature of the heater 29 in the state in which the shaping body 3 is attached to the application body 2 to the low temperature to suppress the output of the heater 29, it is possible to prevent the temperature of the application portion 12 from becoming unnecessarily high. Moreover, in the state in which the application portion 12 is immersed in the mascara liquid in the container 1, it is possible to reduce the viscosity of the mascara liquid while preventing alteration and deterioration of the mascara liquid due to wasteful evaporation of a volatile constituent such as solvent. Therefore, it is possible to cause the mascara liquid having a suitable degree of fluidity to adhere to the application portion 12 to suitably carry out the application of the mascara liquid to the eyelashes. Furthermore, by setting the heat generating temperature of the heater 29 in the state in which the shaping body 3 is detached from the application body 2 to carry out the shaping of the eyelashes to the high temperature, it is possible to increase the temperature of the heating shaping portion 22 to shape and properly curl the eyelashes while effectively heating the eyelashes.

If the heat generating temperature of the heater 29 when the shaping body 3 is attached to the application body 2 is set to the same high temperature as the heat generating temperature of the heater 29 when the shaping body 3 is detached from the application body 2, a heat quantity for heating becomes excessive and the mascara liquid becomes more liable to alter and deteriorate when the application portion 12 is inserted into the container 1 and the mascara liquid is heated. To avoid this situation, an internal space of the application rod 11 may be expanded or a wall thickness of the application rod 11 may be increased, for example. In these cases, however, the application rod 11 becomes thick or increases in diameter, which impairs usability. In order to solve such problems, the heat generating temperature of the heater 29 in the state in which the shaping body 3 is attached to the application body 2 is set to the low temperature so that the output of the heater 29 can be suppressed.

Figure 17:
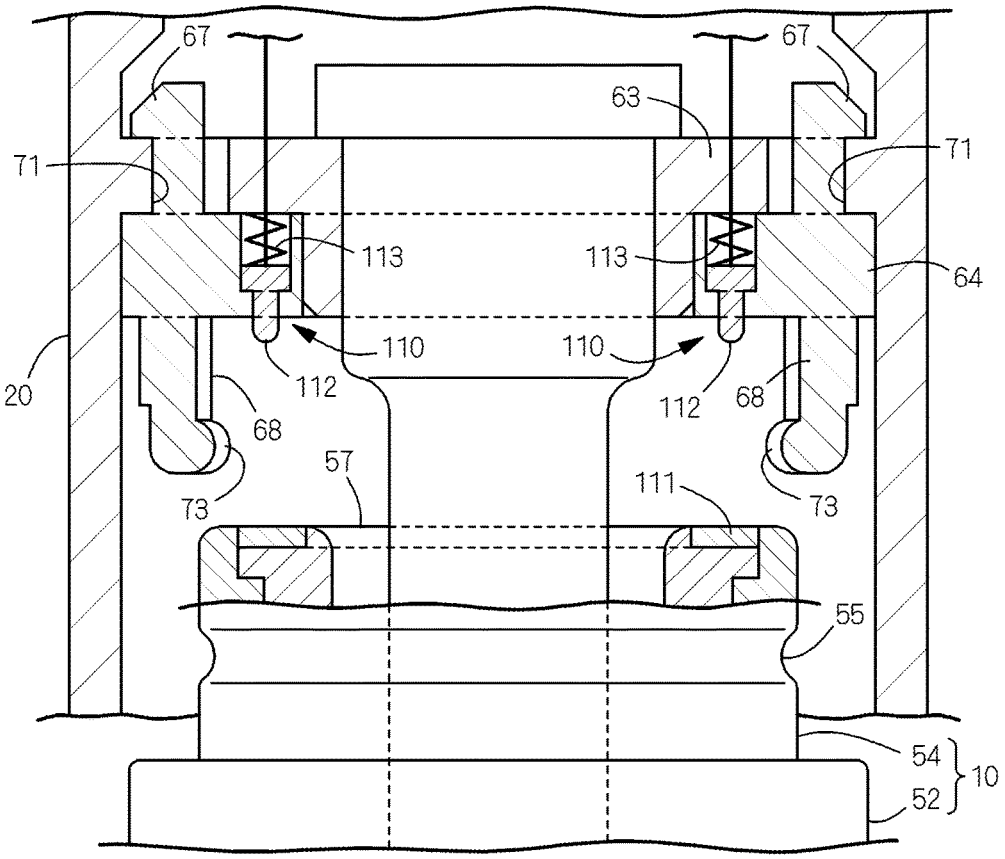
FIG. 17 is a sectional view of an essential portion and showing another embodiment of the cosmetic tool according to the first invention group.
Figure 18:
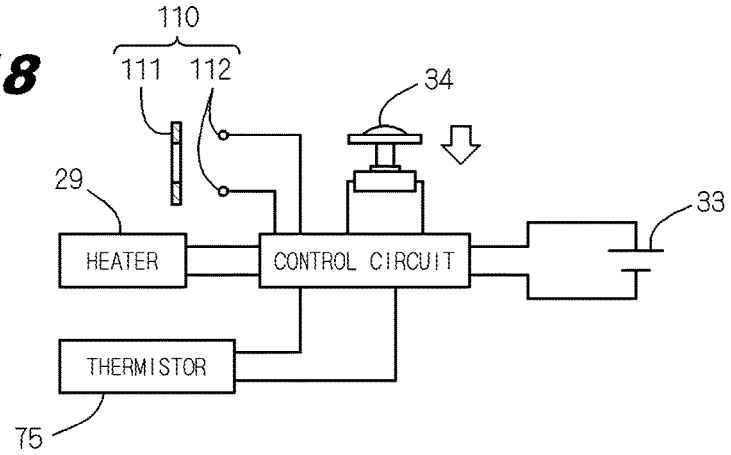
FIG. 18 is an explanatory view showing a manner of temperature control of a heater in FIG. 17.

Although the heat generating temperature of the heater 29 is set to the low temperature by restricting the switching operation of the switch knob 34 with the restricting portion 56 when the shaping body 3 is attached to the application body 2 in the above-described embodiment, this structure is unnecessary. For example, as shown in FIGS. 17 and 18, sensor switches 110 for sensing that the shaping body 3 is attached to the application body 2 are provided to a contact portion between a cap 10 and a shaping grip 20 and a heat generating state of the heater 29 may be set to a low-temperature state based on sensing signals of the sensor switches 110. Specifically, the sensor switches 110 are formed by a conductive ring 111 fixed to an upper end of a rod boss 57 and paired contacts 112 supported by a connection ring 64 to be able to proceed and recede. The opposite contacts 112 are respectively biased to proceed by springs 113. In a state in which the shaping body 3 is attached to the application body 2, the paired contacts 112 come in contact with the conductive ring 111 to become electrically continuous with each other and therefore a control circuit which has received a conduction signal supplies a drive current so that a heat generating temperature of the heater 29 becomes the low temperature. The switch knob 34 in this case may be formed as a push-button switch to be switched only between an ON state and an OFF state.

Although the restricting portion 56 is provided to the shoulder wall of the threaded cap 52 in the above-described embodiment, this structure is unnecessary and a restricting portion 56 may be formed to protrude from a periphery of a connection boss 54. Moreover, the switch knob 34 may be formed so as to be brought into a first ON state when pushed upward from an OFF position. In this case, a restricting chip (stopper) 96 described in the above embodiment may be received by the restricting portion 56 provided to a cap 10 to restrict pushing of the switch knob 34 upward into a second ON state. The heater 29 does not necessarily have to be a sheet heater but may be formed by using a nichrome wire as a heater element. Besides the comb teeth, the application elements 18 may be bristle bunches. Besides the first and second ON states, the heat generating states of the heater 29 may be suitably set to an intermediate temperature state between the first and second ON states and a higher temperature state than the second ON state. The cosmetic tool according to the present invention may be formed by an application body 2 and a shaping body 3 without the container 1. In this case, an outer face of the application body 2 is preferably covered with a protective cap.

Figure 19:
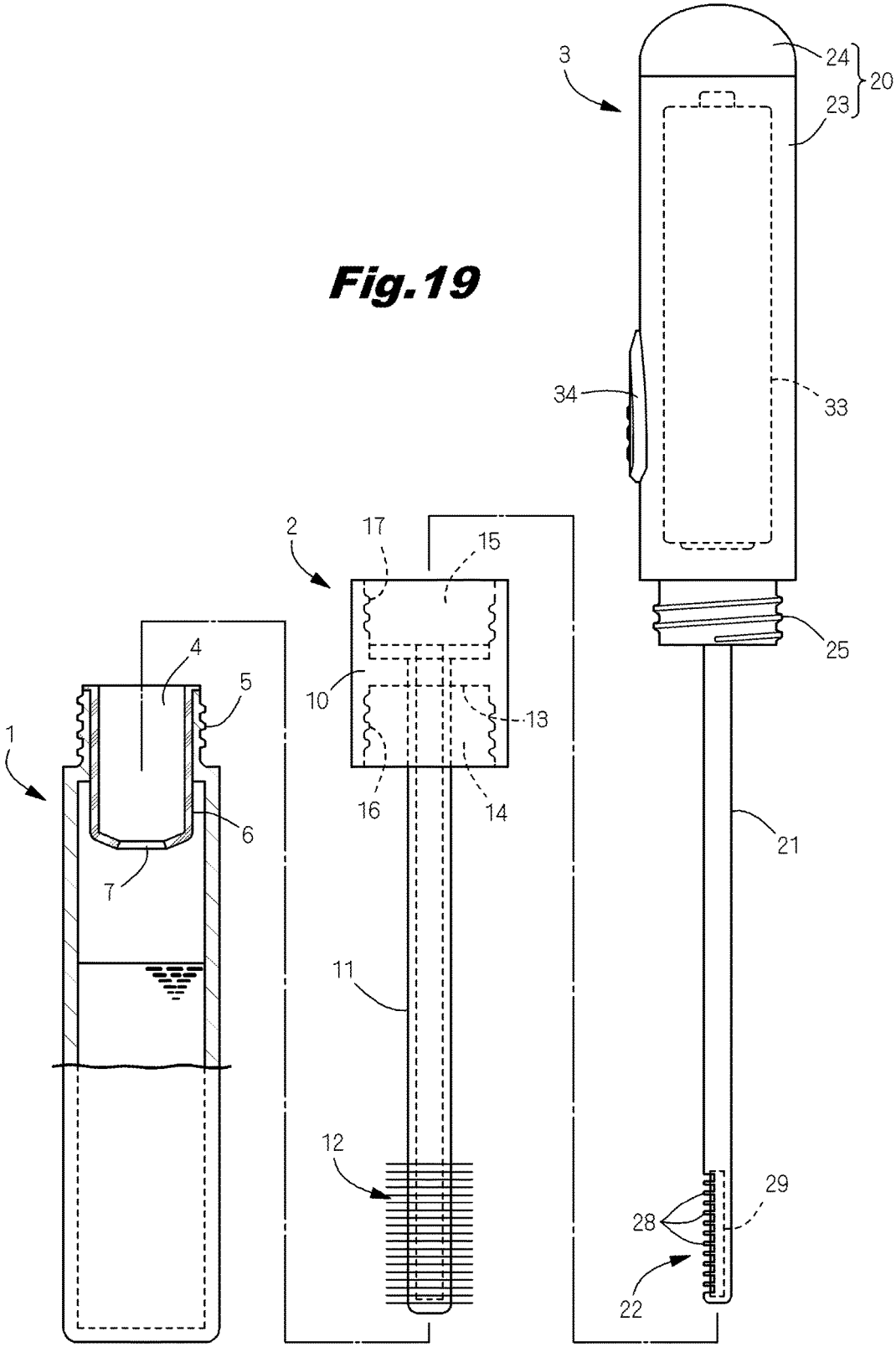
FIG. 19 is an exploded side view of a cosmetic tool according to another embodiment.
Figure 20:
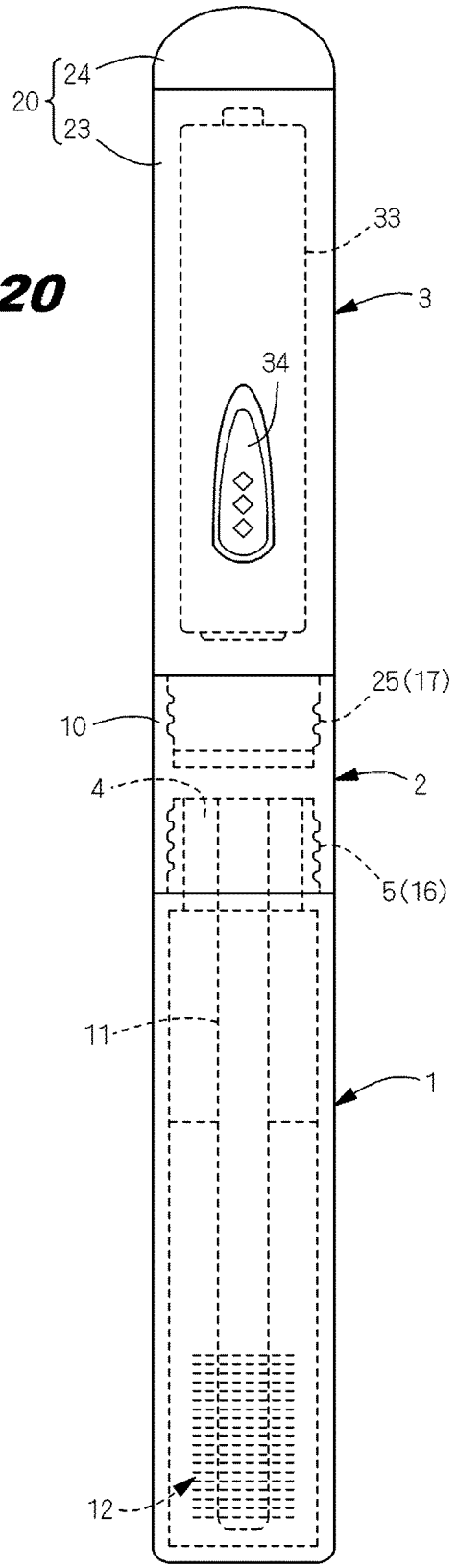
FIG. 20 is a front view of a cosmetic tool according to another embodiment.

FIGS. 19 to 25 show another embodiment of the cosmetic tool according to the first invention group. In FIGS. 19 and 20, a mascara applicator is formed by a container 1 for housing mascara liquid, an application body 2 to be attached to and detached from the container 1, and a shaping body 3 to be attached to and detached from the application body 2. The container 1 is formed into a circular cylindrical shape and an inlet/outlet 4 for the application body 2 is open in an upper end of the container 1. A threaded shaft 5 is formed on a peripheral face of the inlet/outlet 4 and a wiper 6 for squeezing the surplus attached mascara liquid is provided on an inner face of the inlet/outlet 4. The wiper 6 is formed by a cylindrical body made of rubber or plastic material and a squeezing opening 7 is formed in a bottom wall of the cylindrical body.

Figure 21:
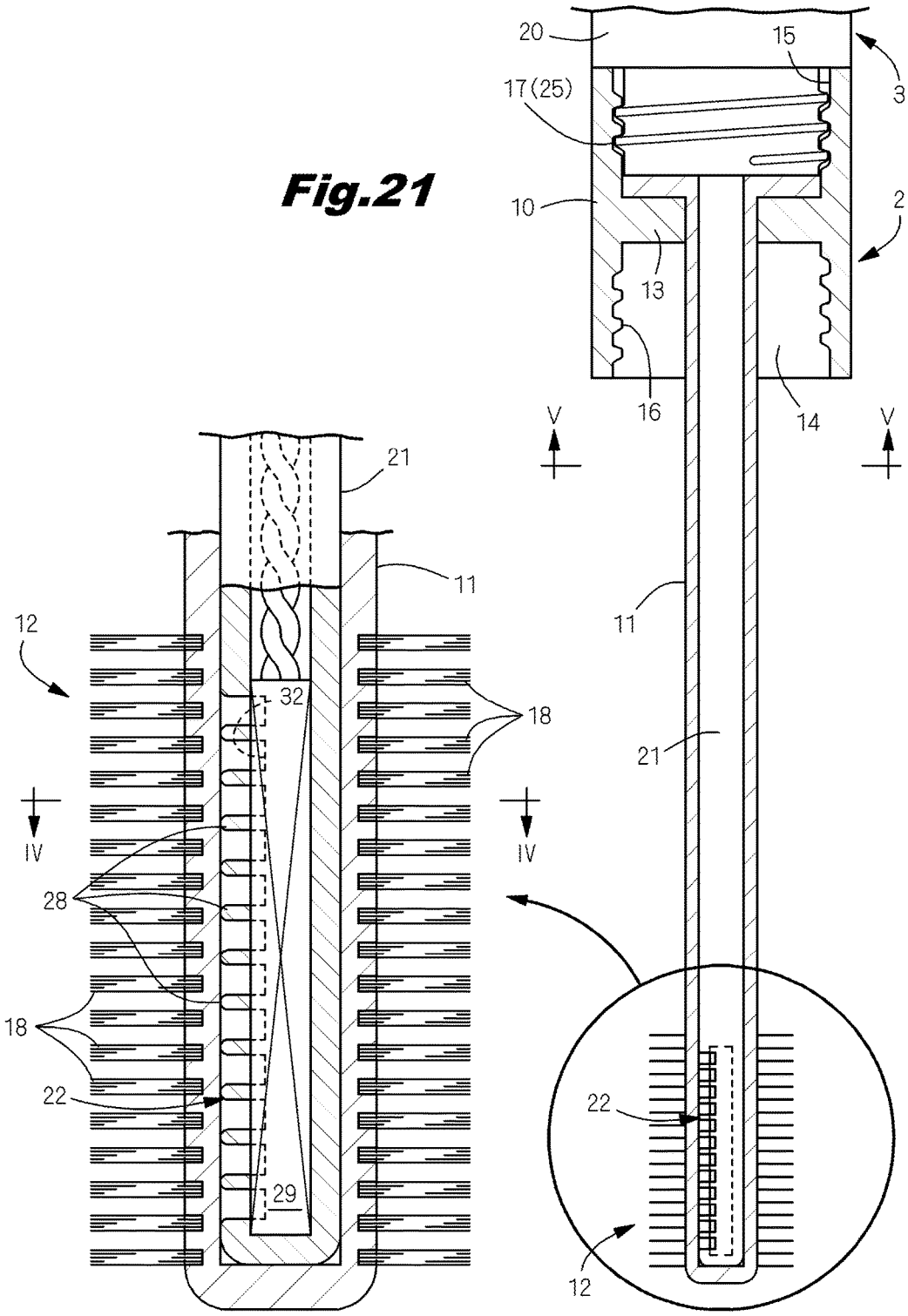
FIG. 21 is a vertical sectional view showing details of an application portion and a heating shaping portion.
Figure 22:
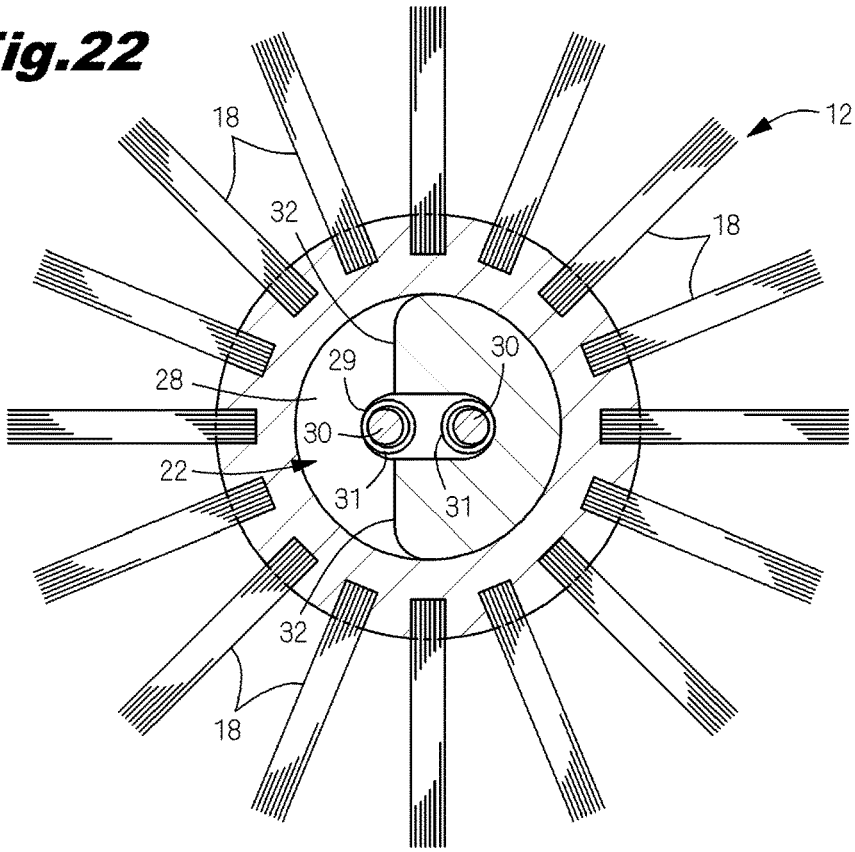
FIG. 22 is a sectional view taken along line IV-IV in FIG. 21.
Figure 23:
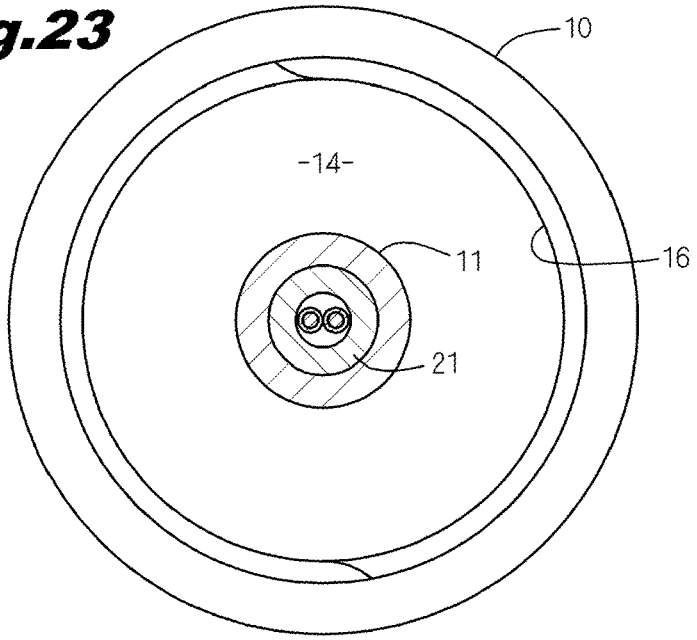
FIG. 23 is a sectional view taken along line V-V in FIG. 21.

The application body 2 is formed by a circular cylindrical application grip (cap) 10 to be attached to and detached from the inlet/outlet 4 in the container 1, an application rod 11 in a shape of a hollow shaft to be inserted into the container 1, and an application portion 12 provided to a lower end portion of the application rod 11. An inside of the application grip 10 is divided into a lower section 14 and an upper section 15 by a partition wall 13 and a threaded hole 16 corresponding to the above-described threaded shaft 5 is formed on an inner periphery of the lower section 14. A similar threaded hole 17 is formed on an inner periphery of the upper section 15. As shown in FIGS. 21 and 22, the application portion 12 is formed by radially implanting a group of bristle bunches (application elements) 18 in a periphery of the application rod 11 and the mascara liquid can be held in clearances between bristles forming the bristle bunches 18 or between base end portions of the bristle bunches 18.

The shaping body 3 is formed by a circular cylindrical shaping grip 20, a hollow shaping rod 21 protruding downward from a lower end of the shaping grip 20, a heating shaping portion 22 provided to a lower end (protruding end) of the shaping rod 21, and the like. The shaping grip 20 is formed by a circular cylindrical grip main body 23 and a cap (battery lid) 24 for opening and closing an opening in an upper end of the grip main body 23 and a threaded shaft 25 corresponding to the above-described threaded hole 17 is formed at a lower end of the grip main body 23. The cap 24 is attached to the grip main body 23 by screwing.

In FIG. 21, the heating shaping portion 22 is formed by a group of partially-arcuate comb teeth 28 disposed in shapes of multiple steps and a heater 29 is disposed inside the heating shaping portion 22. The heater 29 is formed by a single heater wire bent into a U shape at a lower end of an inside of the heating shaping portion 22 and the heater wire is formed by spirally winding a nichrome wire 31 around a heater support shaft 30 made of insulating material (see FIG. 22). Between the respective comb teeth 28, curl faces 32 for curling eyelashes are formed. Parts of the above-described heater 29 are exposed between the curling faces 32 and therefore it is possible to bring the eyelashes in contact with the heater 29 in curling the eyelashes with the heating shaping portion 22. A battery 33 which serves as a power supply for the heater 29 is housed inside the grip main body 23 and a switch knob 34 for turning on and off energization of the heater 29 is provided to a peripheral face of the grip main body 23. By detaching the cap 24 from the grip main body 23, it is possible to replace the battery 33.

By inserting the application rod 11 of the application body 2 into the container 1 from the inlet/outlet 4 and screwing the threaded hole 16 formed in the application grip 10 over the threaded shaft 5, it is possible to close the inlet/outlet 4 with the application body 2 to thereby seal the container 1. Most parts of the application portion 12 and the application rod 11 in this state are immersed in the mascara liquid housed in the container. Moreover, by inserting the heating shaping portion 22 and the shaping rod 21 of the shaping body 3 into the application rod 11 from the upper section 15 and screwing the threaded shaft 25 provided to the grip main body 23 into the threaded hole 17 formed in the application grip 10, it is possible to integrate the shaping body 3 with the application body 2.

The container 1, the application body 2, and the shaping body 3 are formed to have the same sectional shapes and diameters so as to make an image of an external appearance of the mascara applicator simple in the state in which the container 1, the application body 2, and the shaping body 3 are integrated with each other as described above (see FIG. 23). Moreover, the container 1, the application body 2, and the shaping body 3 are disposed in a straight line to be adjacent to each other in this described order from the bottom. A vertical length of the container 1 excluding the threaded shaft 5 is substantially the same as a vertical length of the shaping grip 20 excluding the threaded shaft 25 and a vertical length of the application grip 10 is one-third of the vertical length of the container 1 excluding the threaded shaft 5.

As shown in FIG. 21, the heating shaping portion 22 in a state in which the container 1, the application body 2, and the shaping body 3 are integrated with each other is housed in the application rod 11 together with the shaping rod 21 and positioned inside the application portion 12. Therefore, by turning on the switch knob 34, it is possible to cause the heater 29 to generate heat to heat the heating shaping portion 22 and it is possible to transfer the heat of the heating shaping portion 22 to the application portion 12 through a cylindrical wall of the application rod 11. A temperature of the heating shaping portion 22 in the heat generating state is about 70° C. and a temperature of the peripheral face of the application rod 11 at the application portion 12 is 40 to 50° C. If the heater 29 is caused to generate heat when the application portion 12 is housed in the container 1, the mascara liquid which is half solidified can be heated and warmed to about 40° C.

Figure 25:
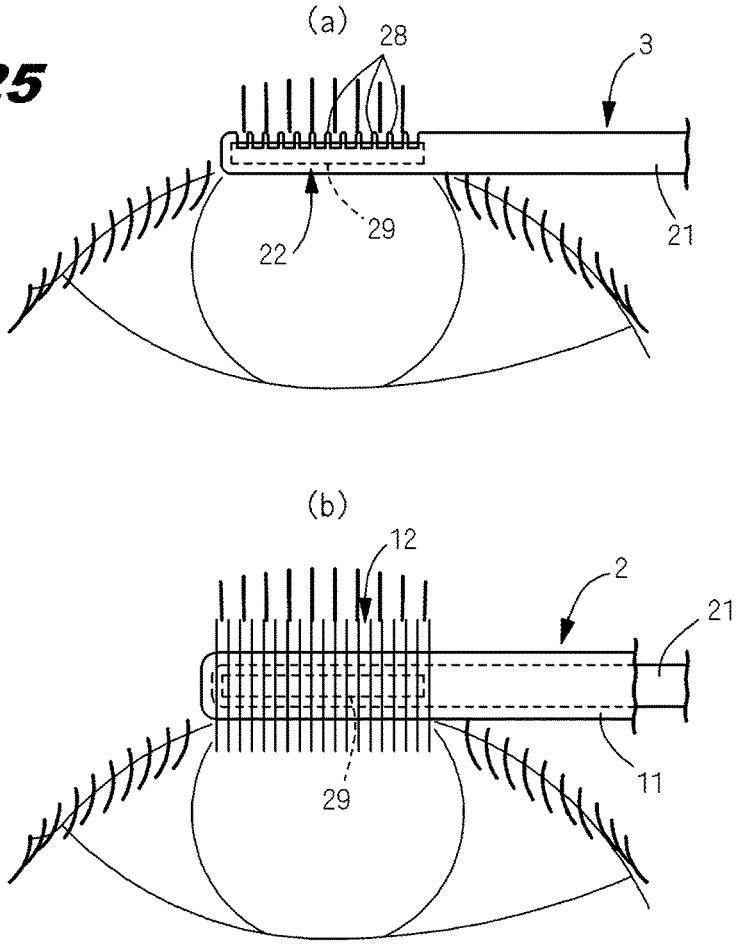
FIGS. 25(*a*) and 25(*b*) are explanatory views showing a shaped condition of eyelashes and an applied condition of mascara liquid.
Figure 26:
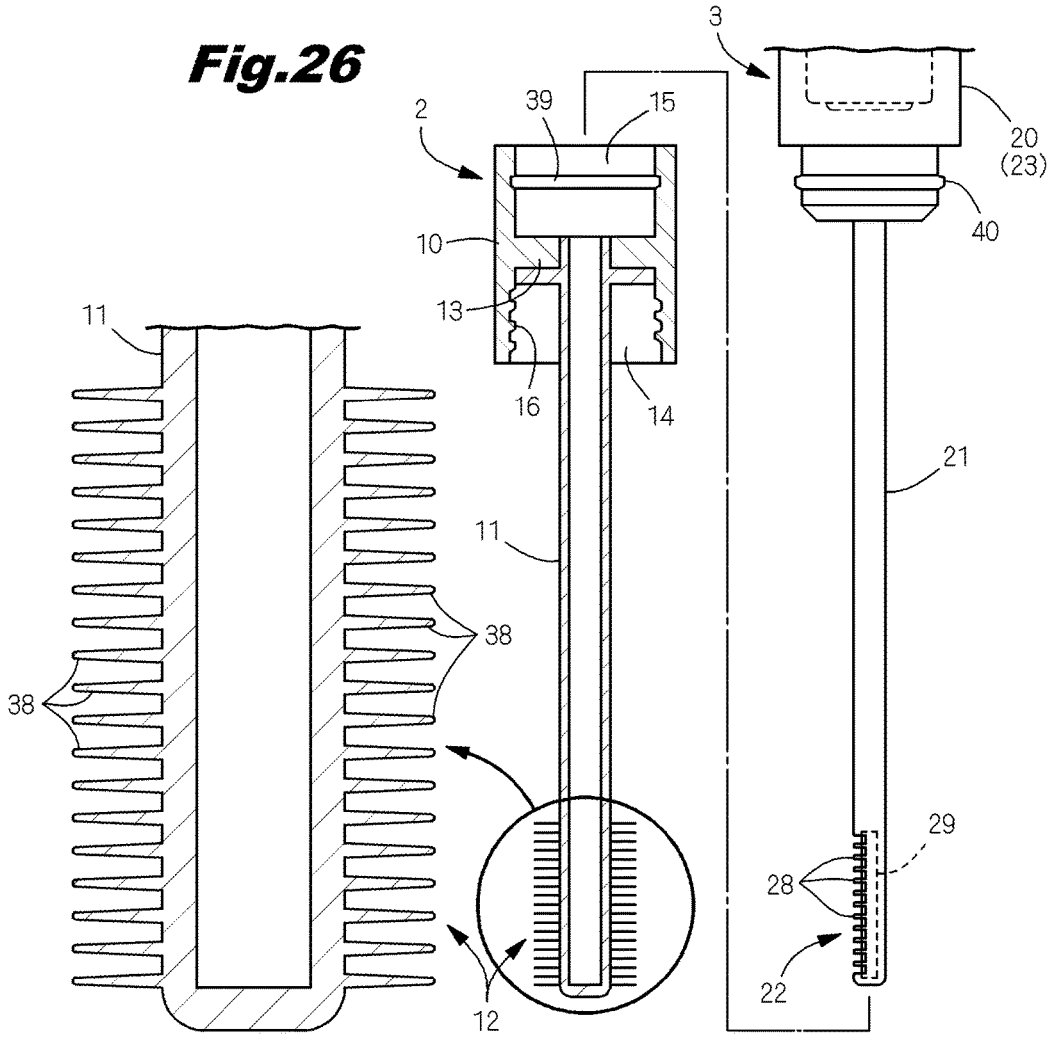
FIG. 26 is an exploded sectional view showing another embodiment of the cosmetic tool according to the first invention group.

The mascara applicator formed as described above can be used to carry out shaping and curling operations of the eyelashes and an application operation of the mascara liquid. To shape and curl the eyelashes, as shown in FIG. 25(*a*), the shaping body 3 is detached from the application body 2 to expose the heating shaping portion 22 and the switch knob 34 is turned onto cause the heater 29 to generate heat in this state. Next, the curling face 32 is brought in contact with the eyelashes while the shaping rod 21 is supported horizontally with the comb teeth 28 oriented upward and the comb teeth 28 are combed through central portions of curves of the eyelashes. In this state, the eyelashes are scooped upward while heated with the heater 29 and the curling face 32 is further rotated toward an eyebrow to curl the eyelashes. Furthermore, by pushing the entire heating shaping portion 22 upward while keeping this state and heating the curled portions with the heater 29, it is possible to reliably curl the eyelashes to their tips. Similarly, it is possible to curl the eyelashes near an inner corner and an outer corner of an eye with the heating shaping portion 22. In curling the eyelashes, it is possible to restrict lateral movement of the caught eyelashes along the curling face 32 with the comb teeth 28 to thereby properly curl the group of eyelashes caught by the adjacent comb teeth 28. In this case, even if the shaping body 3 is detached from the container, if the application body 2 is attached to the container 1, the mascara liquid does not spill.

Figure 24:
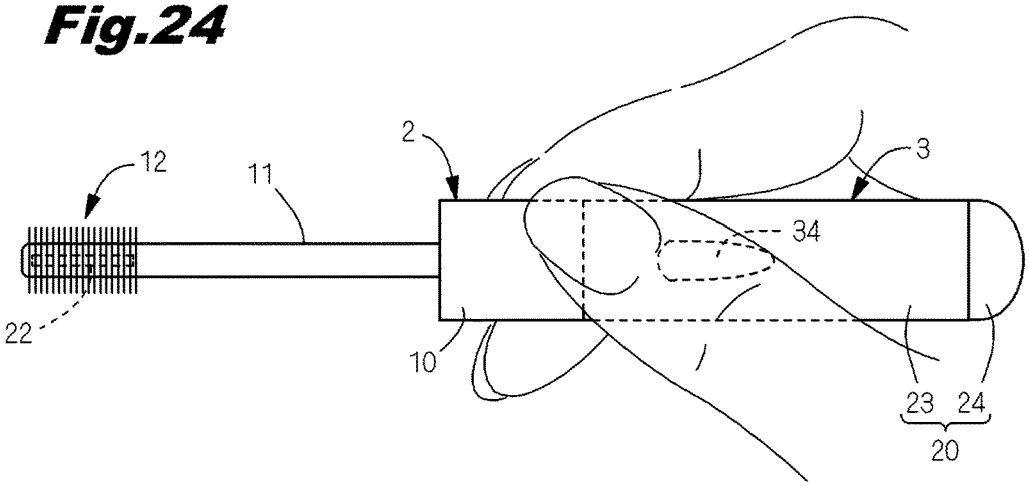
FIG. 24 is an explanatory view showing an example of use of a mascara applicator.

When the shaping and curling operations of the eyelashes are completed, the mascara liquid is applied by use of the application body 2. If an ambient temperature is low at this time, as shown in FIG. 25(*b*), it is possible to heat the application portion 12 with the heating shaping portion 22 by carrying out the application operation in a state in which the shaping body 3 is put into the application body 2 and the switch knob 34 is turned on to cause the heater 29 to generate heat. Therefore, it is possible to increase the temperature of the mascara liquid adhering to the application portion 12 to apply the mascara liquid in a uniformly diffused and flowing state. If the ambient temperature is high, it is unnecessary to turn on the switch knob 34. Moreover, because the application grip 10 and the shaping grip 20 can be held in the same manner as in gripping of a pencil as shown in FIG. 24 when the shaping body 3 and the application body 2 are integrated with each other, it is possible to easily carryout the application of the mascara liquid by holding the application portion 12 in a stable state.

Lastly, by combing the eyelashes a few times by using the mascara comb, it is possible to arrange the curled shapes of the eyelashes. As described above, the switch knob 34 is turned off when it is unnecessary to heat the application portion 12. Alternatively, it is possible to pinch the application grip 10 to apply the mascara liquid in the state in which the shaping body 3 is detached from the application body 2. In this state, it is possible to freely change a pinched attitude or inclination of the application grip 10. For example, it is possible to apply the mascara liquid to the short eyelashes positioned at the inner corner and the outer corner of the eye or to adjust an applied state of the applied mascara liquid by using tips of the bristle bunches 18 at the tip end. In this manner, the user can bring the respective grips 10, 20 into its favorite state to carry out the application of the mascara liquid with the application body 2 and the shaping of the eyelashes with the shaping body 3, which improves usability of the mascara applicator.

As described above, if the shaping body 3 for carrying out the shaping of the eyelashes is disposed inside the application body 2 for applying the mascara liquid and the heating shaping portion 22 provided to the shaping body 3 is heated by the heater 29, the heating shaping portion 22 can be brought into the temperature state suitable to the shaping of the eyelashes and it is possible to suitably curl the eyelashes. Furthermore, in the state in which the application portion 12 and the heating shaping portion 22 are housed in the container 1, the mascara liquid and the application portion 12 can be indirectly heated with the heat transferred from the heating shaping portion 22. As a result, it is possible to prevent the temperature of the application portion 12 from becoming unnecessarily high and therefore it is possible to reduce the viscosity of the mascara liquid while preventing deterioration of the mascara liquid due to excessive heating. In this manner, according to the mascara applicator in which the shaping body 3 is disposed inside the application body 2, it is possible to shape and curl the eyelashes while heating the eyelashes to the suitable temperature or it is possible to reduce the viscosity while preventing the deterioration by heating the mascara liquid to the suitable temperature.

FIGS. 26 to 29 show other embodiments of the cosmetic tool according to the first invention group. In these embodiments, portions different from those in the above-described embodiments will be mainly described and the same members as those in the above-described embodiments will be provided with the same reference signs and will not be described. In a mascara applicator shown in FIG. 26, a group of comb teeth 38 are integrally molded with a lower end of an application rod 11 to form an application portion 12. A straight line of the comb teeth 38 is disposed at each of opposed two positions on a peripheral face of the application rod 11. A pressure fitting groove 39 instead of the threaded hole is formed in an annular shape in an upper section 15 of an application grip (cap) 10 and a pressure fitting rib 40 instead of the threaded shaft is formed in an annular shape at the shaping grip 20. In this embodiment, in a state in which a shaping body 3 is attached to an application body 2, the pressure fitting rib 40 is engaged with the pressure fitting groove 39 to maintain the attached state of the shaping body 3.

Figure 27:
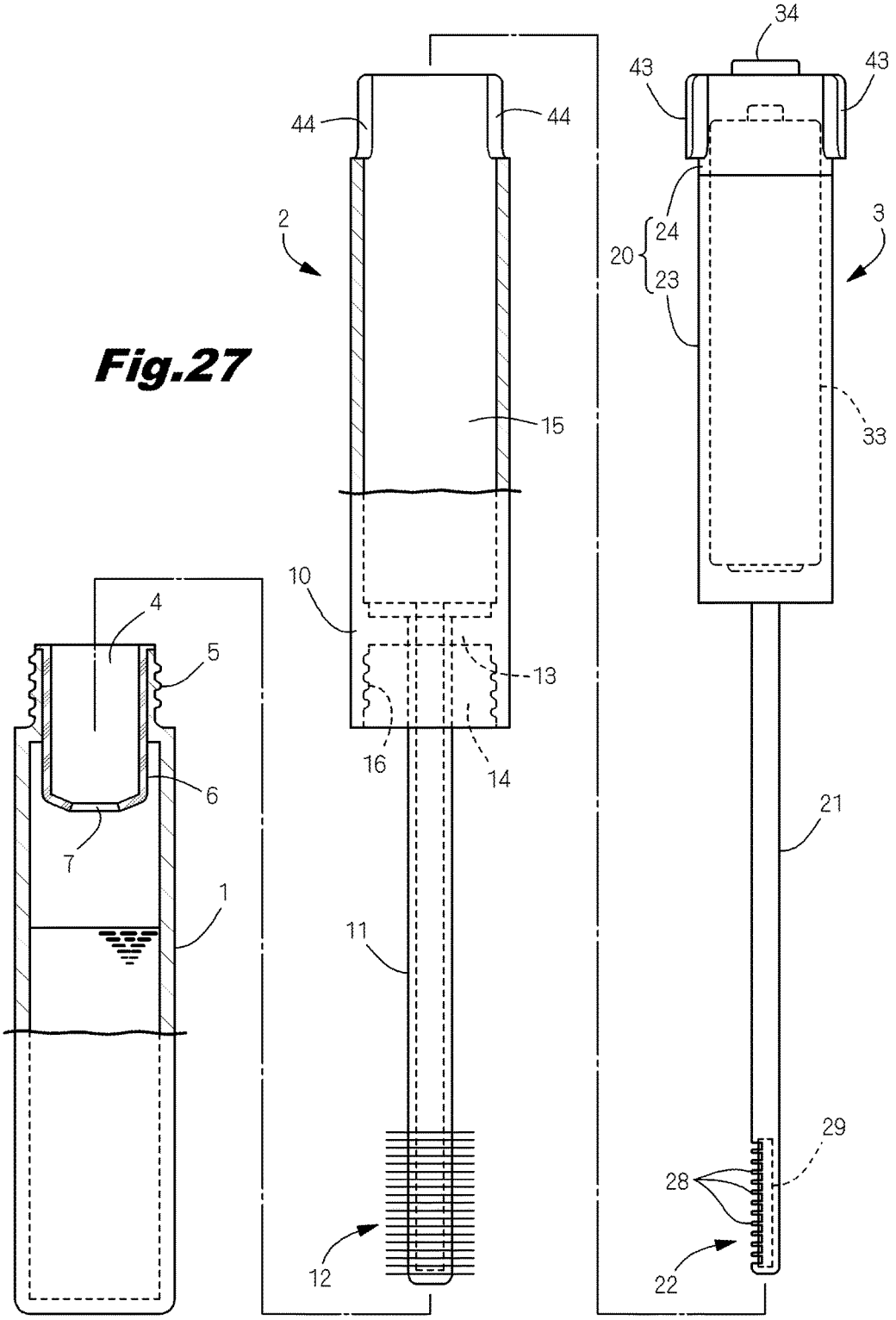
FIG. 27 is an exploded sectional view showing another embodiment of the cosmetic tool according to the first invention group.

In a mascara applicator shown in FIG. 27, an upper section 15 of an application grip (cap) 10 of an application body 2 is formed to be slightly larger than a shaping grip 20 of a shaping body 3 so that the shaping grip 20 can be housed inside the upper section 15 when the shaping body 3 is attached to the application body 2. In order to make it easy to take out the shaping body 3, paired knob chips 43 are formed at opposed positions of a peripheral face of a cap 24 in a protruding manner. In the state in which the shaping body 3 is attached to the application body 2, the knob chips 43 are exposed from grooves 44 formed at two positions of a peripheral face of an upper end of the upper section 15 and therefore it is possible to pinch the knob chips 43 with a thumb and a forefinger to take the shaping body 3 out of the application body 2. A switch knob 34 is disposed on an upper end face of the cap 24. By softly fitting the shaping grip 20 with an inner face of the upper section 15 with pressure in the state in which the shaping body 3 is attached to the application body 2, it is possible to maintain the attached state of the shaping body 3.

Figure 28:
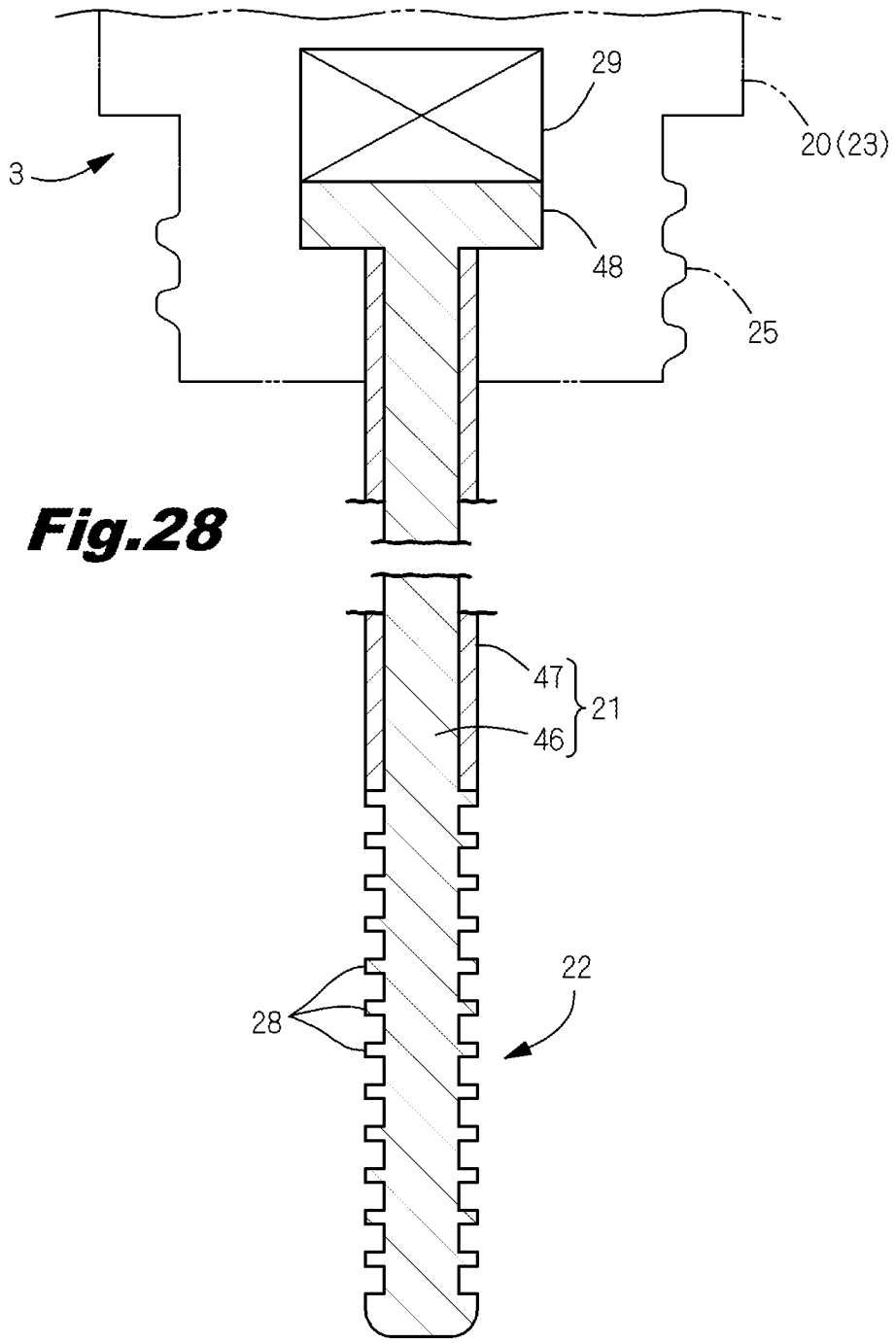
FIG. 28 is a sectional view showing another embodiment of the shaping body according to the first invention group.

In a mascara applicator shown in FIG. 28, a shaping rod 21 is formed by a heat transfer shaft 46 in a shape of a round shaft formed by a heat pipe or made of aluminum and a cover body 47 for covering an outer face of the heat transfer shaft 46, having heat resistance, and made of plastic and a heating shaping portion 22 is provided to a lower portion of the heat transfer shaft 46 exposed from the cover body 47. A PTC heater (heater) 29 is disposed inside a shaping grip 20 and a heat receiving portion 48 provided to an upper end of the heat transfer shaft 46 is brought into close contact with the PTC heater 29. Moreover, a group of annular grooves are formed on the heat transfer shaft 46 and comb teeth 28 in shapes of multiple steps formed between the grooves form the heating shaping portion 22. In this manner, the heating shaping portion 22 can be heated with heat indirectly transferred from the heater 29 through the heat transfer shaft 46.

Figure 29:
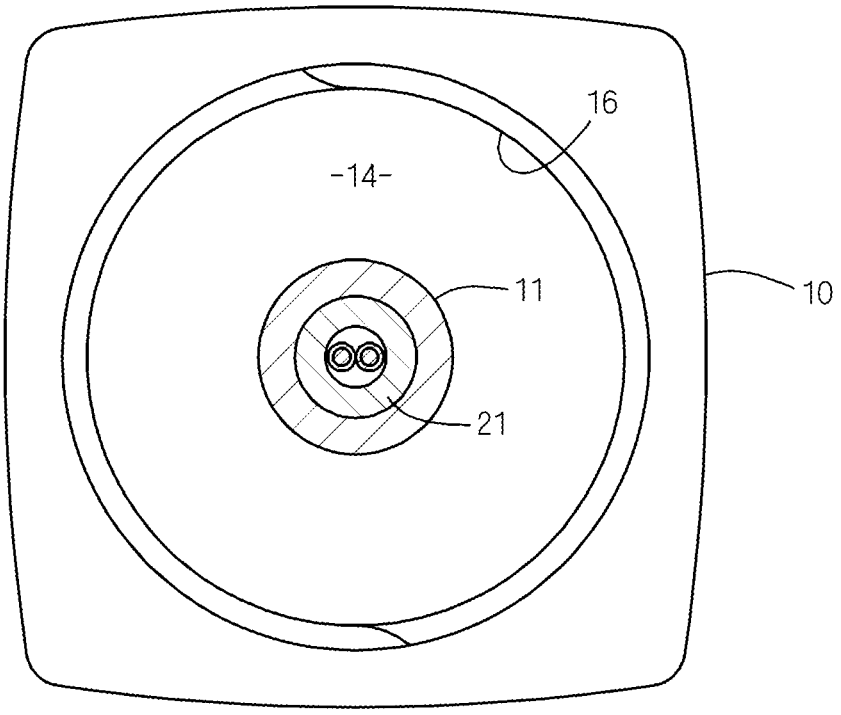
FIG. 29 is a cross-sectional view showing another embodiment of the cosmetic tool according to the first invention group.

In a mascara applicator shown in FIG. 29, outer faces of a container 1, an application grip (cap) 10 of an application body 2, and a shaping grip 20 of a shaping body 3 are formed to have square sections having respective side portions bulging outward. In this manner, as sectional shapes of the container 1, the application grip 10, and the shaping grip 20, it is possible to select any shapes such as ovals, elongated circles, polygons, and heart shapes. If the application grip 10 and the shaping grip 20 can be coupled to each other, it is possible to freely select shapes of the application grip 10 and the shaping grip 20 irrespective of differences in an outer shape and a thickness of the outer shape between them.

Besides the above-described embodiments, a heating shaping portion 22 in a state in which a shaping body 3 is attached to an application body 2 may be disposed in the vicinity of the application portion 12 inside an application rod 11. The application portion 12 may be formed by a mixture of bristle bunches 18 and comb teeth 38. An indicating lamp which lights when the heater 29 is in an energized state, an indicating lamp which lights when an electromotive force of a battery 33 becomes smaller than or equal to a predetermined value, and the like may be provided to an outer face of a shaping grip 20. Moreover, the battery 33 may be formed by a secondary battery to form a rechargeable mascara applicator. Especially, if a contact for recharging the secondary battery is disposed at the shaping grip 20, it is possible to recharge the battery in a state in which the shaping body 3 is detached from the application body 2. In this way, it is possible to recharge the secondary battery without exposing the container 1 and the mascara liquid to an undesirable environment whether it is an undesirably high temperature environment or an undesirably low temperature environment for the mascara liquid in the container 1. Because the container 1 in this case is sealed with the application body 2, the mascara liquid does not leak out.

Although the lengths of the respective rods 11 and 21 are set so that the application portion 12 of the application body 2 and the heating shaping portion 22 of the shaping body 3 can face each other in an inward-outward direction in the embodiment shown in FIG. 19, the shaping rod 21 may be shorter, if an ambient temperature is high and preheating of the mascara liquid is unnecessary. In this way, it is possible to suppress heat diffusion of the heater 29 by the shaping rod 21. Moreover, the shaping rod 21 is preferably made of material and in a shape with a low heat transfer property as long as the shaping rod 21 has such a structure that electric power can be supplied to the heater 29. For example, polypropylene, ABS, vinylidene fluoride, soft PVC, polystyrene, acrylic styrene, and the like can be used as the material of the shaping rod 21. Moreover, the shaping rod 21 is preferably formed by a foam molded article and especially by a closed cell foam molded article.

The sectional shapes of the application rod 11 and the shaping rod 21 may be ovals or polygons. The application rod 11 may be formed by a highly water-repellent flexible resin tube made of silicon, fluorine, polypropylene, polyethylene, or the like, to which the mascara liquid is less liable to be stuck. In this case, by inserting the shaping rod 21 which has higher rigidity and is harder than the application rod 11 into the application rod 11 having flexibility, an outer shape of the application rod 11 can be corrected to be straight along the shaft direction and there is no problem with use.

(Embodiments of Cosmetic Tool According to Second Invention) Group

Because cosmetic tools according to the embodiments are basically the same as the embodiments of the cosmetic tool according to the first invention group, they will be described by referring to the drawings shown in the embodiments of the cosmetic tool according to the first invention group. This holds true for embodiments of cosmetic tools according to the third to fifth invention groups.

Figure 31:
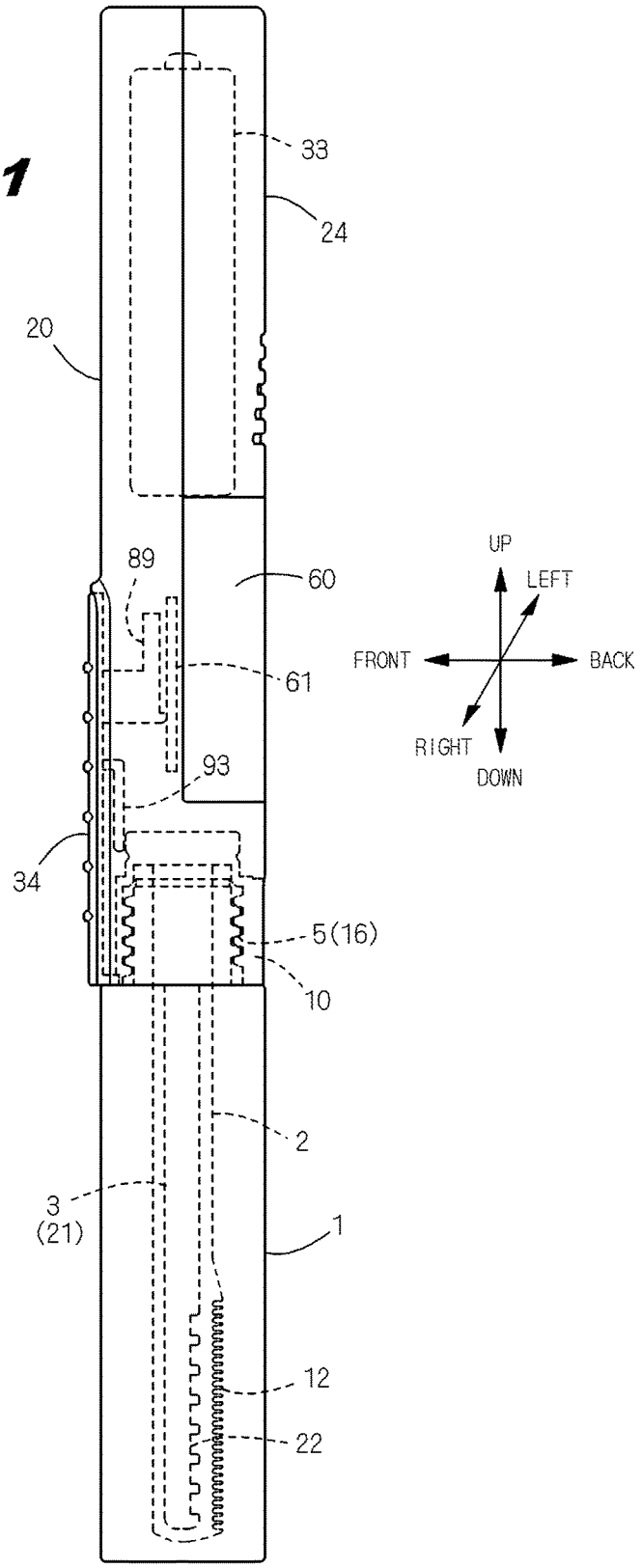
FIG. 31 is a side view of the cosmetic tool according to the second invention group.

A mascara applicator in FIG. 31 is formed by a first member, a second member, and a third member for performing different functions. In the present embodiment, a container 1 for housing mascara liquid is the first member, an application body 2 to be attached to and detached from the container 1 is the second member, and a shaping body 3 to be attached to and detached from the application body 2 is the third member. The container 1 and the application body 2 are detachably connected by a first connection structure and the application body 2 and the shaping body 3 are detachably connected by a second connection structure. When the three members, i.e., the container 1, the application body 2, and the shaping body 3 are connected by both the first and second connection structures, the mascara applicator can be treated as a single cosmetic tool.

The container 1 is formed into a circular cylindrical shape and an inlet/outlet 4 for the application body 2 is open in an upper end of the container 1. A threaded shaft 5 forming the first connection structure is formed on a peripheral face of the inlet/outlet 4 and a wiper 6 for squeezing the surplus attached mascara liquid is provided on an inner face of the inlet/outlet 4. The wiper 6 is formed by a cylindrical body made of rubber or plastic material and a squeezing opening 7 is formed in a bottom wall of the cylindrical body.

Figure 30:
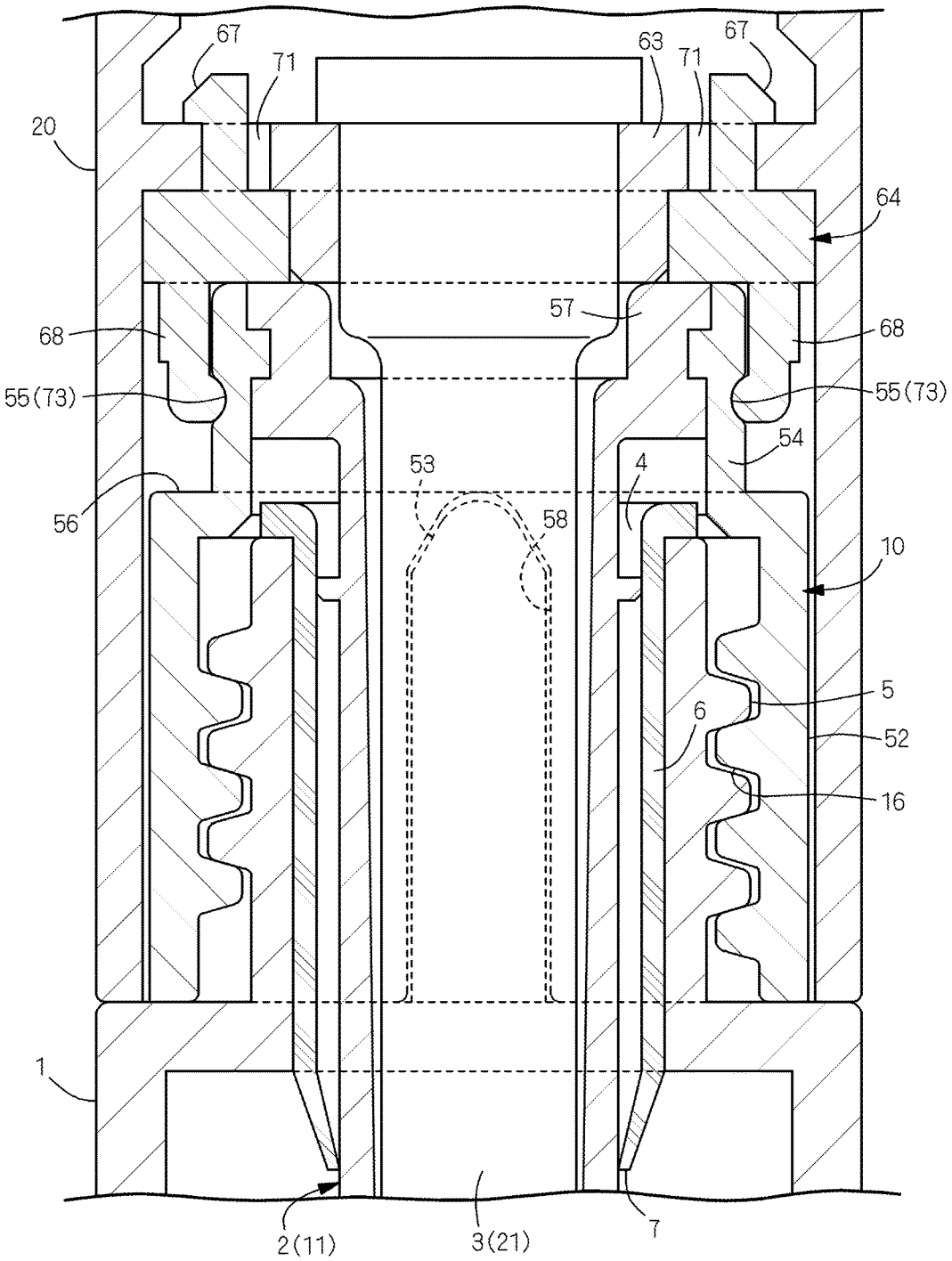
FIG. 30 is a vertical sectional front view showing connection structures of a cosmetic tool according to a second invention group.

In FIG. 1, the application body 2 is formed by a circular cylindrical cap10 to be attached to and detached from the inlet/outlet 4 in the container 1, an application rod 11 in a shape of a hollow shaft having a closed tip end to be inserted into the container 1, and an application portion 12 provided to a lower end portion of the application rod 11. The cap 10 is provided with a connection portion forming the first connection structure and a connection portion forming the second connection structure. As shown in FIG. 30, the former connection portion is formed by a threaded cap 52 occupying a most part of the cap 10 and a threaded hole 16 corresponding to the above-described threaded shaft 5 is formed on an inner face of the threaded cap 52. On an outer face of the cap 10, a positioning rib 53 which is long in a vertical direction is formed. As described above, the first connection structure is formed as a thread structure by the threaded shaft 5 and the threaded cap 52 having the threaded hole 16.

The connection portion forming the second connection structure is formed by a connection groove 55 formed in an annular shape in a peripheral face of a connection boss 54 continuous with an upper portion of the threaded cap 52. An outer diameter of the connection boss 54 is set to be smaller than an outer diameter of the threaded cap 52 and a shoulder wall between abase end of the connection boss 54 and the threaded cap 52 functions as a restricting portion 56 of a stopper 93 (described later). By fitting and engaging a rod boss 57 provided to an upper end of the above-described application rod 11 with an inner face of the connection boss 54 with pressure, the application rod 11 is integrated with the cap 10 so as not to be detachable from the cap 10.

The shaping body 3 is formed by a circular cylindrical shaping grip 20 serving also as a grip, a hollow shaping rod 21 protruding downward from a lower portion of the shaping grip 20, a heating shaping portion 22 provided to a lower end (protruding end) of the shaping rod 21, a heater 29 disposed inside the heating shaping portion 22, and the like. As shown in FIG. 3, a battery lid 24 in a shape of a gutter is detachably provided to a back face of an upper half of the shaping grip 20 and a board cover 60 in a shape of a gutter is disposed on a lower side of the battery lid 24. Inside the shaping grip 20, a battery 33, a control board 61, a switch structure, and the like are housed. A switch knob 34 for turning on and off energization of the heater 29 is provided to a front face of a lower end portion of the shaping grip 20 and a positioning groove 58 for receiving the above-described positioning rib 53 is formed on the back side. A lower end of the switch knob 34 faces a contact portion between the shaping grip 20 and the cap 10.

As shown in FIG. 3, inside the shaping grip 20, a ring-shaped mounting boss 63 is integrally formed with a lower end of an area of the shaping grip 20 housing the control board 61 and an upper portion of the shaping rod 21 is attached to the mounting boss 63 by fitting with pressure. A connection ring 64 to and from which the connection boss 54 of the cap 10 is attached and detached is fixed to the mounting boss 63. As shown in FIG. 4, from right and left opposed positions of an upper face and a lower face of the connection ring 64, paired engagement lugs 67 and paired elastic connection arms 68 protrude. Moreover, at front and back opposed positions of a peripheral face of the connection ring 64, a guide recessed portion 69 for guiding sliding of the stopper 93 (described later) and a positioning recessed portion 70 are formed.

As shown in FIG. 5, by engaging the paired engagement lugs 67 in engagement grooves 71 formed in the above-described mounting boss 63 from a lower face side, the connection ring 64 is fixed to the mounting boss 63 so as not to be detachable. At this time, the positioning recessed portion 70 is positioned by a positioning protrusion 72 provided to an inner face of the shaping grip 20 (see FIG. 4). A connection lug 73 having a semicircular section is provided to an inner face of a lower end of each of the elastic connection arms 68. By engaging and disengaging the connection lugs 73 in and from the connection groove 55 in the connection boss 54, the application body 2 and the shaping body 3 can be integrated with each other as shown in FIG. 2 or the shaping body 3 can be detached from the application body 2 as shown in FIG. 15. In this manner, the second connection structure is formed as a pressure fitting engagement structure by the connection groove 55 formed in the connection boss 54 and the elastic connection arms 68 having the connection lugs 73 to be engaged in and disengaged from the groove 55.

In the unused state of the mascara applicator, as shown in FIGS. 30 and 31, the threaded hole 16 provided to the cap 10 is screwed over the threaded shaft 5 and the application body 2 and the container 1 are integrated with each other. The application rod 11 and the application body 2 in this state are immersed in the mascara liquid housed in the container 1. The shaping rod 21 of the shaping body 3 is housed inside the application rod 11 of the application body 2 and the connection groove 55 provided to the connection boss 54 of the application body 2 is engaged with and caught by the elastic connection arms 68 of the connection ring 64. Because the shaping rod 21 in this state is housed in the application rod 11 having a closed structure, the entire shaping rod 21 including the heating shaping portion 22 is not immersed in the mascara liquid. Therefore, in the unused state, the mascara liquid in the container 1 does not adhere to the shaping rod 21. In the unused state, the restricting chip 96 of the switch knob 34 is received by the shoulder wall of the container 1 and downward movement is restricted. Therefore, it is possible to reliably prevent an accidental switch of the switch knob 34 into a first ON state or a second ON state. Moreover, as described above, if the switch knob 34 has been switched to the ON state, the restricting chip 96 is pushed up by the shoulder wall of the container 1 as the application body 2 is screwed over the threaded shaft 5 and therefore the switch knob 34 is forcibly switched to the OFF state shown in FIG. 8.

Because the other structures of the mascara applicator and modes of use of the mascara applicator are the same as those of the mascara applicators according to the first invention group, description thereof will be omitted.

In the above-described embodiment, the first connection structure for connecting the container 1 and the application body 2 is formed by the thread structure and the second connection structure for connecting the application body 2 and the shaping body 3 is formed by the pressure fitting engagement structure so that operating directions in canceling connected states of the respective connection structures are extremely different from each other. Therefore, in the case of using the application body 2, the application body 2 can be detached from the container 1 by turning the shaping grip 20 in a loosening direction. On the other hand, in the case of using the shaping body 3, the shaping body 3 can be detached from the application body 2 by pulling out the shaping grip 20. Therefore, it is impossible to detach the application body 2 or the shaping body 3 by mistake. In this way, the member to be used can be properly detached from the connection mating member as intended by a user and a series of cosmetic treatments can be deftly carried out with less work. In most cases, the shaping body 3 is used to curl eyelashes and then the application body 2 is used to apply the mascara liquid to the eyelashes. Because the shaping body 3 which is used more frequently than the application body 2 is connected to the application body 2 by the pressure fitting engagement structure, the shaping body 3 can be quickly and easily attached and detached.

FIGS. 32 to 43 show another embodiment of the cosmetic tool according to the second invention group. In the following description, portions different from those in the above-described embodiment will be mainly described and the same members as those in the above-described embodiment will be provided with the same reference signs and will not be described.

Figure 32:
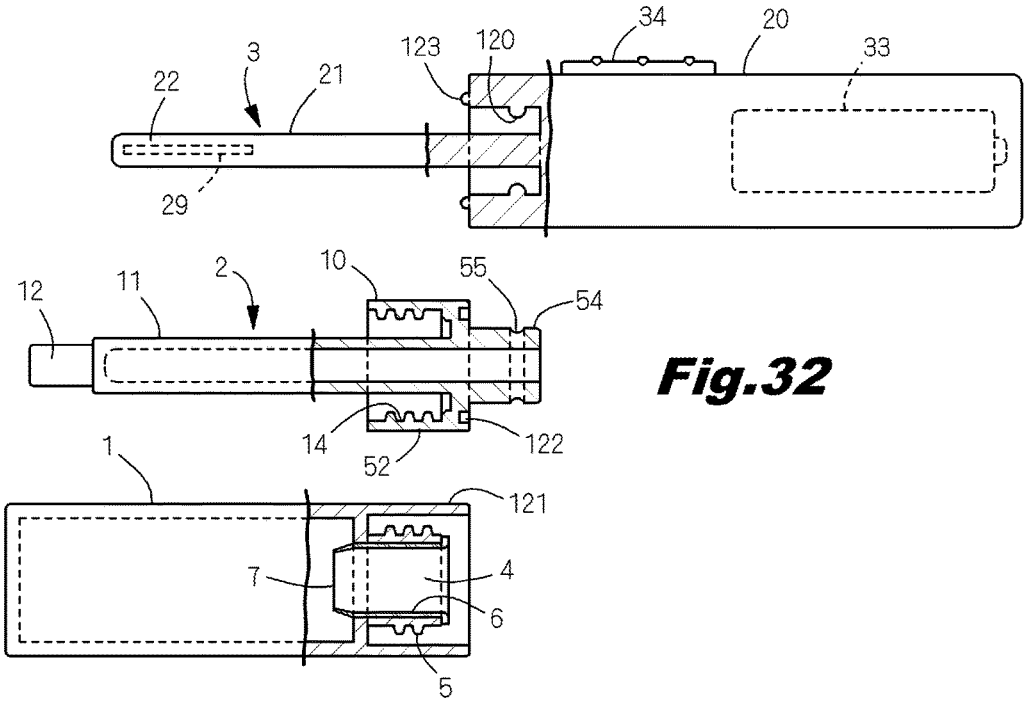
FIG. 32 is a partially cutaway side view showing another embodiment of the cosmetic tool according to the second invention group.

A cosmetic tool shown in FIG. 32 is a lip applicator and includes a container 1 for housing lip liquid with high viscosity, an application body 2, and a lip shaping body (shaping body) 3 for spreading the lip. A first connection structure for connecting the container 1 and the application body 2 is formed by a thread structure including a threaded shaft 5 and a threaded cap 52 similarly to that in the above-described embodiment. A second connection structure for connecting the application body 2 and the lip shaping body 3 is formed by a pressure fitting engagement structure including a connection groove 55 provided to a connection boss 54 and an annular connection rib 120 provided on an inner face of a shaping grip 20. A periphery of the threaded shaft 5 of the container 1 is surrounded with a cylindrical wall 121.

The application body 2 is formed by a cap 10, an application rod 11 formed integrally with the cap 10, and an application portion 12 in a shape of a round shaft and fixed to a protruding end of the application rod 11 and the application portion 12 is different from the application body 2 in the above-described embodiment in that the application portion 12 is formed by a sponge-like elastic porous body. The lip shaping body 3 includes a shaping rod 21 and a heating shaping portion 22 provided to a tip end of the shaping rod 21. The heating shaping portion 22 is formed into a stick shape and a heater 29 is disposed inside the heating shaping portion 22. In order to transmit a turning operation of the shaping grip 20 to the cap 10 in a state in which the connection rib 120 is fitted with pressure and engaged with the connection groove 55, a plurality of engagement holes 122 are formed in recessed shapes in a shoulder wall of the threaded cap 52 and engagement protrusions 123 to be inserted and engaged in the engagement holes 122 are formed on an end wall of the shaping grip 20.

Figure 33:
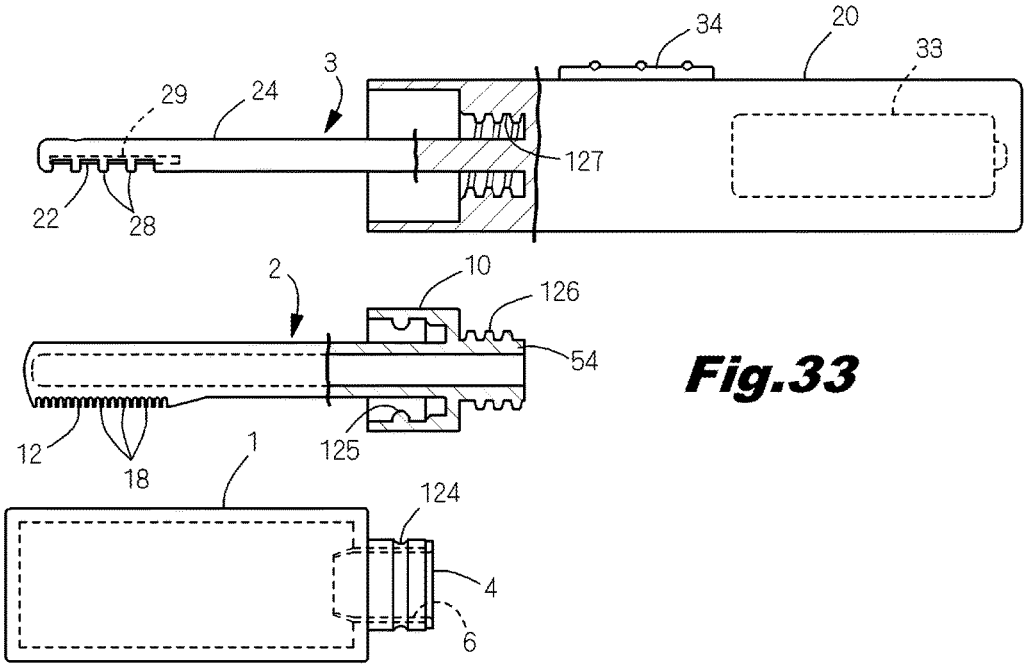
FIG. 33 is a partially cutaway side view showing yet another embodiment of the cosmetic tool according to the second invention group.

A cosmetic tool shown in FIG. 33 is a mascara applicator and includes a container 1, an application body 2, and a shaping body 3. A first connection structure for connecting the container 1 and the application body 2 is formed by a pressure fitting engagement structure including a connection groove 124 formed in a peripheral wall of an inlet/outlet 4 and a connection rib 125 formed on an inner face of a cap 10. A second connection structure for connecting the application body 2 and the lip shaping body 3 is formed by a thread structure including a threaded shaft 126 formed on a periphery of a connection boss 54 and a threaded hole 127 formed in an inner face of the shaping grip 20.

Figure 34:
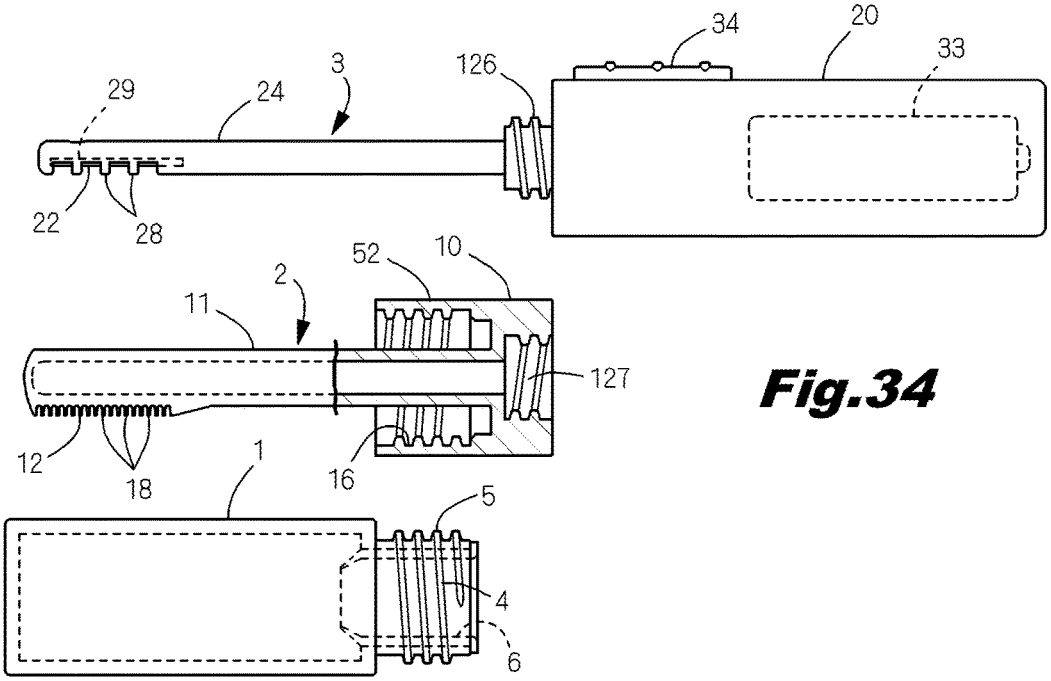
FIG. 34 is a partially cutaway side view showing yet another embodiment of the cosmetic tool according to the second invention group.

A cosmetic tool shown in FIG. 34 is a mascara applicator and includes a container 1, an application body 2, and a shaping body 3. A first connection structure for connecting the container 1 and the application body 2 is formed by a thread structure including a threaded shaft 5 and a threaded cap 52 similarly to that in the embodiment described by using FIG. 30. A second connection structure for connecting the application body 2 and the shaping body 3 is formed by a thread structure including a threaded hole 127 formed in an inner face of a cap 10 and a threaded shaft 126 provided to a shaping grip 20. In this case, thread diameters of the second connection structure are set to be smaller than thread diameters of the first connection structure. Therefore, if a turning force in a loosening direction acts on the shaping grip 20, the second connection structure is disconnected prior to the first connection structure. In other words, in the present embodiment, by setting different thread diameters for the first connection structure and the second connection structure, larger and smaller different operating forces are required to cancel connected states of the respective connection structures.

Figure 35:
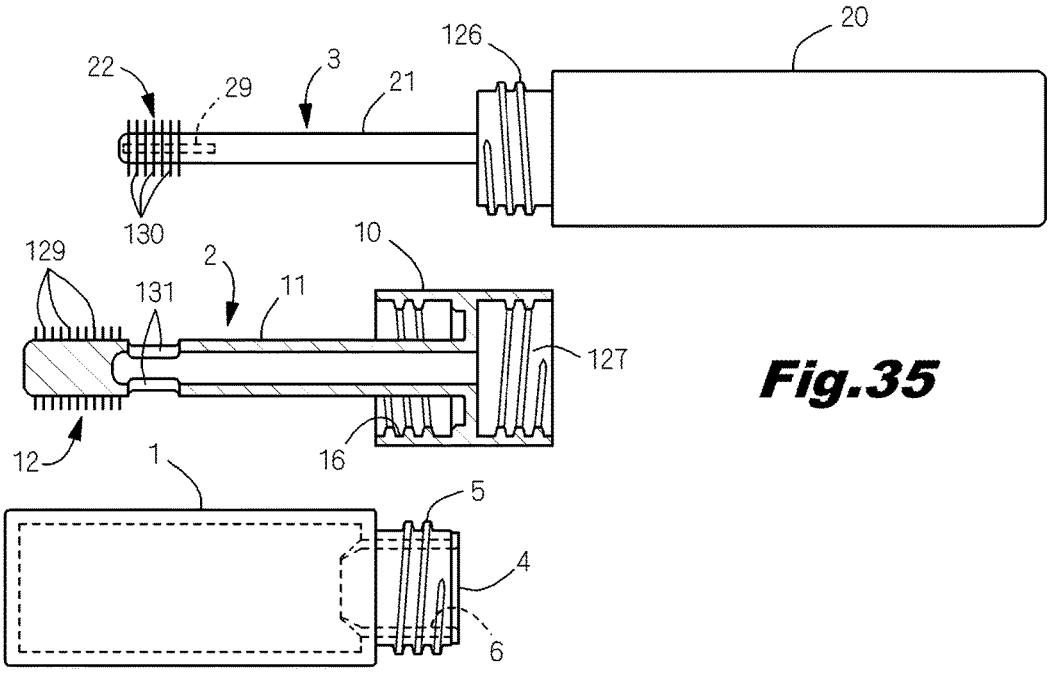
FIG. 35 is a partially cutaway side view showing yet another embodiment of the cosmetic tool according to the second invention group.

A cosmetic tool shown in FIG. 35 is a mascara applicator and includes a container 1, an application body 2, and a shaping body 3. In the present embodiment, as described by using FIG. 34, a first connection structure and a second connection structure are formed by thread structures having the same thread diameters. However, the embodiment is different from the embodiment in FIG. 34 in that the first connection structure is formed by a left-hand thread and the second connection structure is formed by a right-hand thread. In this case, operating directions for canceling connected states of the first connection structure and the second connection structure are directly opposite from each other. An application portion 12 is formed by radially implanting a group of bristle bunches (application elements) 129 in a periphery of an application rod 11. Similarly, a heating shaping portion 22 is formed by radially implanting a group of bristle bunches (application elements) 130 in a periphery of a shaping rod 21. A liquid communication port 131 is open at a position close to a tip end of the application rod 11 so that the mascara liquid can adhere to the bristle bunches 130 in a state in which the heating shaping portion 22 is housed inside the application rod 11.

Figure 36:
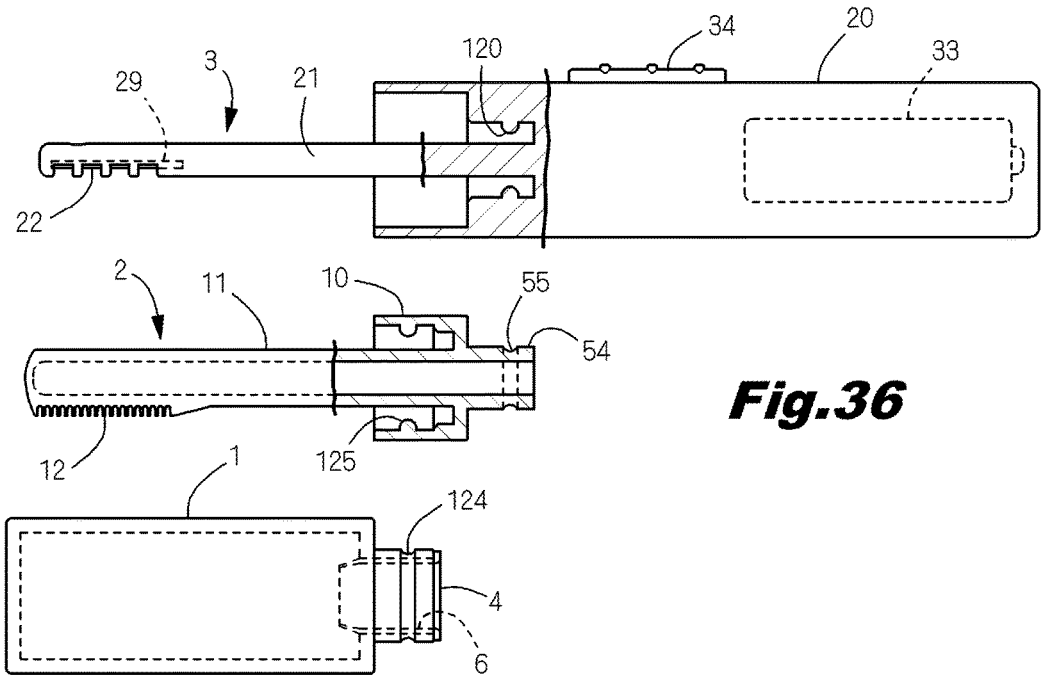
FIG. 36 is a partially cutaway side view showing yet another embodiment of the cosmetic tool according to the second invention group.

A cosmetic tool shown in FIG. 36 is a mascara applicator and includes a container 1, an application body 2, and a shaping body 3. In the present embodiment, a first connection structure is formed as a pressure fitting engagement structure including a connection groove 124 and a connection rib 125 similarly to the connection structure in FIG. 33. A second connection structure is formed as a pressure fitting engagement structure including a connection groove 55 and a connection rib 120 similarly to the connection structure described by using FIG. 32. However, diameters of the connection groove 55 and the connection rib 120 of the second connection structure are set to be smaller than diameters of the connection groove 124 and the connection rib 125 of the first connection structure so that the connection groove 55 and the connection rib 120 of the second connection structure are detached from each other prior to the first connection structure when a shaping grip 20 is pulled out.

Figure 37:
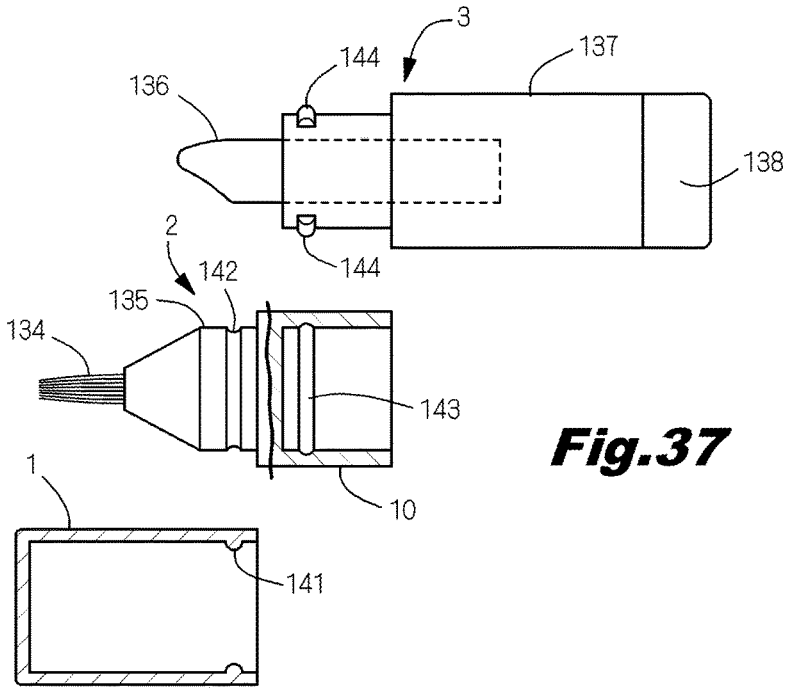
FIG. 37 is a partially cutaway side view showing yet another embodiment of the cosmetic tool according to the second invention group.

A cosmetic tool shown in FIG. 37 is a lip applicator in which a protective cap 1 is a first member, an application body 2 having a lip brush 134 is a second member, and a lip container 3 to be attached to and detached from the application body 2 is a third member. The application body 2 has a brush holder 135 at one end of a cap 10 and the holder 135 supports the above-described lip brush 134. The lip container 3 has a main body portion 137 for housing a lip 136 solidified into a stick shape and an operation cap 138 for putting out and in the lip 136 is provided to an end portion of the lip container 3 to be able to turn.

A first connection structure for connecting the protective cap 1 and the application body 2 is formed by a connection rib 141 provided on an inner face of the protective cap 1 and a connection groove 142 formed in a peripheral face of the brush holder 135. A second connection structure for connecting the application body 2 and the lip container 3 is formed by a connection groove 143 provided in an inner face of the cap 10 and connection ribs 144 formed intermittently at a plurality of positions of a peripheral face of the main body portion 137. Although both the first connection structure and the second connection structure are formed by pressure fitting engagement structures, the connection ribs 144 of the second connection structure are formed intermittently and therefore the lip container 3 can be detached from the application body 2 prior to the protective cap 1 and the application body 2. The lip brush 134 may be exposed by pulling the protective cap 1 off the application body 2 and the lip 136 may be exposed by pulling the lip container 3 out of the application body 2.

Figure 38:
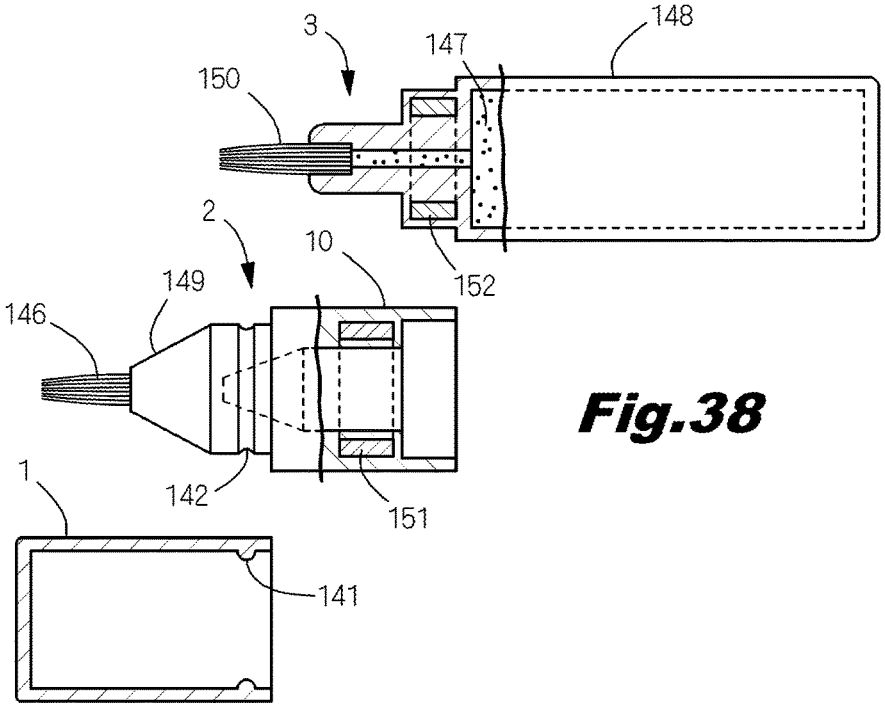
FIG. 38 is a partially cutaway side view showing yet another embodiment of the cosmetic tool according to the second invention group.

A cosmetic tool shown in FIG. 38 is an eye shadow applicator in which a protective cap 1 is a first member, an application body 2 having an adjusting brush 146 is a second member, and a main body portion 148 for housing liquid eye shadow 147 is a third member. The application body 2 has a brush holder 149 at one end of a cap 10 and the holder 149 holds the above-described adjusting brush 146. A shadow brush 150 for applying the eye shadow 147 is provided to the main body portion 148.

A first connection structure for connecting the protective cap 1 and the application body 2 is formed by a connection rib 141 provided on an inner face of the protective cap 1 and a connection groove 142 formed in a peripheral face of the brush holder 149. A second connection structure for connecting the application body 2 and the main body portion 148 is formed by a first magnet 151 embedded in a cylindrical wall of the cap 10 and a second magnet 152 embedded in a wall of the main body portion 148. In a state in which the application body 2 and the main body portion 148 are connected, the first magnet 151 and the second magnet 152 are exerting attraction with different magnetic poles directly facing each other. By detaching the application body 2 and the main body portion 148 from each other against attracting forces of both the magnets 151 and 152, it is possible to expose the shadow brush 150 prior to detachment of the protective cap 1 and the application body 2 from each other.

Figure 39:
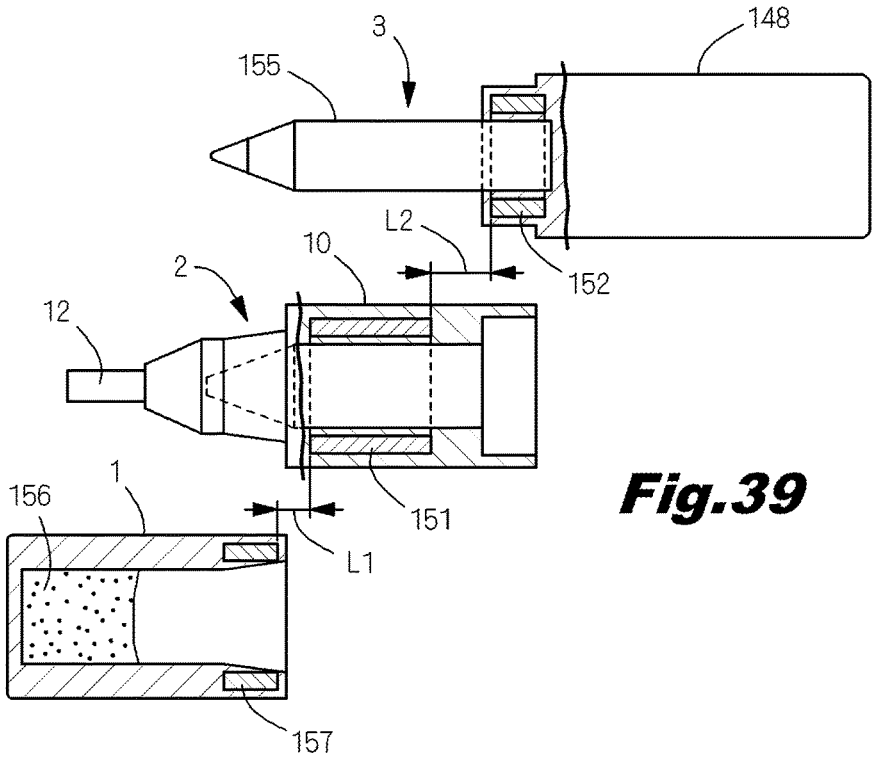
FIG. 39 is a partially cutaway side view showing yet another embodiment of the cosmetic tool according to the second invention group.

A cosmetic tool shown in FIG. 39 is an eyebrow applicator in which a protective cap 1 is a first member, an application body 2 having an application portion 12 in a shape of a round shaft is a second member, and a main body portion 148 for supporting a pencil-shaped eyebrow pencil 155 is a third member. In a dead end portion of an inside of the protective cap 1, solidified eyebrow coloring 156 is housed. The application portion 12 for applying the eyebrow coloring 156 is formed by a sponge-like elastic porous body.

A first connection structure for connecting the protective cap 1 and the application body 2 is formed by a third magnet 157 embedded in a cylindrical wall of the protective cap 1 and a first magnet 151 embedded in a cylindrical wall of a cap 10. A second connection structure for connecting the application body 2 and the main body portion 148 is formed by the first magnet 151 embedded in the cylindrical wall of the cap 10 and a second magnet 152 embedded in a wall of the main body portion 148. In a state in which the protective cap 1 is connected to the application body 2, the third magnet 157 and the first magnet 151 are exerting attraction with different magnetic poles directly facing each other. Similarly, in a state in which the application body 2 and the main body portion 148 are connected, the first magnet 151 and the second magnet 152 are exerting attraction with different magnetic poles directly facing each other.

In the present embodiment, in a state in which the protective cap 1, the application body 2, and the main body portion 148 are connected, a distance L1 between attracting faces of the third magnet 157 and the first magnet 151 is set to be shorter than a distance L2 between attracting faces of the first magnet 151 and the second magnet 152. Therefore, by pulling the main body portion 148, it is possible to detach the main body portion 148 and the eyebrow pencil 155 from the application body 2 prior to detachment of the protective cap 1 and the application body 2 from each other.

A cosmetic tool shown in FIGS. 40 to 43 is a skin surface cosmetic tool for carrying out a cosmetic treatment while supplying an electric current to a skin surface, in which a protective cap 1 is a first member, a sheet holder 160 to be attached to and detached from the protective cap 1 and a main body portion 148 is a second member, and the main body portion 148 having a spherical skin electrode 161 is a third member.

Figure 40:
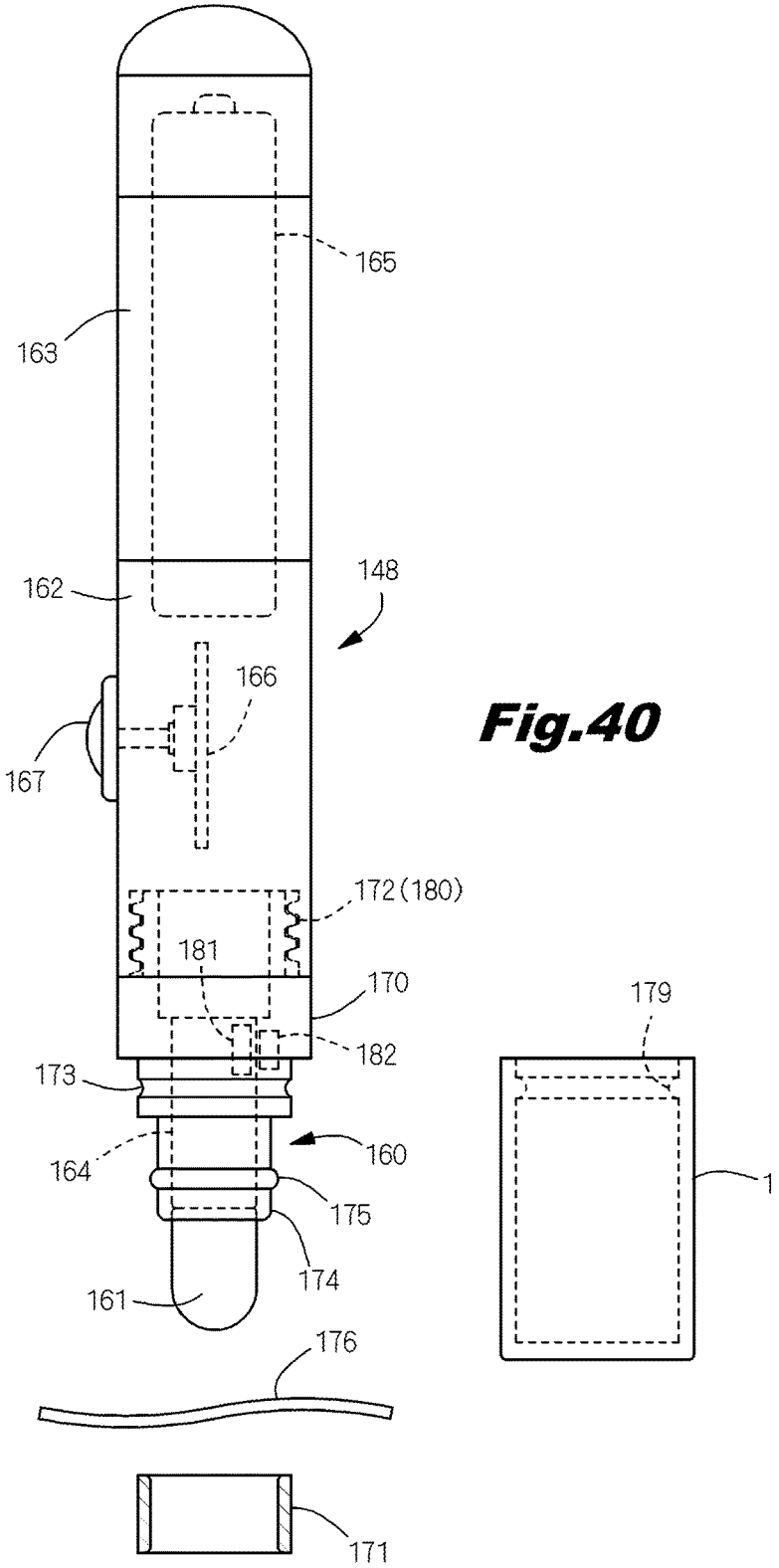
FIG. 40 is a partially cutaway side view showing yet another embodiment of the cosmetic tool according to the second invention group.

In FIG. 40, the main body portion 148 has a main body case 162, which is long in a vertical direction, and the skin electrode 161 at its lower end, and a ring-shaped grip electrode 163 is exposed at an upper portion of the case. The skin electrode 161 is made of metal having excellent electrical conductivity, has a hemispherical face to be brought in contact with skin, and is supported by an electrode holder 164 in a shape of a round shaft and provided at a lower end of the main body case 162. A battery 165, a control board 166, and the like are housed inside the main body portion 148 and the control board 166 is provided with a circuit for generating pulse current, a switching circuit for reversing polarity of the pulse current, and the like. On a front face of the main body portion 148, a switch button 167 is provided.

The sheet holder 160 is formed by a holder main body 170 having upper and lower opposite open ends and a round cylindrical sheet cap 171 to be attached by fitting with pressure to a lower portion of the holder main body 170. The holder main body 170 is formed by a plastic molded article and has a threaded shaft 172 at its upper end and a connection groove 173 is formed in an annular shape in a peripheral face of a middle portion in the vertical direction of the holder main body 170. A sheet retaining cylinder 174 is provided to the lower portion of the holder main body 170 and a sheet retaining rib 175 is formed on a peripheral face of the sheet retaining cylinder 174. In a state in which the holder main body 170 is connected to the main body case 162, by causing a liquid impregnated sheet 176 such as a cotton sheet or gauze to cover the skin electrode 161 and the sheet retaining cylinder 174 and fitting the sheet cap 171 over the sheet retaining cylinder 174, it is possible to pinch and fix the liquid impregnated sheet 176 between the sheet retaining rib 175 and the sheet cap 171 (see FIG. 41).

A first connection structure for connecting the protective cap 1 and the sheet holder 160 is formed as a pressure fitting engagement structure including a connection rib 179 formed on an inner face of a cylindrical wall of the protective cap 1 and the connection groove 173 formed in the holder main body 170. A second connection structure for connecting the sheet holder 160 and the main body portion 148 is formed as a thread structure including the threaded shaft 172 formed on the holder main body 170 and a threaded hole 180 formed on an inner face of a lower portion of the main body case 162. In order to sense that the sheet holder 160 is connected to the main body portion 148, a reed switch 181 is embedded in the electrode holder 164 and a magnet 182 is embedded in an inner face of the holder main body 170. In a connected state of the second connection structure, the reed switch 181 is switched into an ON state by the magnet 182 and therefore a control circuit determines that the sheet holder 160 and the main body portion 148 are connected and supplies pulse current with positive polarity to the skin electrode 161.

Figure 41:
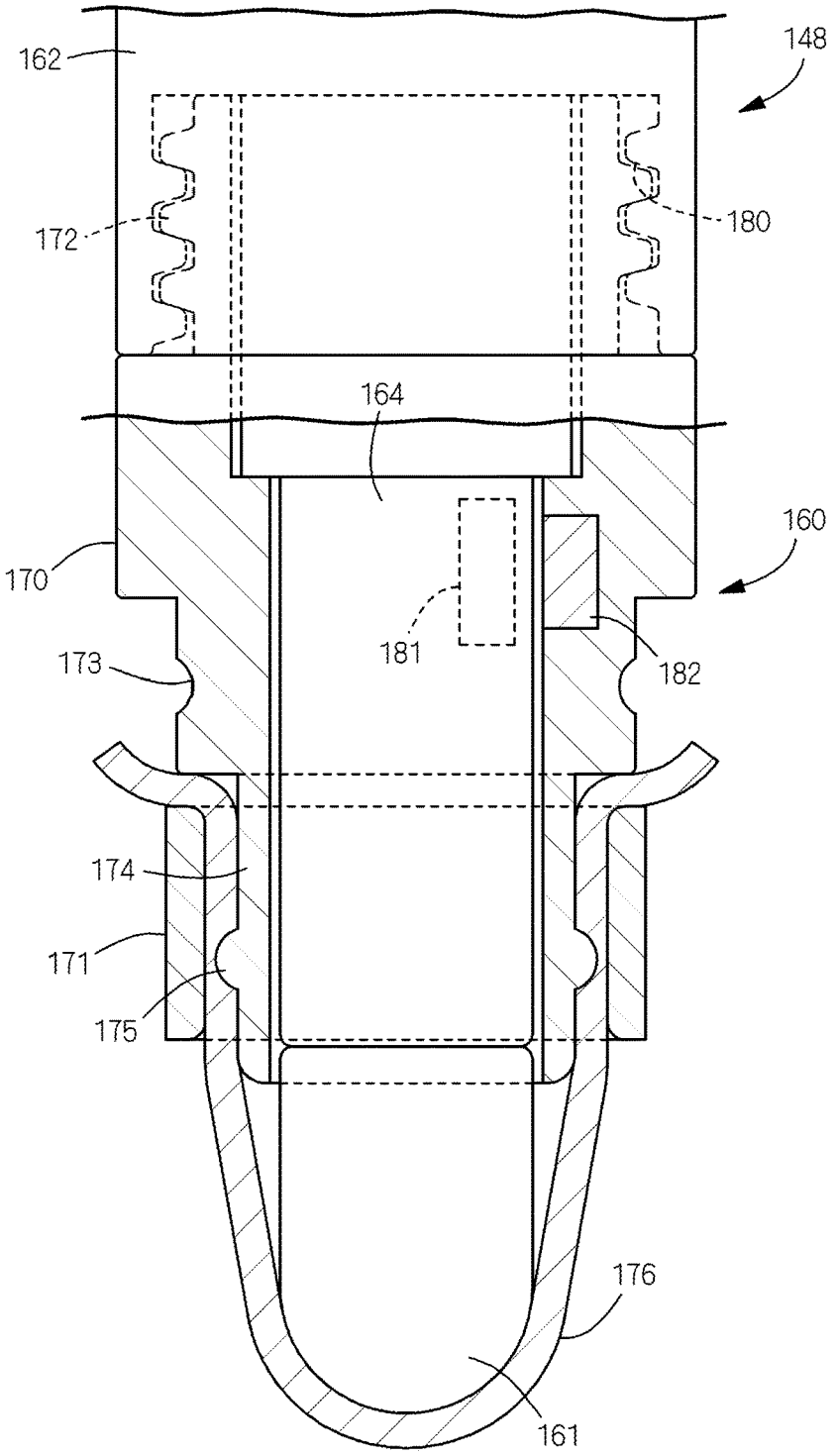
FIG. 41 is a partially cutaway side view of the cosmetic tool in FIG. 40.

The skin cosmetic tool can be used in either one of a cleansing mode in which the tool is used while supplying positive pulse current to the skin electrode 161 and negative pulse current to the grip electrode 163 and an iontophoresis mode in which polarity of the pulse current supplied to the respective electrodes 161 and 163 is reversed. In the cleansing mode, as shown in FIG. 41, after the sheet holder 160 is connected to the main body portion 148 by the second connection structure, the liquid impregnated sheet 176 is fixed to the skin electrode 161 by the sheet cap 171 and impregnated with beauty serum such as lotion. In this state, the switch button 167 is pushed down and the liquid impregnated sheet 176 is repeatedly slid along a skin surface while the positive pulse current is supplied to the skin electrode 161. When the liquid impregnated sheet 176 is pressed against the skin surface, the skin electrode 161 and the grip electrode 163 are electrically continuous with each other through a human body. Therefore, the pulse current exerts an ion leading-out action and pore-clogging dirt is attracted to the skin electrode 161 and caught by the liquid impregnated sheet 176.

Figure 42:
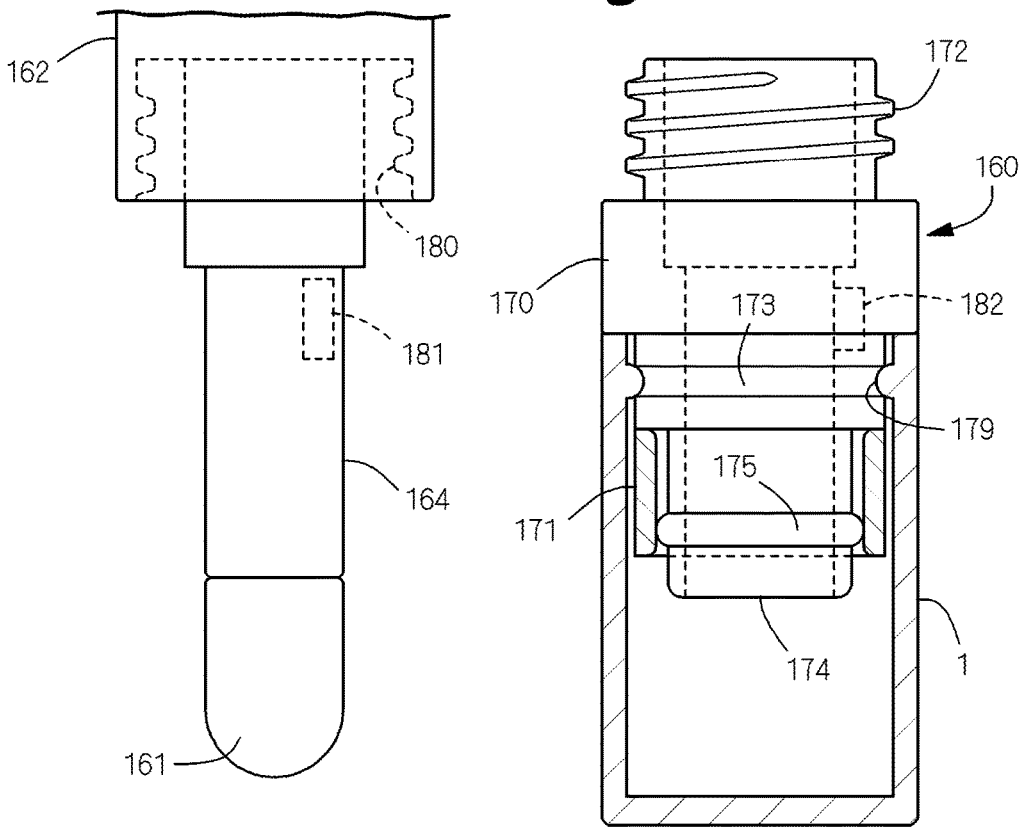
FIG. 42 is a partially cutaway side view showing a used state of the cosmetic tool in FIG. 40.
Figure 43:
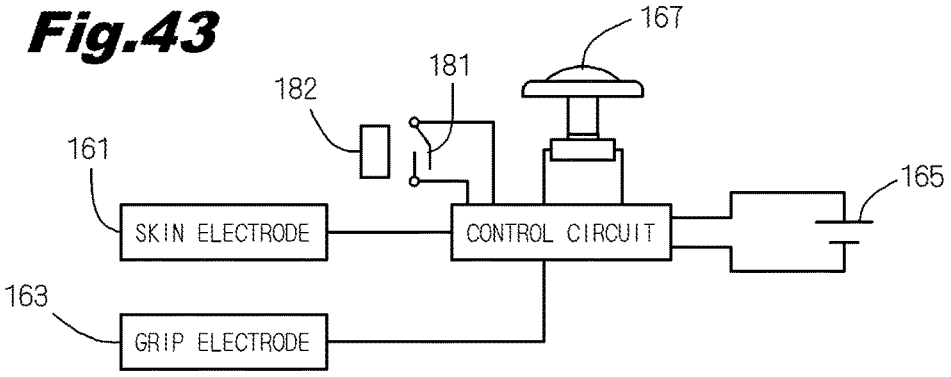
FIG. 43 is an explanatory view schematically showing a control circuit in the cosmetic tool in FIG. 40.

In the iontophoresis mode, as shown in FIG. 42, the sheet holder 160 is detached from the main body portion 148 and housed in the protective cap 1. In this state, the reed switch 181 is switched into an OFF state and therefore the control circuit determines that the sheet holder 160 is detached from the main body portion 148 and supplies pulse current with negative polarity to the skin electrode 161. When the skin electrode 161 in this state is pressed against the skin surface, the skin electrode 161 and the grip electrode 163 are electrically continuous with each other through the human body. Therefore, the pulse current exerts an iontophoresis action and can cause the beauty serum such as lotion applied to the skin surface to penetrate into the skin.

If relationships between the first member, the second member, and the third member in each of the above-described embodiments are considered from a viewpoint of weight, a weight W3 of the third member is greater than a weight W1 of the first member or a weight W2 of the second member and the relationships satisfy an expression (W3>W2>W1) or an expression (W3>W1>W2). Therefore, by forming the third member with a large weight so that it is detached prior to the other members, it is possible to improve usability of the cosmetic tool as compared with a case in which the second member and the third member connected to each other are detached from the first member prior to the third member. If the second member is used more frequently than the third member, the second member is used in the state in which the second member and the third member are connected, i.e., the state with a greater weight than when the third member is used alone and therefore the second member cannot be used lightly, which impairs usability of the cosmetic tool.

If the first connection structure and the second connection structure are formed by the pressure fitting engagement structures, flat springs or wire springs may be used to maintain engaged states. In this case, by setting larger and smaller different spring forces for the flat springs or the wire springs in the respective connection structures, larger and smaller different operating forces are required to cancel connected states of the respective connection structures.

(Embodiments of Cosmetic Tool According to Third Invention Group)

Cosmetic tools according to the present embodiments are basically the same as the embodiments of the cosmetic tools according to the first invention group and the second invention group.

A mascara applicator in the present embodiment is formed by a first member, a second member, and a third member for performing different functions similarly to the mascara applicator described by use of FIG. 31. In the present embodiment, the container 1 for housing mascara liquid is a first member, an application body 2 to be attached to and detached from the container 1 is a second member, and a shaping body (treatment body) 3 to be attached to and detached from the application body 2 is a third member. The container 1 and the application body 2 are detachably connected by a first connection structure and the application body 2 and the shaping body 3 are detachably connected by a second connection structure. In a state in which the three members, i.e., the container 1, the application body 2, and the shaping body 3 are connected by both the first and second connection structures, the mascara applicator can be treated as a single cosmetic tool.

In FIG. 1, the application body 2 is formed by a cylindrical cap (application grip) 10 to be attached to and detached from an inlet/outlet 4 in the container 1, an application rod 11 in a shape of a hollow shaft having a closed tip end to be inserted into the container 1, and an application portion 12 provided to a lower end portion of the application rod 11. The cap 10 is provided with a connection portion for the container 1 and a connection portion for the shaping body 3. The connection portion for the container 1 is formed by a threaded cap 52 occupying a most part of the cap 10 and a threaded hole 16 corresponding to the above-described threaded shaft 5 is formed on an inner face of the threaded cap 52. In this manner, a first connection structure is formed by the threaded shaft 5 and the threaded cap 52. On an outer face of the cap 10, a positioning rib 53 which is long in a vertical direction is formed.

The connection portion for the shaping body 3 is formed by a connection boss 54 continuous with an upper portion of the threaded cap 52 and a connection groove 55 formed in an annular shape in a peripheral face of the connection boss 54. An outer diameter of the connection boss 54 is set to be smaller than an outer diameter of the threaded cap 52 and a shoulder wall between a base end of the connection boss 54 and the threaded cap 52 functions as a restricting portion 56 of a stopper 93 (described later). By fitting and engaging a rod boss 57 provided to an upper end of the above-described application rod 11 with an inner face of the connection boss 54 with pressure, the application rod 11 is integrated with the cap 10 so as not to be detachable.

Figure 44:
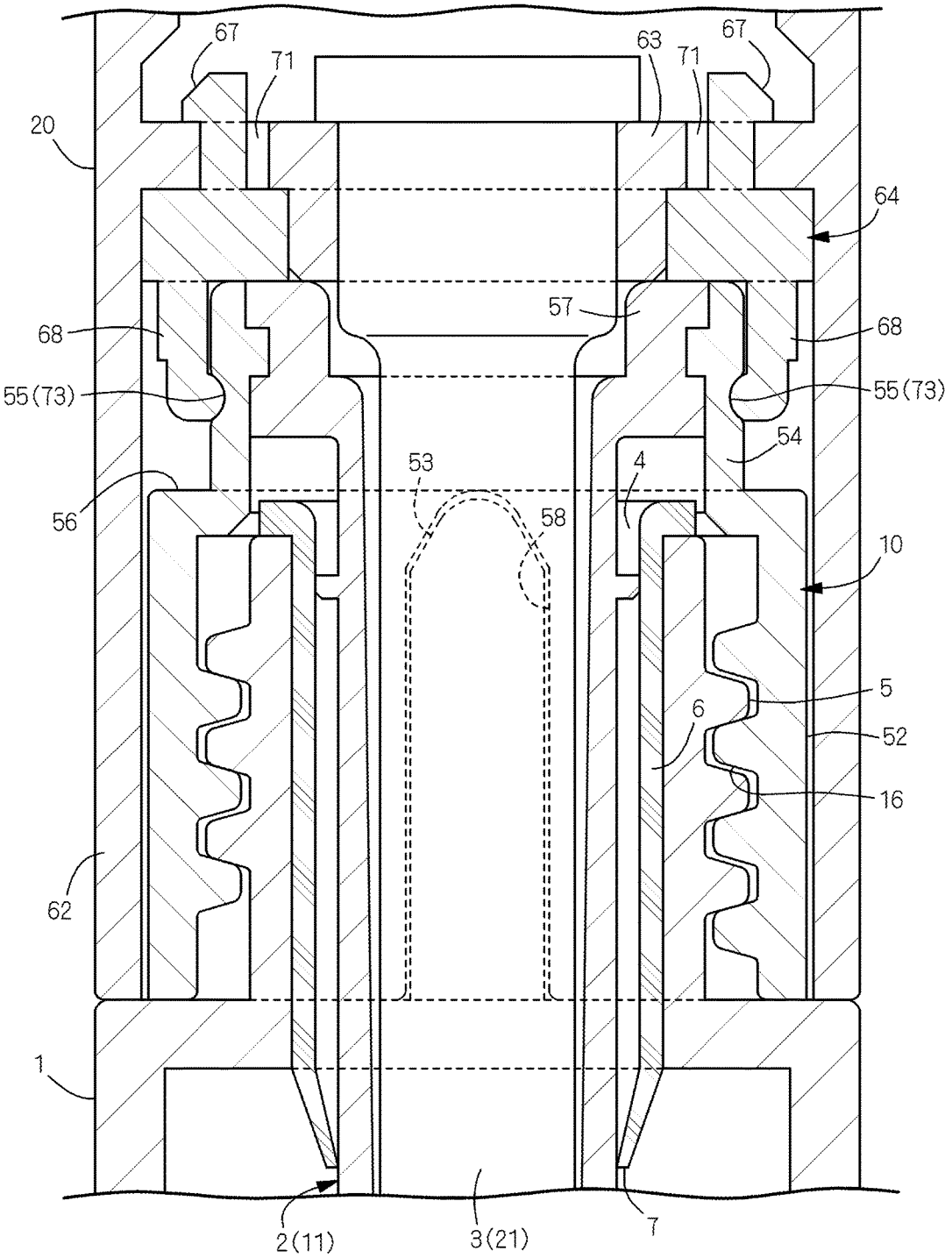
FIG. 44 is a vertical sectional front view showing a connection structure of a cosmetic tool according to a third invention group.
Figure 45:
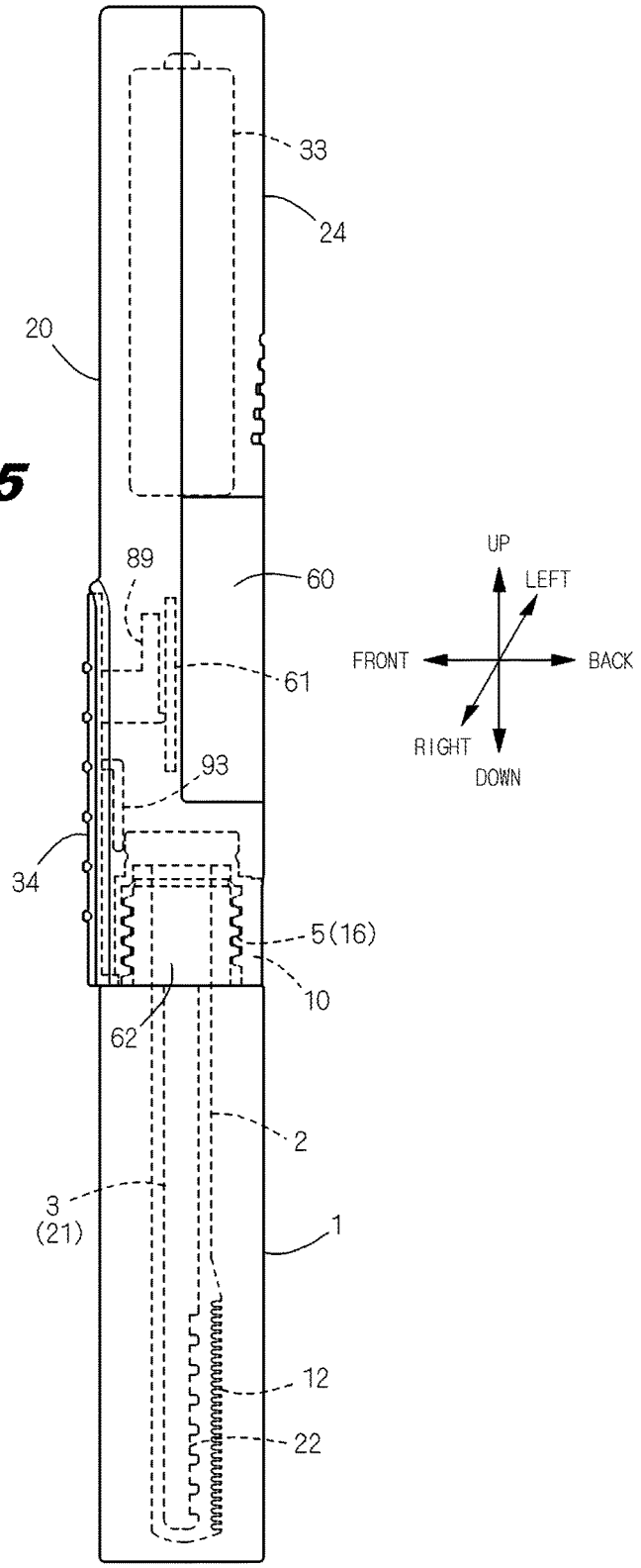
FIG. 45 is a side view of the cosmetic tool in FIG. 44.
Figure 46:
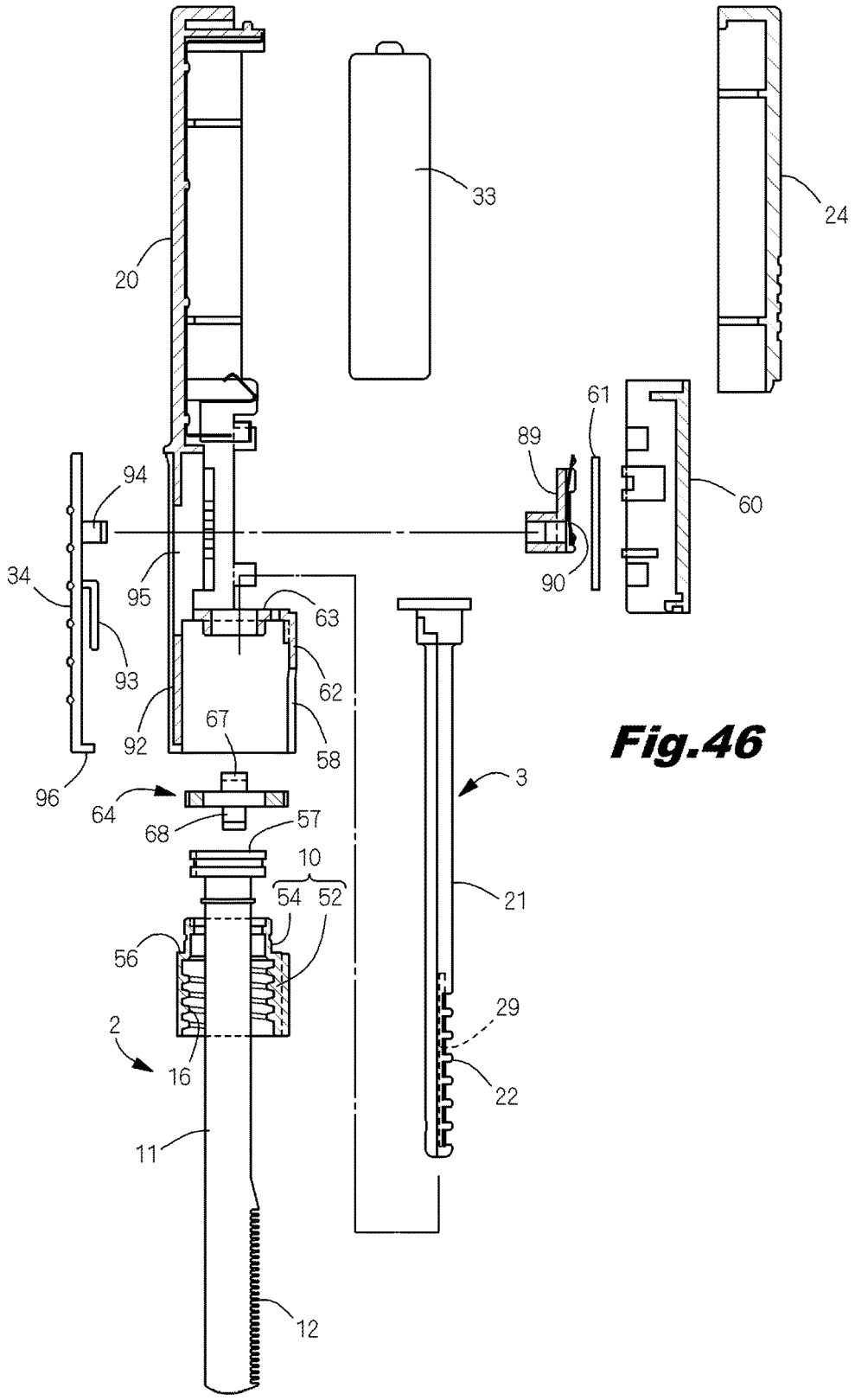
FIG. 46 is an exploded sectional view of the cosmetic tool in FIG. 44.

The shaping body 3 is formed by a circular cylindrical shaping grip (grip) 20 serving also as a main body case of the mascara applicator, a hollow shaping rod (treatment rod) 21 protruding downward from a lower end of the shaping grip 20, a heating shaping portion (treatment portion) 22 provided to a lower end of the shaping rod 21, and the like. A battery lid 24 in a shape of a gutter is detachably provided to one side of an upper half of the shaping grip 20 and a board cover 60 in a shape of a gutter is disposed on a lower side of the battery lid 24. Inside the shaping grip 20, a battery 33, a control board 61, a switch structure, and the like are housed (see FIG. 2). As shown in FIGS. 44 and 45, a round cylindrical shield wall 62 is provided to a lower end portion of the shaping grip 20 and a switch knob 34 for turning on and off energization of a heater 29 is provided to a front face of the shield wall 62. A positioning groove 58 for receiving the above-described positioning rib 53 is formed (see FIG. 46) at a back portion of the shield wall 62. In a state in which the shaping body 3 is connected to the application body 2, the cap 10 is housed in a space surrounded with the shield wall 62 with the positioning rib 53 engaged in the positioning groove 58 as shown in FIG. 1. A lower end of the switch knob 34 faces a contact portion between the shaping grip 20 and the cap 10.

As shown in FIG. 44, inside the shaping grip 20, a ring-shaped mounting boss 63 is integrally formed with a lower end of an area of the shaping grip 20 housing the control board 61 and an upper portion of the shaping rod 21 is attached to the mounting boss 63 by fitting with pressure. A connection ring 64 for making the connection boss 54 of the cap 10 detachable is fixed to the mounting boss 63. As shown in FIG. 4, from front and back opposed positions of an upper face and a lower face of the connection ring 64, paired engagement lugs 67 and paired elastic connection arms 68 protrude. Moreover, at right and left opposed positions of a peripheral face of the connection ring 64, a guide recessed portion 69 for guiding sliding of the stopper 93 (described later) and a positioning recessed portion 70 are formed.

As shown in FIG. 44, by engaging the paired engagement lugs 67 in engagement grooves 71 formed in the above-described mounting boss 63 from a lower face side, the connection ring 64 is fixed to the mounting boss 63 so as not to be detachable. At this time, the positioning recessed portion 70 is positioned by a positioning protrusion 72 provided to an inner face of the shaping grip 20 (see FIG. 4). A connection lug 73 having a semicircular section is provided to an inner face of a lower end of each of the elastic connection arms 68. By engaging and disengaging the connection lugs 73 in and from the connection groove 55 in the connection boss 54, the application body 2 and the shaping body 3 can be integrated with each other or the shaping body 3 can be detached from the application body 2. In this manner, the application body 2 and the shaping body 3 are detachably connected to each other by the second connection structure having the pressure fitting and engagement structure formed by the elastic connection arms 68 and the connection groove 55.

In the mascara applicator formed as described above, the three members, i.e., the container 1, the application body 2, and the shaping body 3 can be used respectively in separated states. Therefore, in the state in which the three members are separated from each other, the shaping body 3 may be inserted into the container 1 by mistake and the heating shaping portion 22 may be immersed in the mascara liquid. In order to avoid such improper use, an insertion preventing structure is provided between the shaping grip 20 and the cap 10 in the embodiment. As shown in FIG. 44, the insertion preventing structure is formed by the shield wall (cylindrical wall) 62 for covering a periphery of the cap 10 in a state in which the application body 2 and the shaping body 3 are connected to each other. If the shield wall 62 covers the periphery of the cap 10 in a state in which the application body 2 is connected to the container 1 and the shaping body 3 is connected to the application body 2, the cap 10 cannot be turned alone. Therefore, even if the shaping body 3 is pulled out of the application body 2, the inlet/outlet 4 of the container 1 is kept closed with the cap 10 and therefore it is possible to prevent the shaping rod 21 from being directly inserted into the container 1. In other words, in the embodiment, the shaping body 3 is allowed to be attached to and detached from the application body 2 only in a state in which the application body 2 is connected to the container 1, which prevents the shaping body 3 from being inserted into the container 1 by mistake.

Incidentally, if the application body 2 and the treatment body 3 connected to each other are detached from the container 1, it is not impossible to pull the treatment body 3 out of the application body 2 by gripping and holding the application rod 11. Moreover, the treatment body 3 detached from the application body 2 may be inserted into the container 1. However, the application rod 11 is thin and the mascara liquid is adhering to the application portion 12 and a surface of the rod, which makes a user to hesitate to dirty its hand to try to carry out the above-described detaching operation. Therefore, by providing the insertion preventing structure for covering an outer face of the cap 10 with the shield wall 62, it is possible to reliably prevent the treatment body 3 from being pulled out of the application body 2 to thereby prevent the treatment body 3 from being inserted into the container 1.

As described above, in the unused state of the mascara applicator, the threaded hole 16 provided to the cap 10 is screwed over the threaded shaft 5 and the application body 2 is integrated with the container 1. As shown in FIG. 45, the application rod 11 and the application body 2 in this state are immersed in the mascara liquid housed in the container 1. The shaping rod 21 of the shaping body 3 is housed inside the application rod 11 of the application body 2 and the connection groove 55 provided to the connection boss 54 of the application body 2 is engaged with and caught by the elastic connection arms 68 of the connection ring 64 (see FIG. 44). Because the shaping rod 21 in this state is housed in the application rod 11 having a closed structure, the entire shaping rod 21 including the heating shaping portion 22 is not immersed in the mascara liquid. Therefore, in the unused state, the mascara liquid in the container 1 does not adhere to the shaping rod 21.

In the unused state, the restricting chip 96 of the switch knob 34 is received by the shoulder wall of the container 1 and downward movement is restricted. Therefore, it is possible to reliably prevent an accidental switch of the switch knob 34 into the first ON state or the second ON state. Moreover, as described above, if the switch knob 34 has been switched into the ON state, the restricting chip 96 is pushed up by the shoulder wall of the container 1 as the application body 2 is screwed over the threaded shaft 5 and therefore the switch knob 34 is forcibly switched into the OFF state shown in FIG. 8.

Because the other structures of the mascara applicator and modes of use of the mascara applicator are the same as those of the mascara applicators according to the above-described invention groups, description thereof will be omitted.

FIGS. 47 to 54 show another embodiment of the cosmetic tool according to the third invention group. In the following description, portions different from those in the above-described embodiment will be mainly described and the same members as those in the above-described embodiment will be provided with the same reference signs and will not be described.

Figure 47:
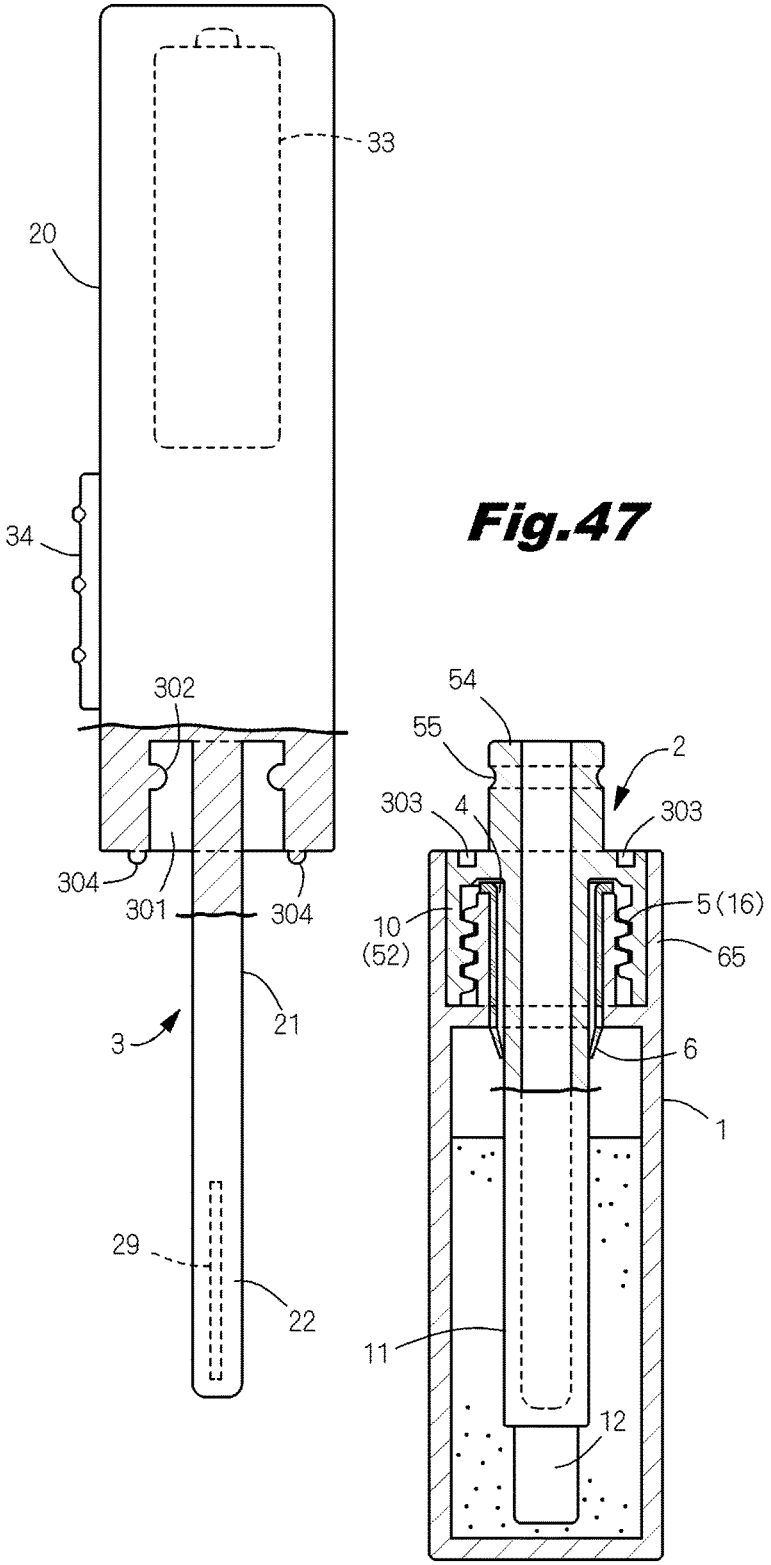
FIG. 47 is a partially cutaway side view showing another embodiment of the cosmetic tool according to the third invention group.

FIG. 47 shows the embodiment of the cosmetic tool in which the present invention is applied to a gloss applicator. In the present embodiment, gloss liquid with high viscosity is housed in a container 1 and it is possible to cause the gloss liquid to adhere to an application portion 12 provided to a tip end of an application rod 11 to apply the gloss liquid to lips. The application portion 12 is made of soft foam formed into a round stick shape. A heating shaping portion (treatment portion) 22 in a shape of a round stick is provided to a lower end of a shaping rod 21 of a shaping body 3 and it is possible to shape the gloss liquid applied by use of the above-described application portion 12 while spreading the gloss liquid with the heating shaping portion 22. A recessed portion 301 for housing the connection boss 54 is formed in a lower portion of a grip 20 serving also as a main body case and a connection rib 302 formed inside the recessed portion 301 and a connection groove 55 formed in the connection boss 54 form a second connection structure. In order to transmit a turning operation of the grip 20 to the cap 10 in a state in which the connection rib 302 is fitted with pressure and engaged with the connection groove 55, a plurality of engagement holes 303 are formed in recessed shapes in a shoulder wall of a threaded cap 52 and engagement protrusions 304 to be inserted and engaged in the engagement holes 303 are formed on an end wall of the grip 20. An insertion preventing structure in the present embodiment is formed by a shield wall (cylindrical wall) 65 provided at a periphery of an inlet/outlet 4 of a container 1. In a state in which an application body 2 is connected to the container 1 by screwing, an outer face of a cap 10 is covered with the shield wall 65 so that it is possible to prevent the application body 2 from being detached from the container 1. In other words, the application body 2 cannot be detached from the container 1 unless the shaping body 3 is connected to the application body 2 so that it is possible to prevent the shaping body 3 from being inserted into the container 1.

Figure 48:
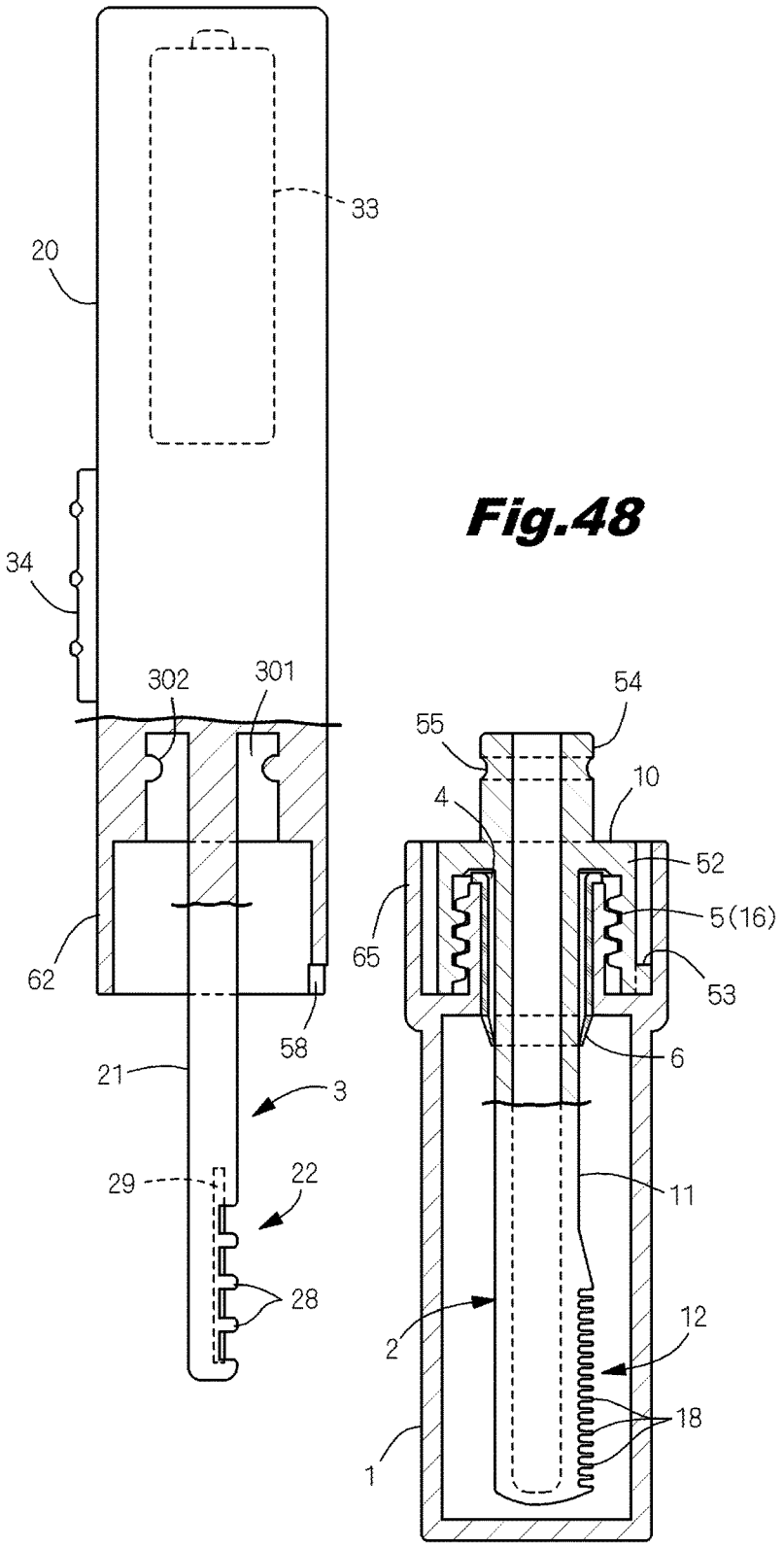
FIG. 48 is a partially cutaway side view showing yet another embodiment of the cosmetic tool according to the third invention group.
Figure 49:
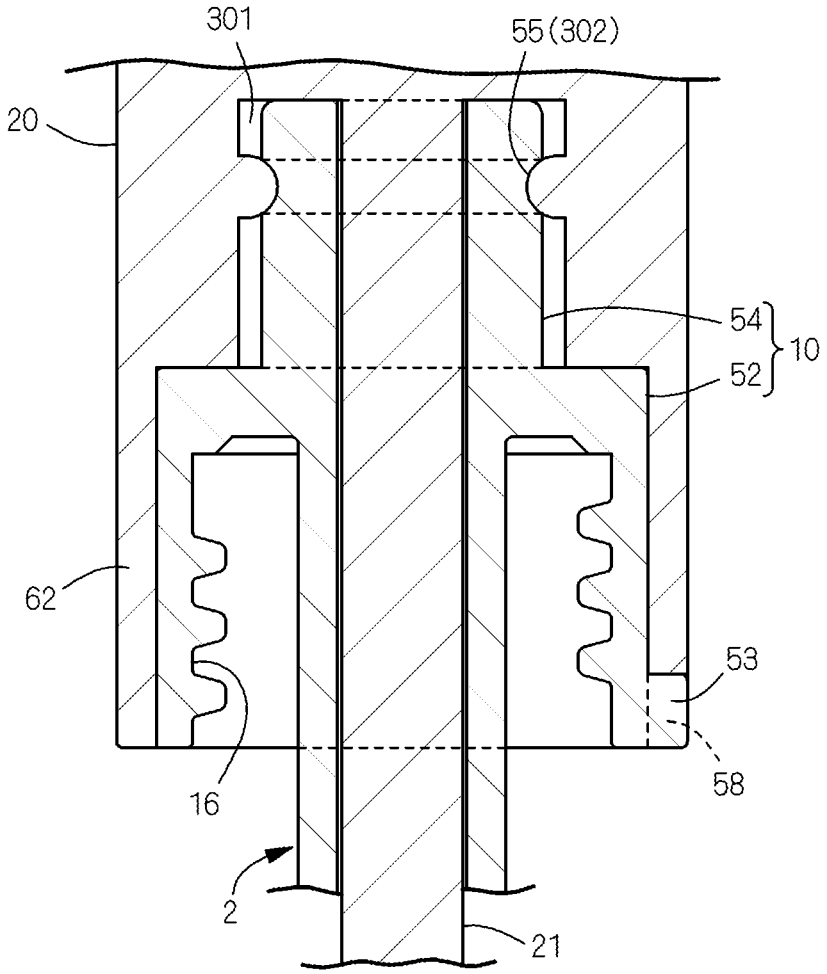
FIG. 49 is a vertical sectional view showing a connected state of the cosmetic tool in FIG. 48.

FIGS. 48 and 49 show another embodiment of a cosmetic tool in which the present invention is applied to a mascara applicator. In the embodiment, a second connection structure is formed similarly to that in FIG. 47, an inner shield wall (shield wall) 62 similar to that in FIG. 44 is formed at a lower portion of a shaping grip 20, and an outer shield wall (shield wall) 65 is formed at a periphery of an inlet/outlet 4 of a container 1. In a state in which an application body 2 is connected to a container 1 and a shaping body 3 is attached to the application body 2 by insertion, an outer face of the cap 10 is covered with the inner shield wall 62 and an outer face of the inner shield wall 62 is covered with the outer shield wall 65. A positioning rib 53 is formed on the outer shield wall 65 and a positioning groove 58 is formed in the inner shield wall 62. If the inner and outer two shield walls 62 and 65 are provided in this manner, an operation for detaching the application body 2 from the container 1 becomes complicated and it is possible to prevent the shaping body 2 from being inserted into the container 1 by mistake.

Figure 50:
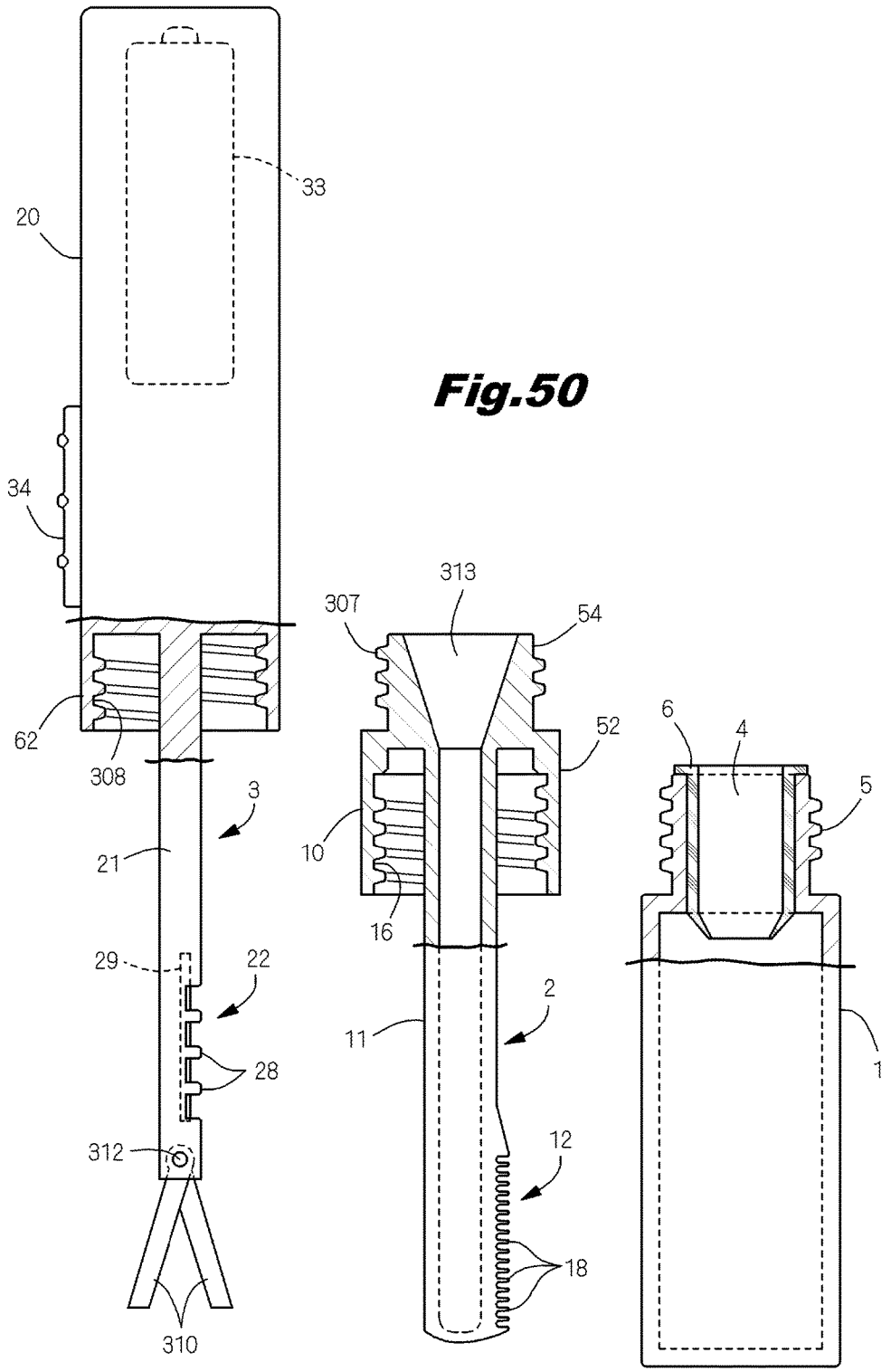
FIG. 50 is a partially cutaway side view showing yet another embodiment of the cosmetic tool according to the third invention group.
Figure 51:
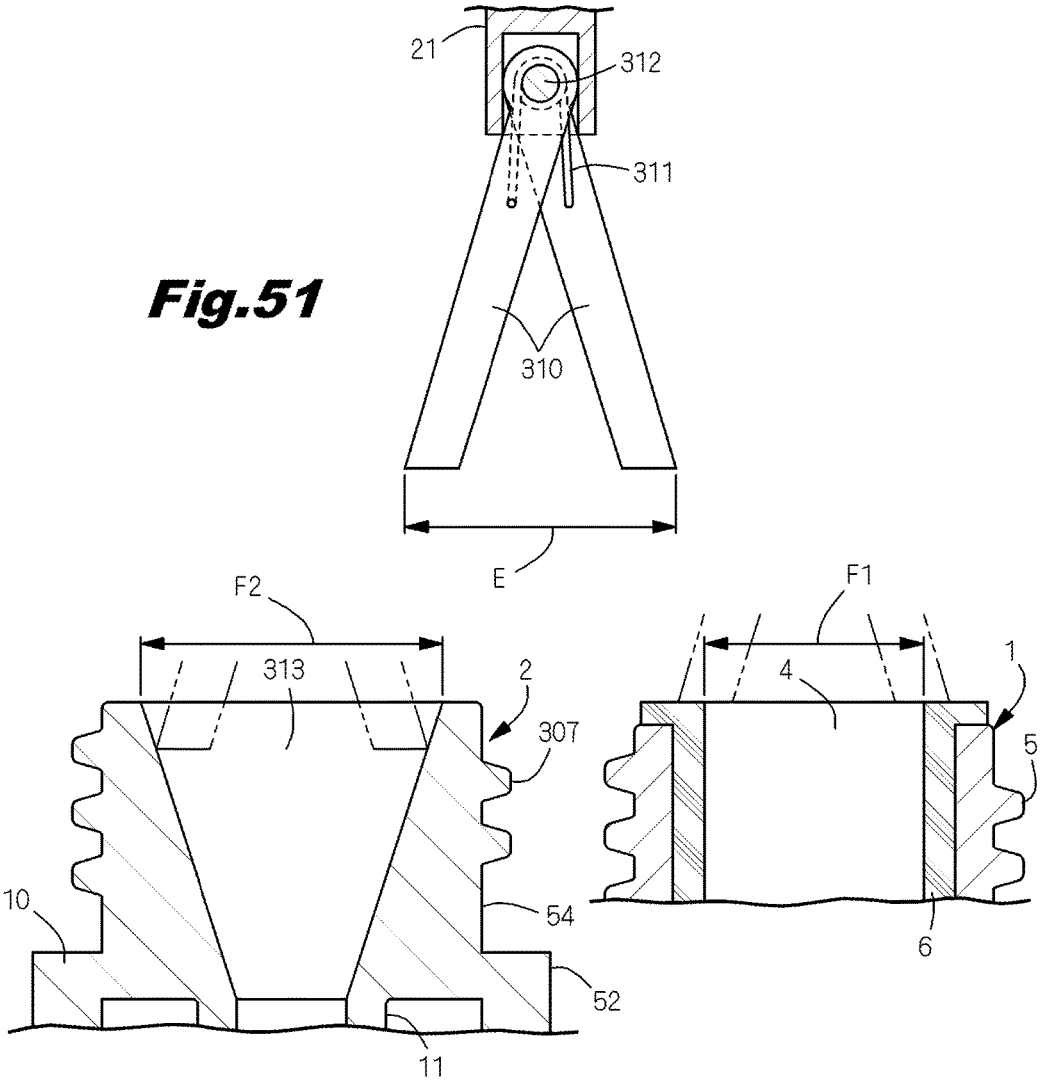
FIG. 51 is a sectional view showing relative dimensions of the cosmetic tool in FIG. 50.

FIGS. 50 and 51 show another embodiment of a cosmetic tool in which the present invention is applied to a mascara applicator. In the embodiment, a second connection structure is formed by a threaded shaft 307 provided to a peripheral wall of a connection boss 54 and a threaded hole 308 formed on an inner face of a cylindrical wall 62. In this case, thread diameters of the second connection structure are set to be smaller than thread diameters of a first connection structure. Therefore, if a turning force in a loosening direction acts on a shaping grip 20, the second connection structure is disconnected prior to the first connection structure.

An insertion preventing structure in the present embodiment is formed by paired insertion preventing chips 310 disposed at a lower end of a shaping rod 21 and a spring 311 for biasing and displacing the insertion preventing chips 310 into an insertion preventing attitude. The insertion preventing chips 310 are supported by a pin 312 to be able to swing and can swing between the insertion preventing attitude in which the paired insertion preventing chips 310 open into an inverted V shape and an insertion allowing attitude in which the paired insertion preventing chips 310 overlap each other in a thickness direction. As shown in FIG. 51, when an opening dimension of an inlet/outlet 4 of a container 1 is F1, an opening dimension of an inlet/outlet 313 of an application rod 11 of an application body 2 is F2, and a span dimension when the insertion preventing chips 310 are displaced into the insertion preventing attitude is E, the insertion preventing chips 310 is formed to satisfy an expression ($F1<E<F2$). If the span dimension E of the insertion preventing chips 310 is set to be larger than the opening dimension F1 of the inlet/outlet 4 in this manner, the insertion preventing chips 310 cannot be inserted into the inlet/outlet 4 of the container 1 even in a state in which the application body 2 is detached from the container 1. Therefore, it is possible to prevent a shaping body 3 from being inserted into the container 1 by mistake. The inlet/outlet 313 of the application rod 11 is formed in a shape tapered downward so as to facilitate insertion of the insertion preventing chips 310. It is also possible to provide only one insertion preventing chip 310. In this case, a central portion of the insertion preventing chip 310 is supported by a pin 312 and the insertion preventing chip 310 is biased by a spring 311 into an insertion preventing attitude in which the insertion preventing chip 310 is orthogonal to a central axis of the shaping rod 21.

Figure 52:
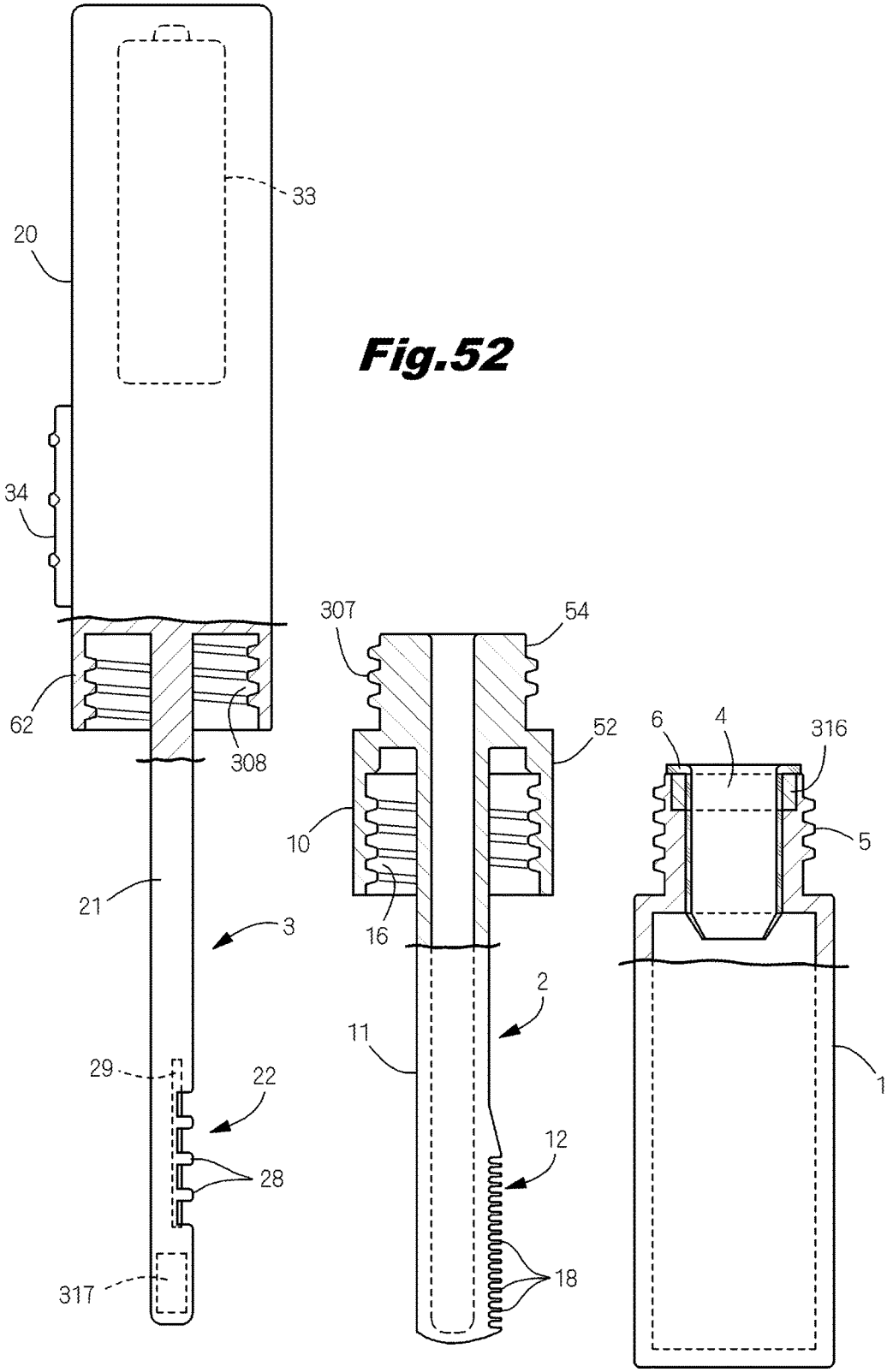
FIG. 52 is a partially cutaway side view showing yet another embodiment of the cosmetic tool according to the third invention group.
Figure 53:
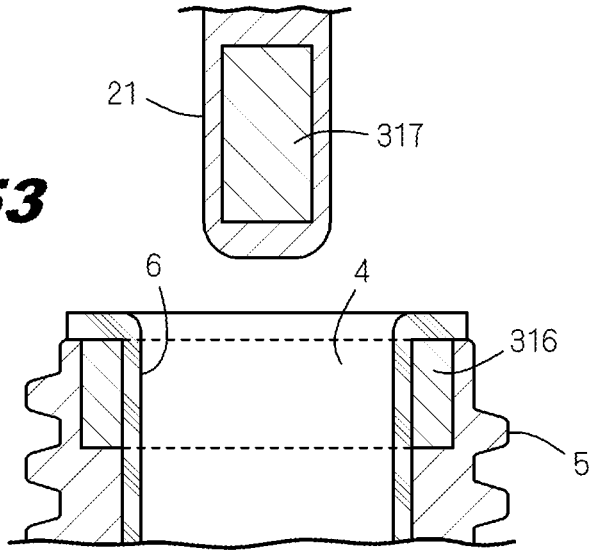
FIG. 53 is a sectional view showing a used state of the cosmetic tool in FIG. 52.

FIGS. 52 and 53 show another embodiment of a cosmetic tool in which the present invention is applied to a mascara applicator. In the embodiment, a second connection structure is formed by a threaded shaft 307 provided to a peripheral face of a connection boss 54 and a threaded hole 308 formed on an inner face of a cylindrical wall 62 as in the cosmetic tool in FIG. 50. Thread diameters of the second connection structure are set to be smaller than thread diameters of a first connection structure. Therefore, if a turning force in a loosening direction acts on a shaping grip 20, the second connection structure is disconnected prior to the first connection structure.

The insertion preventing structure in the embodiment is formed by a ring-shaped first magnet 316 disposed on an inner peripheral face of an inlet/outlet 4 of a container 1 and a second magnet 317 in a shape of a round stick and disposed at a lower end portion of a shaping rod 21. The first magnet 316 and the second magnet 317 are formed by neodymium magnets, samarium-cobalt magnets, or the like and magnetic poles of the first magnet 316 and the second magnet 317 are set to have polarities repelling each other. For example, if the polarity of the magnetic pole of a lower face side of the first magnet 316 is the N pole, the polarity of the magnetic pole of an upper face side of the second magnet 317 is the N pole so that, when a lower portion of a shaping rod 21 comes close to an opening of the inlet/outlet 4, both the magnets 316 and 317 repel each other to prevent an inserting operation of the shaping rod 21.

Figure 54:
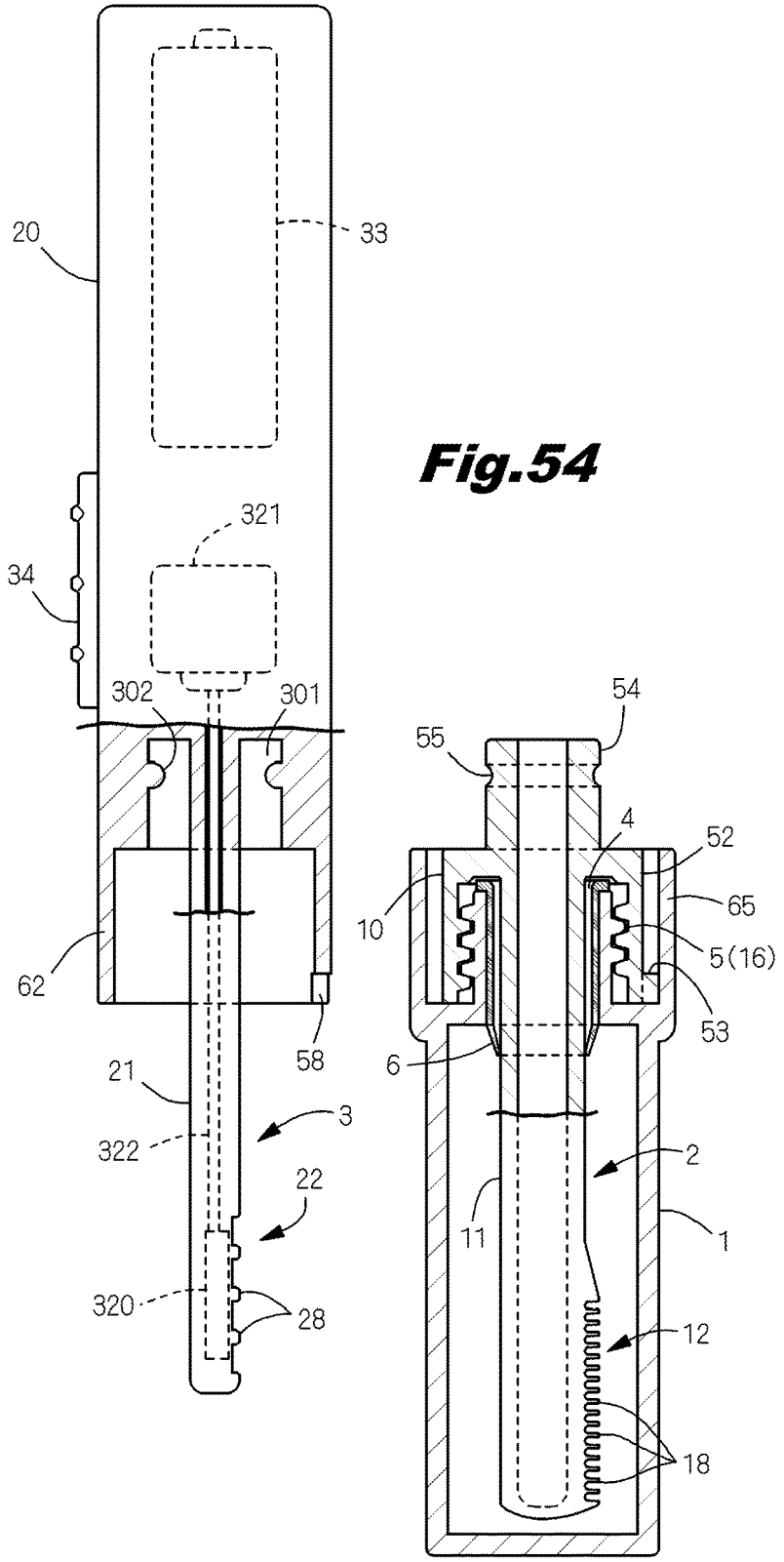
FIG. 54 is a partially cutaway side view showing yet another embodiment of the cosmetic tool according to the third invention group.

FIG. 54 shows another embodiment of a cosmetic tool in which the present invention is applied to a mascara applicator. In the embodiment, while a second connection structure is formed as in a cosmetic tool in FIG. 47, an inner shield wall 62 similar to that in the cosmetic tool in FIG. 48 is formed at a lower portion of a shaping grip 20 and an outer shield wall 65 is formed at a periphery of an inlet/outlet 4 of a container 1 to form an insertion preventing structure. An eccentric weight 320 is provided inside a treatment portion 22 instead of a heater 29 and can be driven to rotate by a motor 321 provided inside a shaping grip 20 via a flexible wire 322. By driving the eccentric weight 320 for rotation in the treatment portion 22, it is possible to vibrate the treatment portion 22 and a treatment rod 21. In this way, it is possible to increase a chance of contact between mascara liquid applied to eyelashes and the eyelashes to cause the mascara liquid to uniformly adhere to the eyelashes.

In the above-described embodiment, the heater 29 does not necessarily have to be a sheet heater but may be formed by using a nichrome wire as a heater element. Besides comb teeth, application elements 18 may be bristle bunches. Besides the first and second ON states, a heat generating state of the heater 29 may be suitably set to an intermediate temperature state between the first and second ON states and a higher temperature state than the second ON state. The cosmetic tool according to the present invention may be formed by an application body 2 and a shaping body 3 without the container 1. In this case, an outer face of the application body 2 is preferably covered with a protective cap.

(Embodiments of Cosmetic Tool According to Fourth Invention Group)

Cosmetic tools according to the embodiments are basically the same as the embodiments of the cosmetic tools according to the first to third invention groups.

In FIG. 2, the mascara applicator is formed by a container 1 for housing mascara liquid, an application body 2 to be attached to and detached from the container 1, a shaping body (heating body) 3 to be attached to and detached from the application body 2, and the like. The container 1 and the application body 2 are detachably connected by a first connection structure (connection structure) and the application body 2 and the shaping body 3 are detachably connected by a second connection structure (connection structure). When the three members, i.e., the container 1, the application body 2, and the shaping body 3 are connected by both the first and second connection structures, the mascara applicator can be treated as a single cosmetic tool.

Figure 55:
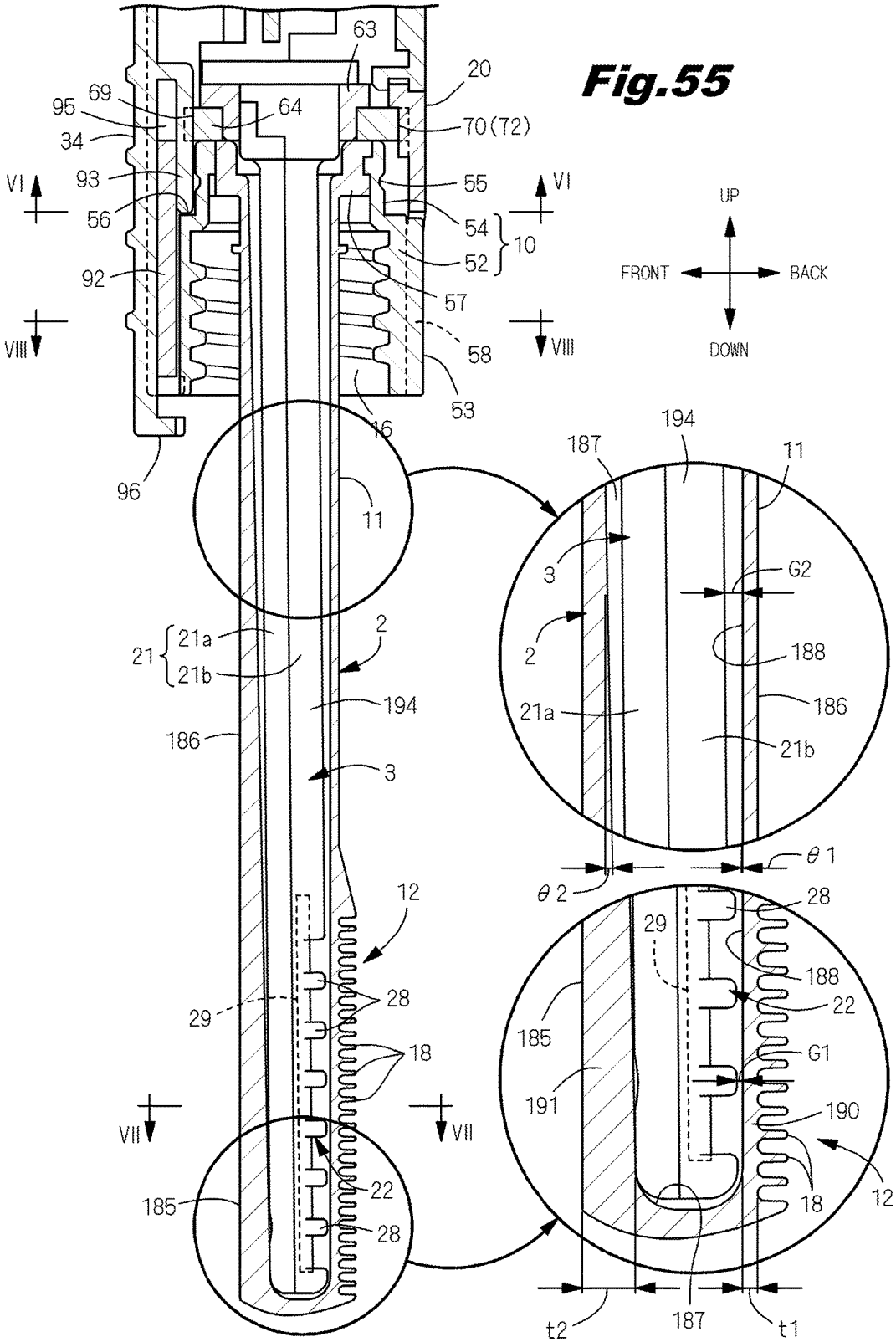
FIG. 55 is a vertical sectional side view of an application body in a used state of a cosmetic tool according to a fourth invention group.
Figure 56:
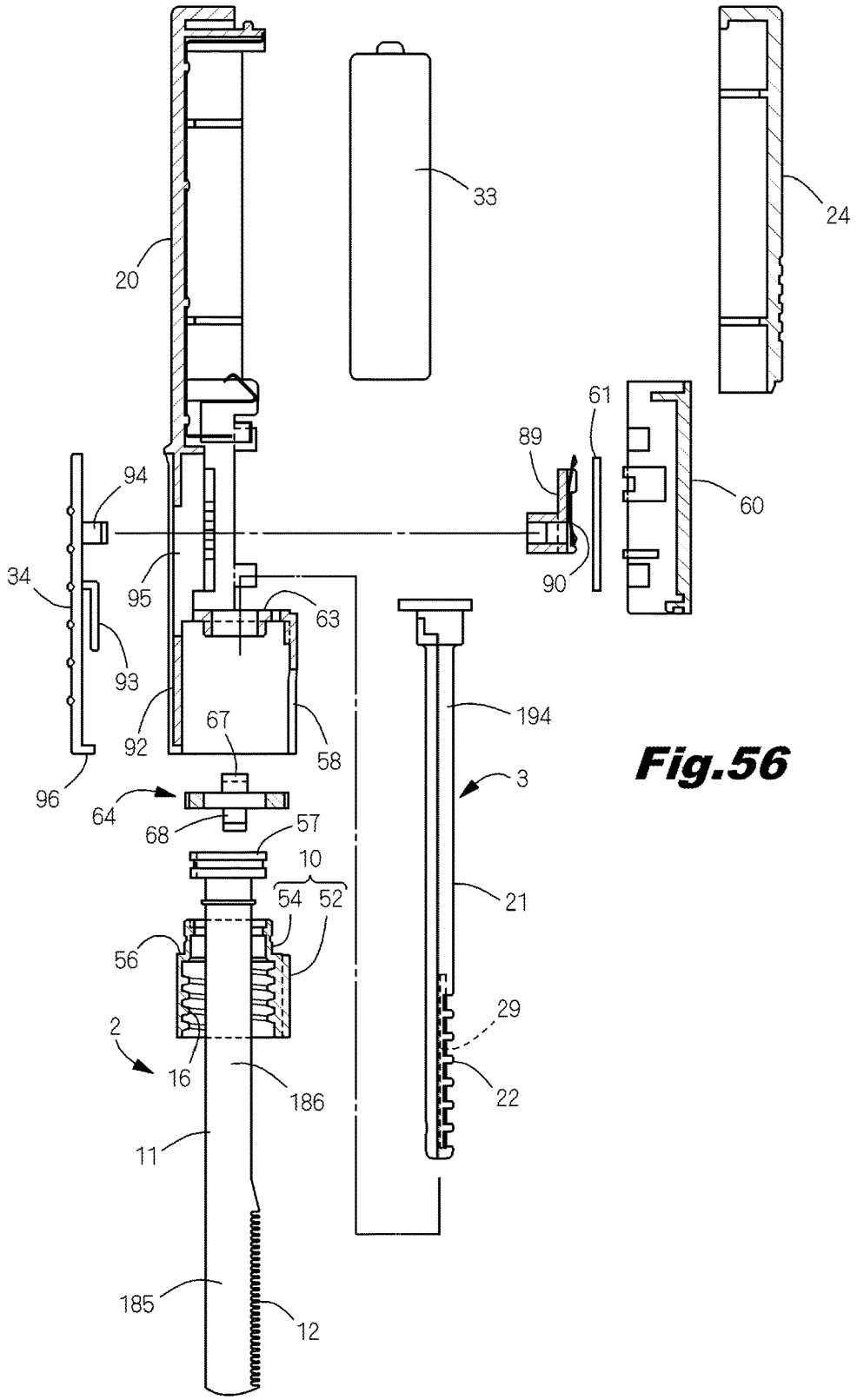
FIG. 56 is an exploded sectional view of the cosmetic tool in FIG. 55.
Figure 58:
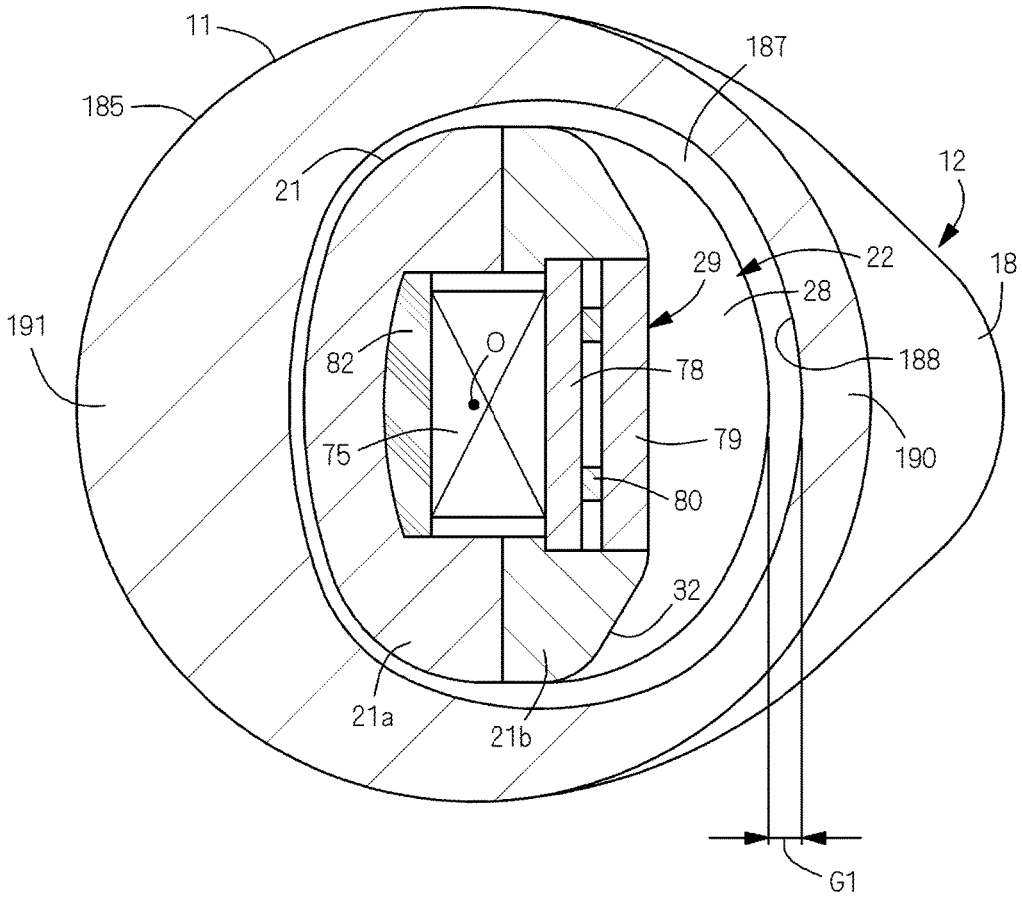
FIG. 58 is a sectional view taken along line VII-VII in FIG. 55.

In FIG. 55, the application body 2 includes a circular cylindrical cap 10 to be attached to and detached from an inlet/outlet 4 of the container 1 and a cylindrical application rod 11 in which a housing hole 187 is formed along a central axis. The application rod 11 is formed into a cylindrical shape having a bottom and is formed by a treatment portion 185 provided to a lower end portion (end portion) of the application rod 11 and a stem portion 186 continuous with an upper side of the treatment portion 185 and an application portion 12 for holding the mascara liquid is provided to the treatment portion 185. The treatment portion 185 includes an application portion side cylindrical wall 190 on which the application portion 12 is formed and an opposed cylindrical wall 191 facing the application portion side cylindrical wall 190. An inner face 188 of the housing hole 187 in the application rod 11 is formed by forming the application portion side cylindrical wall 190 and the opposed cylindrical wall 191 into a shape tapered from an upper end portion side (base end side) toward a lower end portion side (end portion side). In FIG. 58, reference sign O designates the central axis of the application rod 11 formed into a round cylindrical shape. In a state in which the container 1 and the application body 2 are connected by the first connection structure, the application rod 11 can be inserted into the container 1.

An inclination angle of the inner face 188 of the housing hole 187 formed into the shape tapered from the upper end portion side toward the lower end portion side is not constant through the entire circumference. As shown in FIG. 55, an inclination angle θ1 of the inner face 188 at the application portion side cylindrical wall 190 is the smallest and an inclination angle θ2 of the inner face 188 at the opposed cylindrical wall 191 is the largest. Right and left cylindrical wall portions of the treatment portion 185 are formed so that the inclination angle gradually increases from the application portion side cylindrical wall 190 toward the opposed cylindrical wall 191 so as to gently connect the inclination angles θ1 and θ2 of the opposite cylindrical walls 190 and 191. A lower end side of a central axis of the housing hole 187 is inclined backward with respect to the central axis O of the application rod 11, because the inclination angles θ1 and θ2 are different angles.

According to the above-described structure, a sectional area of a face orthogonal to the central axis O of the application rod 11 increases toward the lower end portion of the application rod 11. Therefore, a volume per unit length is larger at the treatment portion 185 than at the stem portion 186 so that the treatment portion 185 heated by a heating shaping portion (heating portion) 22 is less liable to become cold, which suppresses power consumption of a heater 29. In the embodiment, the inclination angle θ1 on the back side of the inner face 188 of the housing hole 187 is set to 0.1° and the inclination angle θ2 on the front side is set to 1.0°. The angles are preferably set to 0 to 3.0°. This is because it is difficult to mold the shaping rod 21 in the shape of the cylinder having the bottom by using a metal mold when the inner face 188 is tapered upward with the angles smaller than 0° and because a difference in wall thickness between upper and lower portions of the cylindrical wall becomes large to cause molding defects such as a sink mark when the angles exceed 3.0°. The inclination angles θ1 and θ2 may be changed suitably depending on a length or an outer diameter of the application rod 11.

As shown in FIG. 55, the application portion 12 is formed by a group of comb teeth (application elements) 18 formed on the application portion side cylindrical wall 190 of the treatment portion 185 of the application rod 11 and can hold the mascara liquid between the adjacent comb teeth 18. As shown in FIG. 58, each of the comb teeth 18 is formed into a shape of a tongue chip with a rounded tip end. A thickness t1 of the application portion side cylindrical wall 190 on which the comb teeth 18 are formed is smaller than a thickness t2 of the opposed cylindrical wall 191 (see FIG. 55). Therefore, it is possible to quickly transfer heat generated by the heating portion 22 to a surface of the application portion side cylindrical wall 190 due to the smaller thickness of the cylindrical wall to thereby swiftly heat the application portion 12. Moreover, the volume of the application portion side cylindrical wall 190 having the smaller thickness is smaller than the volume of the opposed cylindrical wall 191 and therefore a heat capacity of the application portion side cylindrical wall 190 is small and, as a result, it is possible to further swiftly heat the application portion 12.

The cap 10 is provided with a connection portion forming the first connection structure and a connection portion forming the second connection structure. The former connection portion is formed by a threaded cap 52 occupying a most part of the cap 10 and a threaded hole 16 corresponding to the above-described threaded shaft 5 is formed on an inner face of the threaded cap 52. On an outer face of the cap 10, a positioning rib 53 which is long in a vertical direction is formed. As described above, the first connection structure is formed as a thread structure by the threaded shaft 5 and the threaded cap 52 having the threaded hole 16.

The connection portion forming the second connection structure is formed by a connection groove 55 formed in an annular shape in a peripheral face of a connection boss 54 continuous with an upper portion of the threaded cap 52. An outer diameter of the connection boss 54 is set to be smaller than an outer diameter of the threaded cap 52 and a shoulder wall between abase end of the connection boss 54 and the threaded cap 52 functions as a restricting portion 56 of a stopper 93 (described later). By fitting and engaging a rod boss 57 provided to an upper end of the above-described application rod 11 with an inner face of the connection boss 54 with pressure, the application rod 11 is integrated with the cap 10 so as not to be detachable.

The shaping body 3 is formed by a circular cylindrical shaping grip (grip) 20 serving also as a grip, a hollow shaping rod (heating rod) 21 protruding downward from a lower portion of the shaping grip 20, a heating shaping portion (heating portion) 22 provided to a lower end (end portion) of the shaping rod 21, a heater 29 disposed inside the heating shaping portion 22, and the like.

Figure 57:
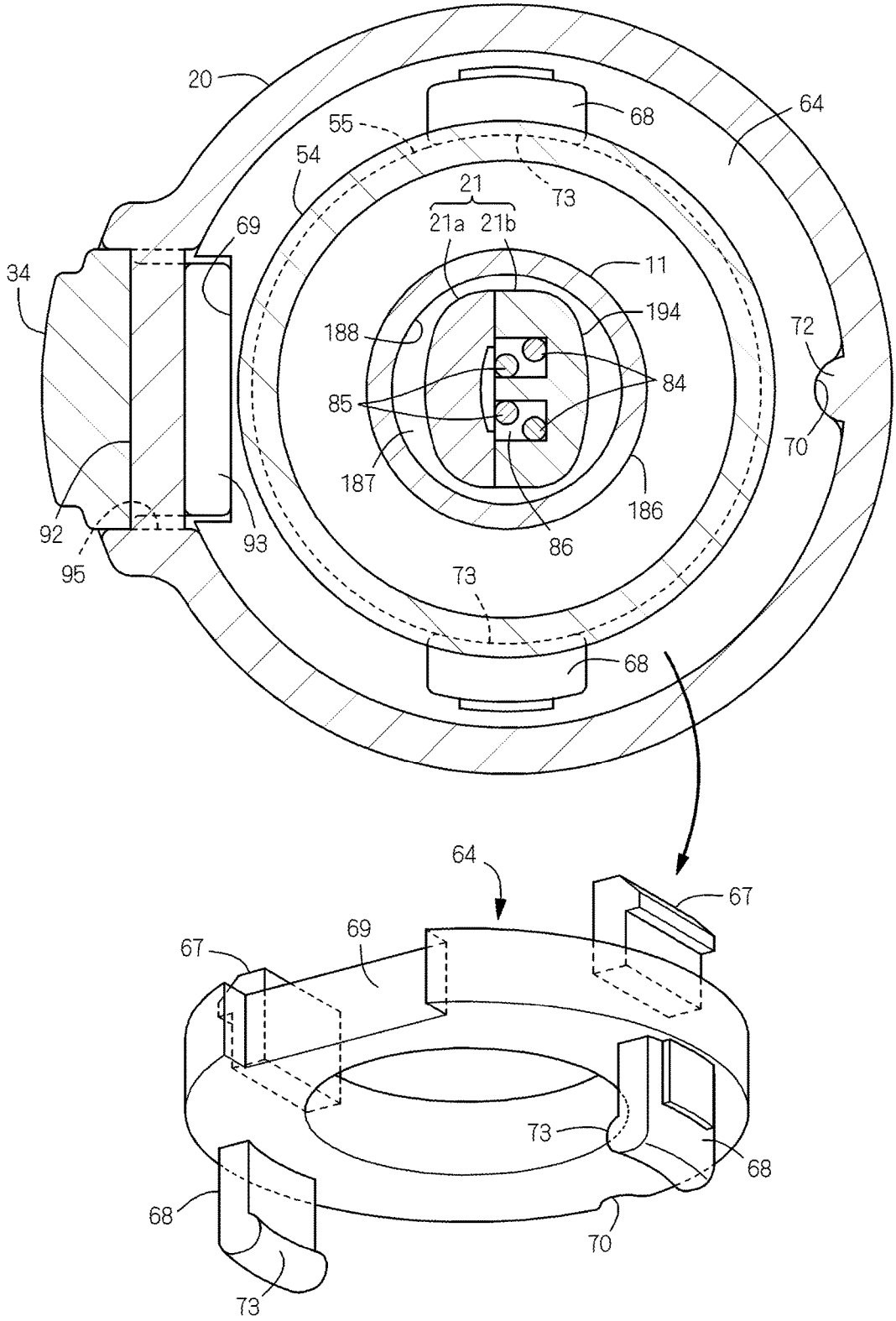
FIG. 57 is a sectional view taken along line VI-VI in FIG. 55.

In FIG. 55, inside the shaping grip 20, a ring-shaped mounting boss 63 is integrally formed with a lower end of an area of the shaping grip 20 housing a control board 61 and an upper portion of the shaping rod 21 is attached to the mounting boss 63 by fitting with pressure. A connection ring 64 for making the connection boss 54 of the cap 10 detachable is fixed to the mounting boss 63. As shown in FIG. 57, from right and left opposed positions of an upper face and a lower face of the connection ring 64, paired engagement lugs 67 and paired elastic connection arms 68 protrude. Moreover, at front and back opposed positions of a peripheral face of the connection ring 64, a guide recessed portion 69 for guiding sliding of the stopper 93 (described later) and a positioning recessed portion 70 are formed.

As shown in FIG. 5, by engaging the paired engagement lugs 67 in engagement grooves 71 formed in the above-described mounting boss 63 from a lower face side, the connection ring 64 is fixed to the mounting boss 63 so as not to be detachable. At this time, the positioning recessed portion 70 is positioned by a positioning protrusion 72 provided to an inner face of the shaping grip 20 (see FIG. 57). A connection lug 73 having a semicircular section is provided to an inner face of a lower end of each of the elastic connection arms 68. By engaging and disengaging the connection lugs 73 in and from the connection groove 55 in the connection boss 54, the application body 2 and the shaping body 3 can be integrated with each other or the shaping body 3 can be detached from the application body 2. In this manner, the second connection structure is formed as a pressure fitting engagement structure by the connection groove 55 formed in the connection boss 54 and the elastic connection arms 68 having the connection lugs 73 to be engaged in and disengaged from the groove 55.

As described above, the first connection structure is formed as the thread structure by the threaded shaft 5 and the threaded cap 52 having the threaded hole 16 and the second connection structure is formed as the pressure fitting engagement structure by the connection groove 55 formed in the connection boss 54 and the elastic connection arms 68 having the connection lugs 73 to be engaged in and disengaged from the groove 55. In this manner, by only disconnecting the thread structure to detach the container 1 and pulling the application body 2 off the shaping body 3, it is possible to detach the application body 2. Therefore, if the application body 2 gets broken, it can be easily replaced. If stains are stuck to the application body 2, the application body 2 can be easily washed with hot water and the like and can be used again.

As shown in FIG. 58, the shaping rod 21 is formed by joining a front rod body 21*a* and a back rod body 21*b* to each other in a lid-fitting manner. The shaping rod 21 is formed by the heating shaping portion (heating portion) 22 formed at the lower end portion (end portion) of the shaping rod 21 and a stem portion 194 continuous with an upper side of the heating shaping portion 22. A large number of comb teeth 28 disposed at constant intervals in the vertical direction are formed on the back rod body 21*b* of the heating shaping portion 22 and the heater 29, a thermistor 75, and a thermochromic element 76 are disposed inside the heating shaping portion 22. Heating windows 77 are open between the comb teeth 28 and an outer surface of the heater 29 is exposed through the respective heating windows 77 to serve as a curling face 32. A heater element 80 (described later) of the heater 29 is positioned on a front side of a center in a front-back direction of the heating shaping portion 22. Each of the comb teeth 28 is formed into a petal shape having a front-back dimension sufficiently greater than its protruding dimension.

Figure 59:
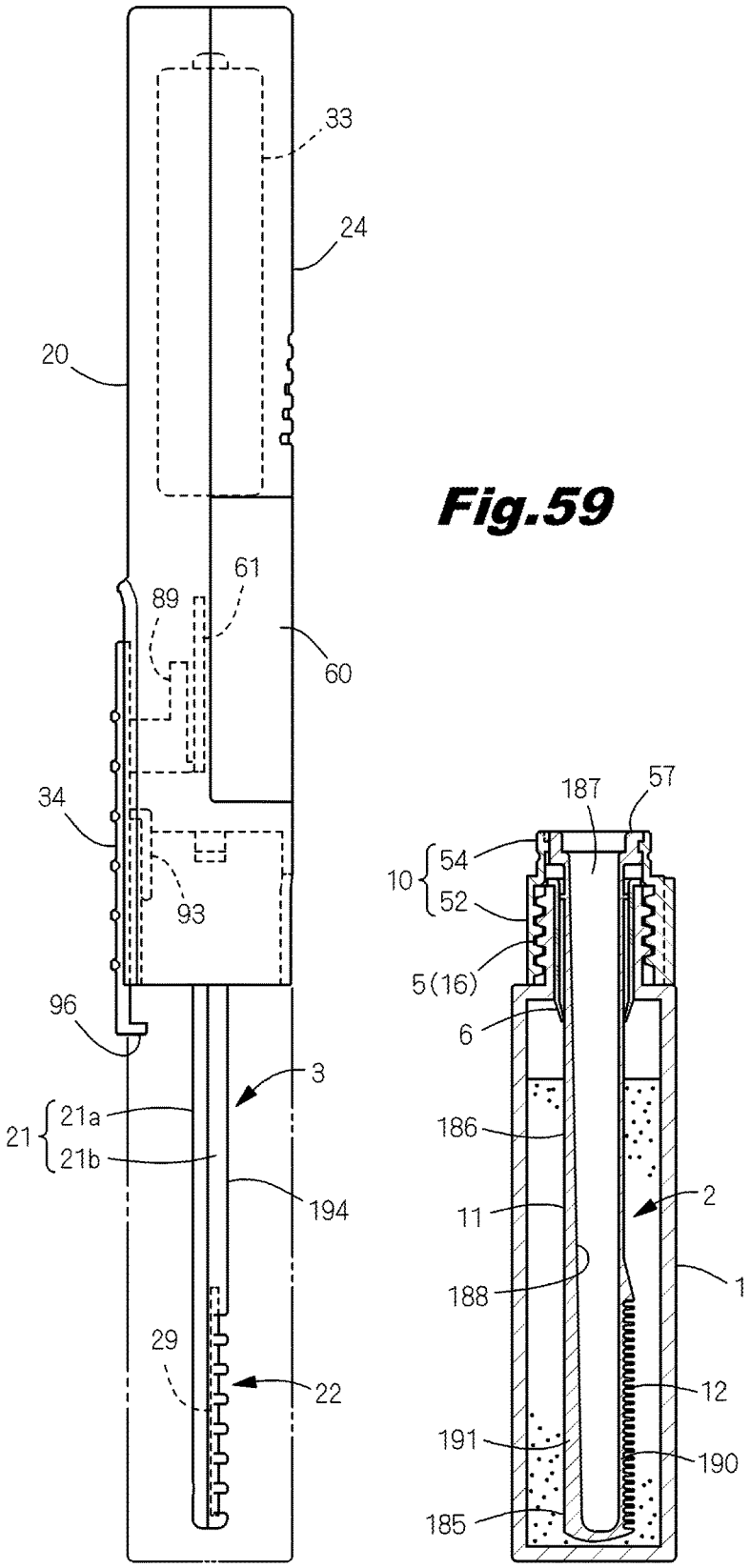
FIG. 59 is a partially cutaway side view showing a state in which a shaping body is detached from the application body.
Figure 60:
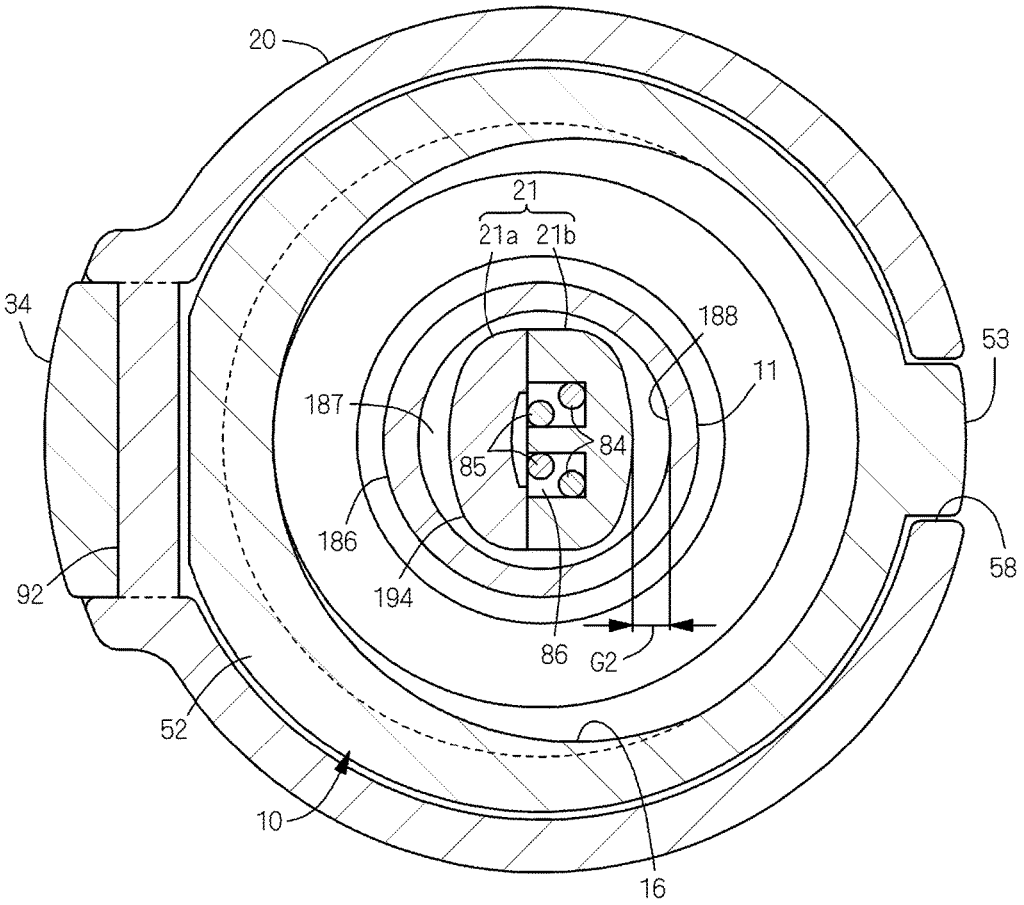
FIG. 60 is a sectional view taken along line VIII-VIII in FIG. 55.

As shown in FIG. 55, in a state in which the shaping rod 21 is housed in the housing hole 187 and the shaping body 3 is attached to the application body 2, the heating shaping portion 22 is disposed inside the treatment portion 185 of the application rod 11. Because the lower end side of the central axis of the housing hole 187 is inclined backward with respect to the central axis O of the application rod 11, when the shaping rod 21 is housed in the housing hole 187, a front side of a lower end portion of the shaping rod 21 comes in contact with the inner face 188 of the opposed cylindrical wall 191 and the shaping rod 21 is housed while bent backward (see FIG. 55). In this state, a lower end side of the shaping rod 21 is displaced backward and therefore a gap G1 (see FIG. 58) between the application portion side cylindrical wall 190 and the heating shaping portion 22 can be smaller than a gap G2 (see FIG. 60) between the stem portion 194 of the heating rod 21 and the inner face 188 of the stem portion 186 of the application rod 11. FIG. 59 shows a state in which the shaping body 3 is detached from the application body 2.

With the above-described structure, a periphery of the heating shaping portion 22 is covered with the treatment portion 185 and the heating shaping portion 22 can efficiently transfer the heat generated by the heating portion 22 to the treatment portion 185 to thereby swiftly heat the application portion 12. Therefore, it is possible to quickly heat cosmetic material held by the application portion 12 to heat it to a temperature suitable for application to thereby shorten a waiting time. By setting the gap G1 to a smaller dimension than the gap G2, it is possible to make transfer of the heat from the stem portion 194 of the heating rod 21 to the stem portion 186 of the application rod 11 smaller than that from the heating portion 22 to the treatment portion 185 by utilizing heat insulating effect of an air space between the respective stem portions 186 and 194. Therefore, it is possible to improve heat transfer efficiency from the heating portion 22 to the treatment portion 185 to thereby swiftly heat the application portion 12.

In addition, if the shaping rod 21 is housed while bent backward and the lower end side of the shaping rod 21 is displaced backward, the heater 29 can be disposed while displaced toward the application portion side cylindrical wall 190 with respect to the central axis O of the application rod 11. Therefore, the heater 29 can be brought close to the inner face 188 of the inner face 188 to efficiently transfer the heat to the inner face 188 to thereby swiftly heat the application portion 12.

Because the other structures of the mascara applicator and modes of use of the mascara applicator are the same as those of the mascara applicators according to the above-described invention groups, description thereof will be omitted.

In the above-described embodiment, the shaping rod 21 need not be housed in the housing hole 187 in the bent state but may be housed without being in contact with the inner face of the housing hole 187. In this case, by disposing the heater 29 in the vicinity of a back face of the heating shaping portion 22 and bringing the heater 29 close to the inner face 188, it is possible to satisfy the above-described dimensional relationship. The sectional shape orthogonal to the central axis O of the application rod 11 may be an oval or a polygon. It is unnecessary to connect the three members, i.e., the container 1, the application body 2, and the shaping body 3 to treat the mascara applicator as a single cosmetic tool. For example, a protective cap instead of the container 1 may be connected to protect the application rod 11 in a usual state and the application rod 11 may be inserted into a separate container 1 housing the mascara liquid and the mascara liquid may be applied to eyebrows in a used state.

Figure 61:
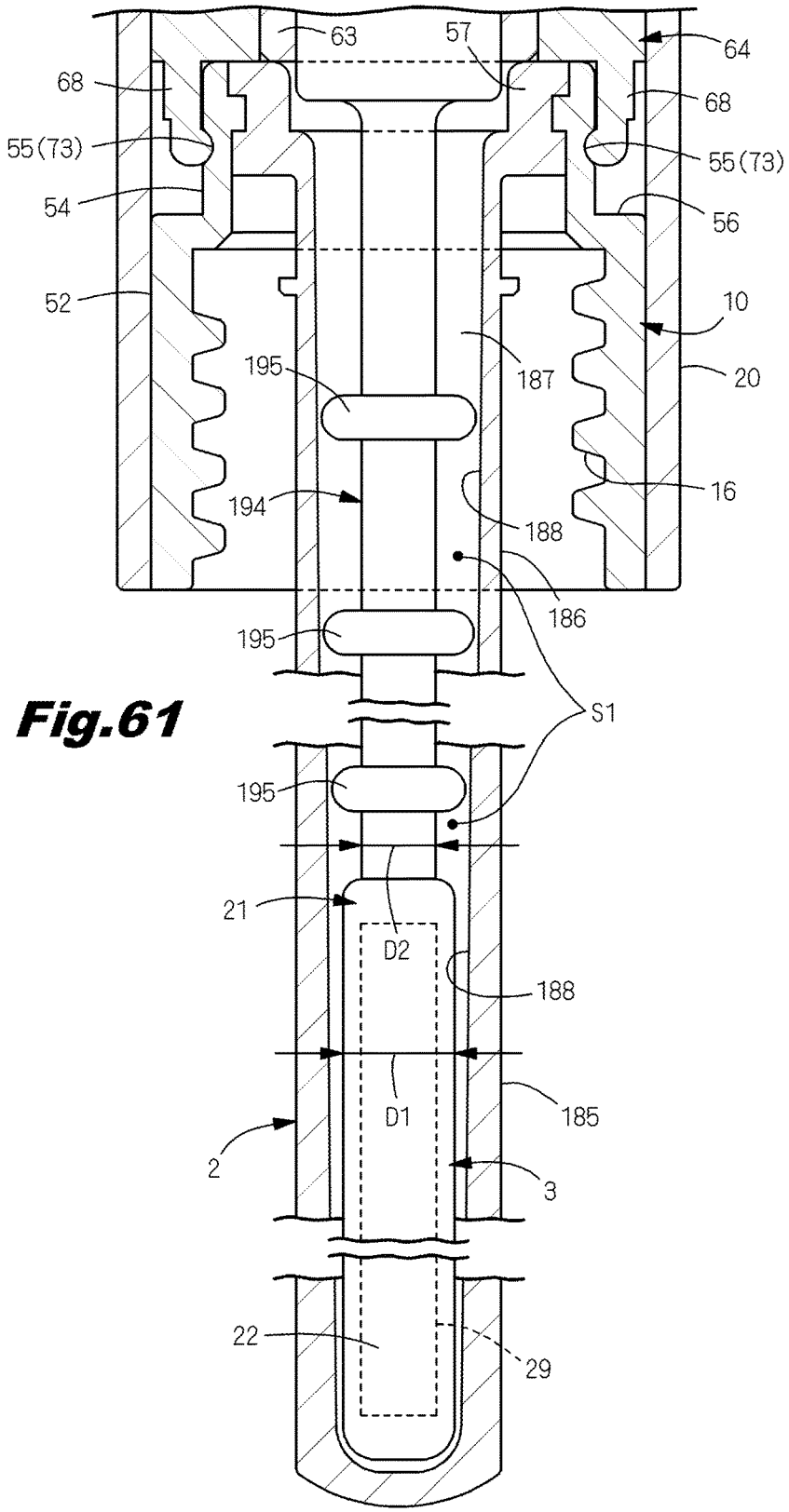
FIG. 61 is a partially cutaway front view showing another embodiment of the cosmetic tool according to the fourth invention group.
Figure 62:
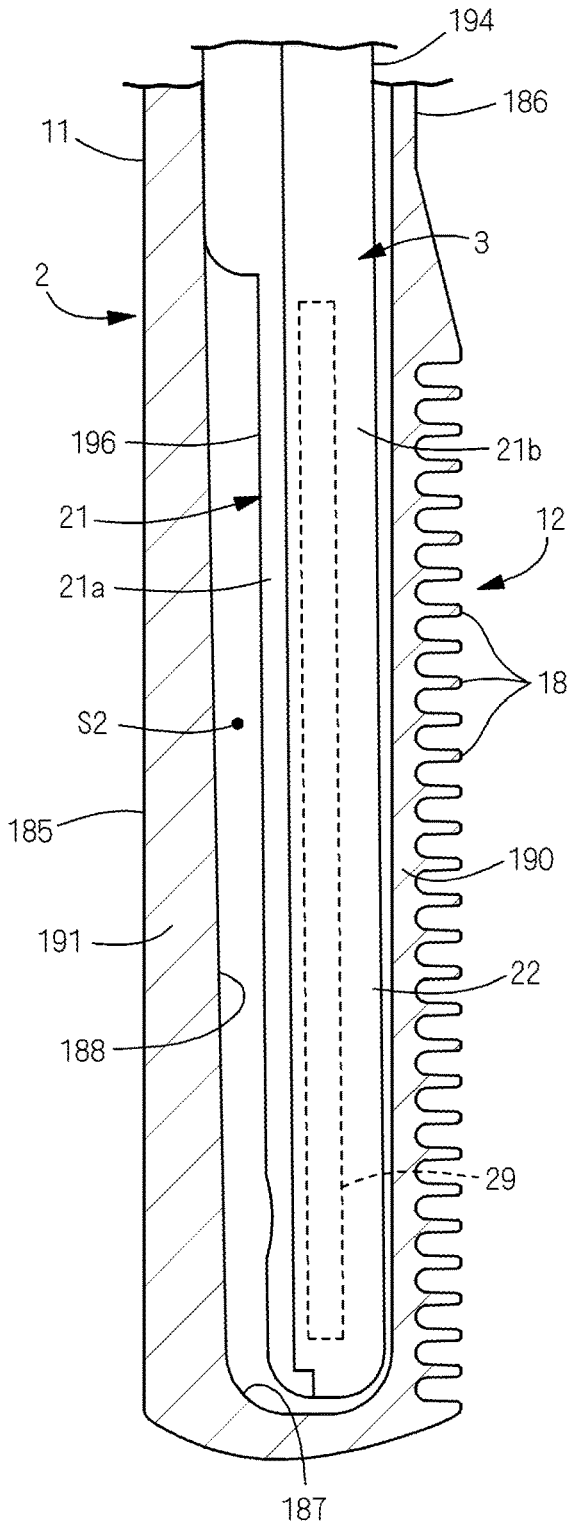
FIG. 62 is a partially cutaway side view showing yet another embodiment of the cosmetic tool according to the fourth invention group.
Figure 63:
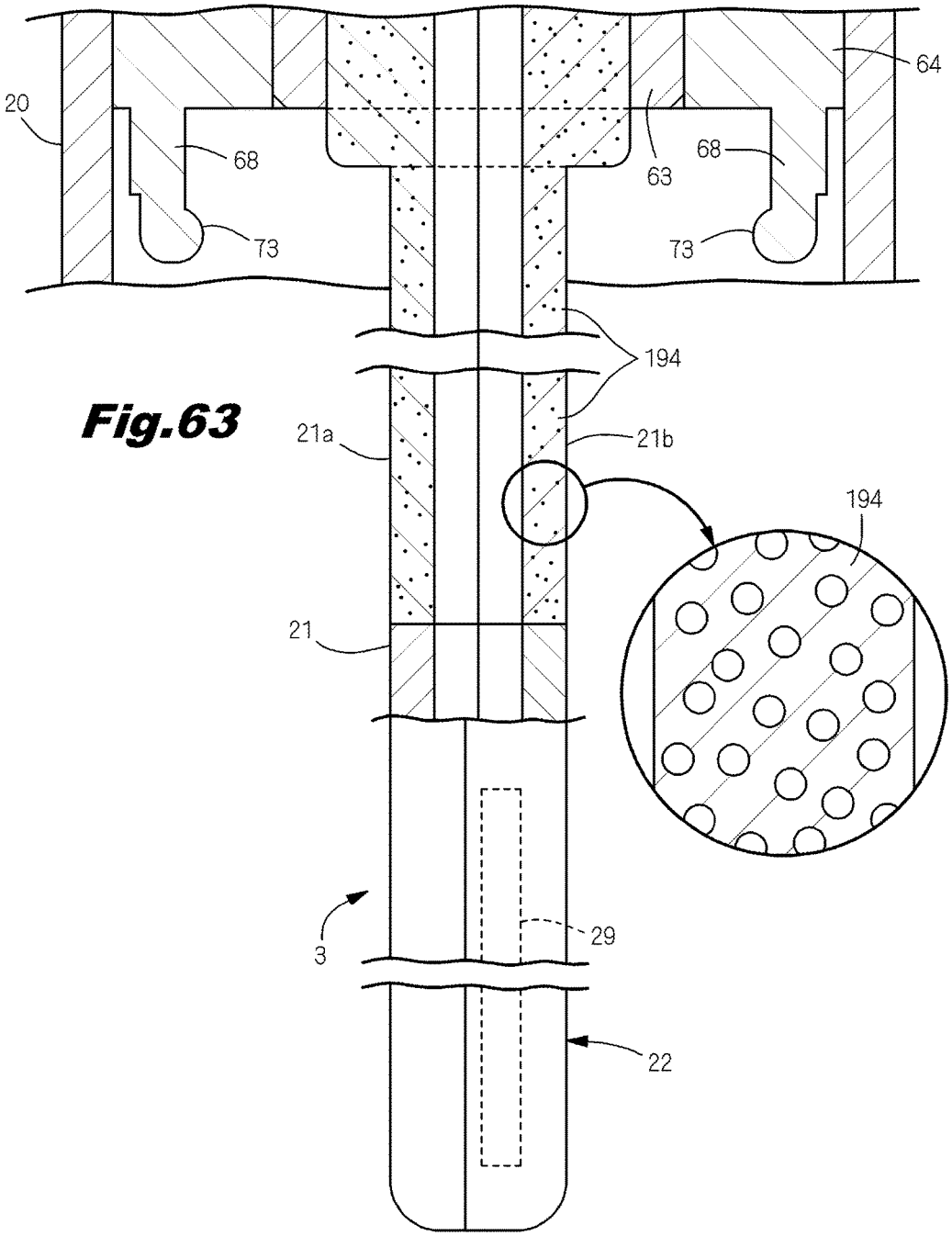
FIG. 63 is a partially cutaway front view showing yet another embodiment of the cosmetic tool according to the fourth invention group.

FIGS. 61 to 63 show other embodiments of the cosmetic tool according to the fourth invention group. In the following description, portions different from those in the above-described embodiment will be mainly described and the same members as those in the above-described embodiment will be provided with the same reference signs and will not be described.

FIG. 61 shows another embodiment of the heating rod 21, in which comb teeth 28 are omitted and a heater 29 is sealed in a lower end portion of the shaping rod 21 to form a heating head (heating portion) 22. An outer diameter D2 of a stem portion 194 is smaller than an outer diameter D1 of the heating head 22 and a heat insulating space S1 is formed between an inner face 114 of a housing hole 187 in an application rod 11 and an outer face of the stem portion 194 of the heating rod 21. A plurality of division walls 195 are formed in a vertical direction of the stem portion 194 of the heating rod 21 and are formed into rib shapes protruding from a periphery of the stem portion 194. The heat insulating space S1 is divided into a plurality of spaces by the division walls 195.

If the outer diameter D2 of the stem portion 194 of the heating rod 21 is set to be smaller than the outer diameter D1 of the heating head 22, it is possible to suppress a heat quantity to be transferred from the heating portion 22 to a grip 20 via the stem portion 194. Therefore, most of heat of the heating head 22 can be transferred to a cylindrical wall of a treatment portion 185 to swiftly heat an application portion 12. Moreover, heat transfer between both the stem portions 186 and 194 is suppressed by the heat insulating space 51, which suppresses power consumption of the heater 29. Furthermore, if the insulating space 51 is divided into the plurality of spaces by the division walls 195, it is possible to suppress movement of heat due to convection of air to suppress heat transfer to the stem portion 186 of the application rod 11 and the grip 20 through the air. The heating head 22 can carry out a curling operation of eyelashes previous to application of mascara liquid to the eyelashes with the heater 29 generating heat and the eyelashes brought in contact with an outer surface of the heating head 22. The present embodiment is the same as the above-described embodiment in other respects.

FIG. 62 shows another embodiment of the heating rod 21, in which comb teeth 28 are omitted and a heater 29 is sealed in a lower end portion of the heating rod 21 to form a heating head (heating portion) 22. A lower step portion 196 is formed on a front rod body 21*a* of the heating rod 21 to form the front rod body 21*a* into a stepped shape so that a heat insulating space S2 is formed between a front face side of a heating shaping portion 22 and an opposed cylindrical wall 191. If the heat insulating space S2 is provided in this manner, it is possible to effectively suppress heat transfer from the heating shaping portion 22 to the opposed cylindrical wall 191 to swiftly heat an application portion 12. The heating head 22 can carry out a curling operation of eyelashes previous to application of mascara liquid to the eyelashes with the heater 29 generating heat and the eyelashes brought in contact with an outer surface of the heating head 22.

FIG. 63 shows another embodiment of the heating rod 21, in which comb teeth 28 are omitted and a heater 29 is sealed in a lower end portion of the heating rod 21 to form a heating head (heating portion) 22 and a stem portion 194 of the heating rod 21 is made of foamable resin. A front rod body 21*a* and a back rod body 21*b* of the shaping rod 21 are formed by plastic molded articles formed by two-color molding and portions corresponding to the stem portion 194 are made of foamable resin. The foamable resin is synthetic resin formed to be porous by finely dispersing bubbles in the synthetic resin. If the stem portion 194 of the heating rod 21 is made of the foamable resin in this manner, it is possible to effectively suppress transfer of heat of the heating head 22 to a shaping grip (grip) 20 via the stem portion 194 of the heating rod 21. Therefore, it is possible to efficiently transfer the heat of the heating head 22 to a treatment portion 185 to swiftly heat an application portion 12. Moreover, there is also an advantage that power consumption of the heater 29 can be suppressed. A portion of the heating rod 21 except the heating head 22 facing an inner face 188 may be made of foamable resin so that heat transfer to portions other than the inner face 188 is suppressed.

(Embodiments of Cosmetic Tool According to Fifth Invention Group)

Figure 64:
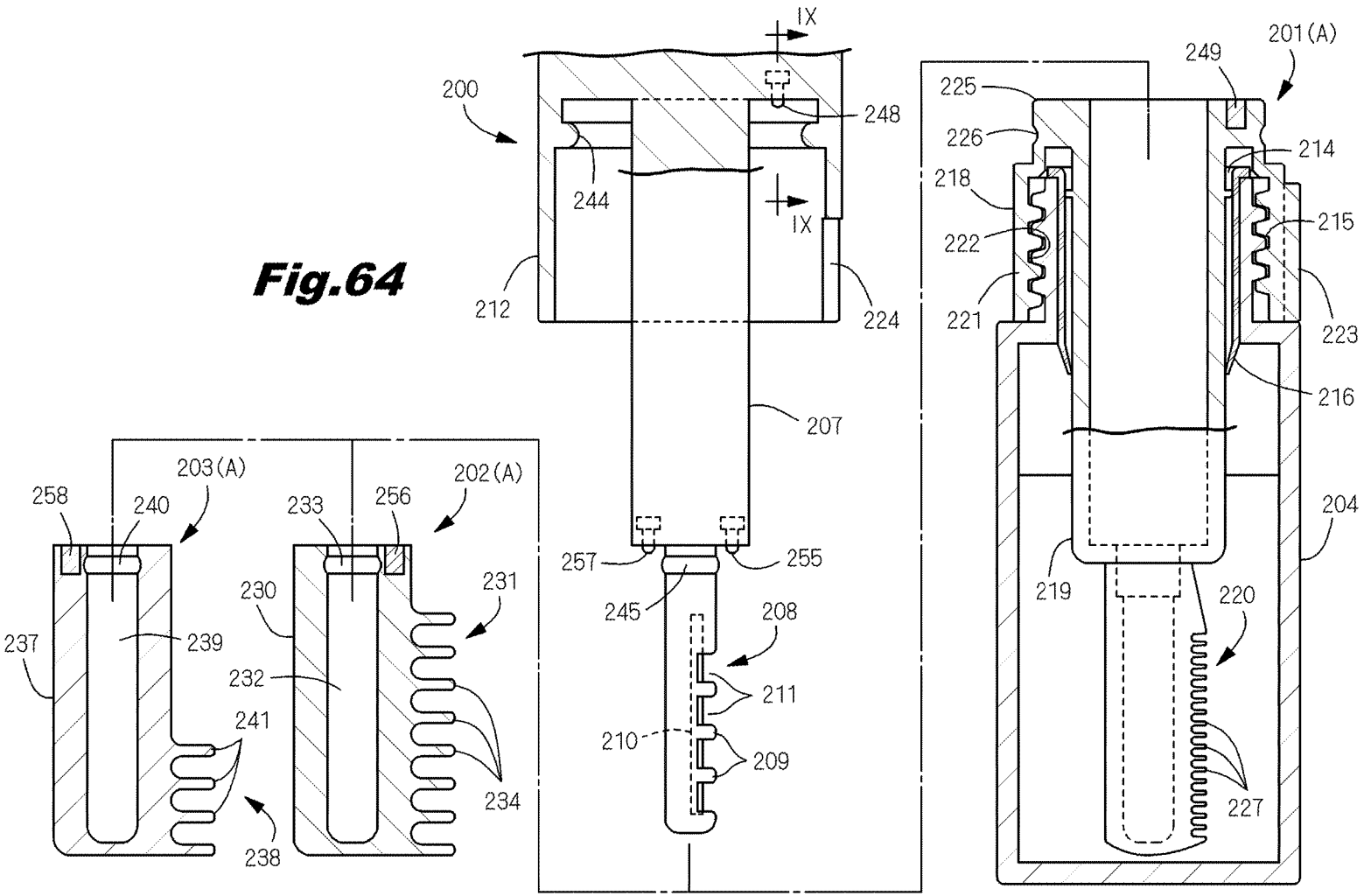
FIG. 64 is an exploded sectional view showing a cosmetic tool according to a fifth invention group.
Figure 65:
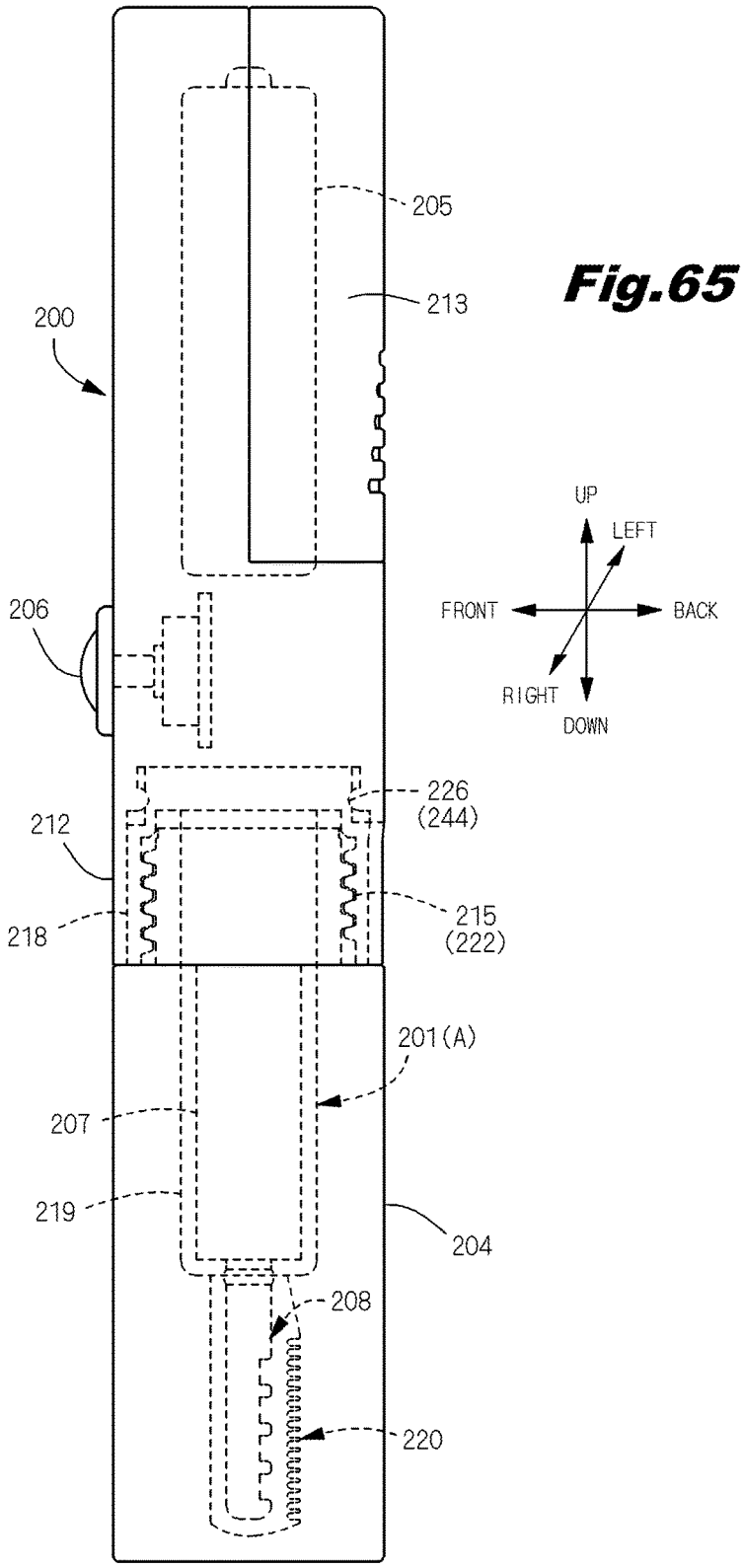
FIG. 65 is a side view of the cosmetic tool in FIG. 64.

FIGS. 64 to 70 show embodiments in which the present invention is applied to a mascara applicator (cosmetic tool). In FIG. 65, a mascara applicator is formed by a main body portion (first member) 200, three kinds of attachments (second members) A to be attached to and detached from the main body portion 200, and a container (third member) 204 for housing mascara liquid. One of the three kinds of attachments A is an applicator (first application body) 201 and the other two are a first eyelash shaping body (eyelash shaping body) 202 and a second eyelash shaping body (eyelash shaping body) 203.

In FIGS. 64 and 65, the main body portion 200 is formed by a round cylindrical case which is long in a vertical direction and a battery 205, a control board (not shown), and the like are disposed inside the main body portion 200. A push-button power switch 206 for switching between ON and OFF states is provided to a front face of the main body portion 200. A heating rod 207 in a shape of a round stick is provided to protrude downward from a lower end of the main body portion 200 and a heating shaping portion (heating portion) 208 having a smaller diameter than the heating rod 207 is provided to a lower end of the heating rod 207. The heating shaping portion 208 is formed by a plurality of comb teeth 209 disposed at constant intervals in the vertical direction and a sheet heater (heater) 210, a thermistor (not shown), and the like are disposed inside the heating shaping portion 208. Heating windows 211 are open between the comb teeth 209 and an outer surface of the sheet heater 210 is exposed through the respective heating windows 211. A periphery of a base end portion of the heating rod 207 is surrounded with a cylindrical wall 212 and a cap 218 (described later) can be mounted by insertion into the cylindrical wall 212. A battery lid 213 provided to an upper portion of the main body portion 200 can be detached and the battery 205 can be replaced.

The container 204 is formed by a circular cylindrical glass formed article and an inlet/outlet 214 for the applicator 201 is open in an upper end of the container 204. A threaded shaft 215 is formed on a peripheral face of the inlet/outlet 4 and a wiper 216 for squeezing the surplus attached mascara liquid is provided on an inner face of the inlet/outlet 214.

The application body 201 is formed by the circular cylindrical cap 218 to be attached to and detached from the inlet/outlet 214 in the container 204, an application rod 219 in a shape of a hollow shaft to be inserted into the container 204, and an application portion 220 provided to a lower end portion of the application rod 219. The cap 218 is provided with a connection portion for the container 204 and a connection portion for the main body portion 200. The connection portion for the container 204 is formed by a threaded cap 221 occupying a most part of the cap 218 and a threaded hole 222 corresponding to the above-described threaded shaft 215 is formed on an inner face of the threaded cap 221.

By screwing the cap 218 over the threaded shaft 215, it is possible to integrate the application body 201 with the container 204 while closing the inlet/outlet 214. On an outer face of the cap 218, a positioning rib 223 which is long in the vertical direction is formed. By engaging the positioning rib 223 in a positioning groove 224 provided to the above-described cylindrical wall 212, the application body 201 can be attached to the main body portion 200 at a constant position. The connection portion for the main body portion 200 is formed by a connection groove 226 formed in an annular shape in a peripheral face of a connection boss 225 continuous with an upper portion of the threaded cap 221. An upper end of the above-described application rod 219 is integrated with the connection boss 225.

As shown in FIG. 64, the application portion 220 is formed by a group of comb teeth 227 formed on a periphery of the application portion 220 and can hold the mascara liquid between the adjacent comb teeth 227. A pitch of the adjacent comb teeth 227 is set to be smaller than pitches of adjacent comb teeth 234 and 241 of the first eyelash shaping body 202 and the second eyelash shaping body 203 (described later).

The first eyelash shaping body 202 is provided mainly for shaping of upper eyelashes and includes a comb frame 230 in a cylindrical shape having a bottom and a shaping comb portion 231 provided on one side of an outer face of the comb frame 230. An attachment hole 232 into which the entire heating shaping portion 208 can be inserted is formed inside the comb frame 230 and a connection groove 233 is formed in an annular recessed shape near an upper opening of the attachment hole 232. The shaping comb portion 231 is formed by eight comb teeth 234.

The second eyelash shaping body 203 is provided mainly for shaping of lower eyelashes and includes a comb frame 237 in a cylindrical shape having a bottom and a shaping comb portion 238 provided on one side of an outer face of the comb frame 237. An attachment hole 239 into which the entire heating shaping portion 208 can be inserted is formed inside the comb frame 237 and a connection groove 240 is formed in an annular recessed shape near an upper opening of the attachment hole 239. The shaping comb portion 238 is formed by four comb teeth 241.

The application body 201 is detachably attached to the main body portion 200 by a first connection structure. The first connection structure is formed as a pressure fitting engagement structure by the connection groove 226 formed in the connection boss 225 of the cap 218 and a connection rib 244 formed in an annular shape on an inner face of the cylindrical wall 212 of the main body portion 200 and can be connected and disconnected by inserting and pulling the application body 201 into and out of the cylindrical wall 212. Similarly, each of the first and second eyelash shaping bodies 202 and 203 is detachably attached to the heating shaping portion 208 by a second connection structure. Each of the second connection structures is formed as a pressure fitting engagement structure by the connection groove 233 or 240 formed on the eyelash shaping body 202 or 203 and a connection rib 245 formed in an annular shape at a position near an upper end of the heating shaping portion 208 and can be connected and disconnected by putting and pulling the eyelash shaping body 202 or 203 on and off the heating shaping portion 208.

Figure 66:
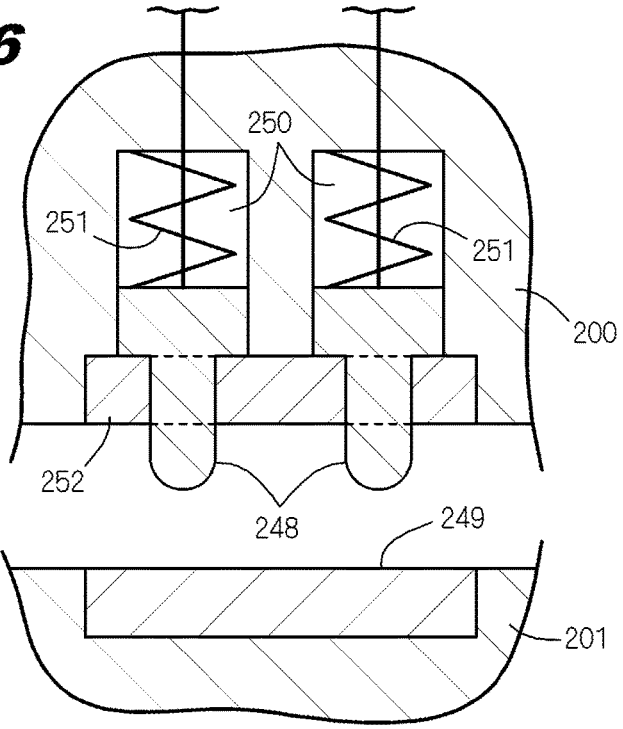
FIG. 66 is a sectional view taken along line IX-IX in FIG. 64 and showing a sensor structure.
Figure 67:
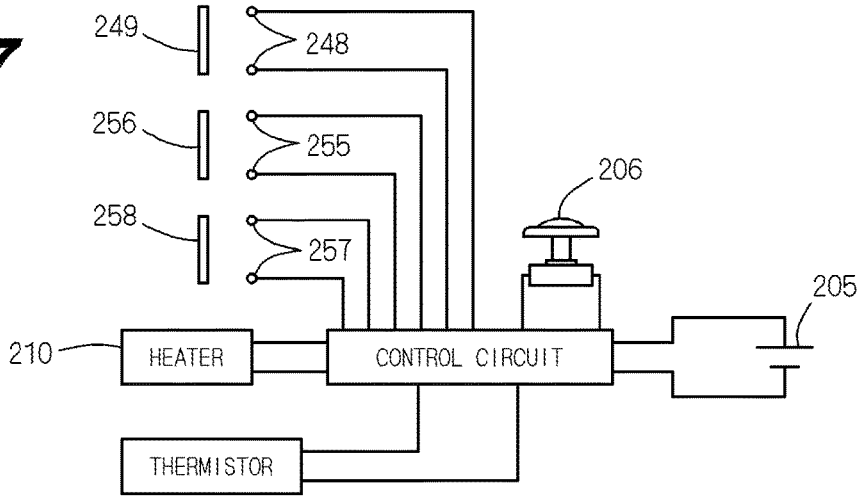
FIG. 67 is a block diagram showing a relationship between the sensor structure and a control circuit of the cosmetic tool in FIG. 64.
Figure 68A:
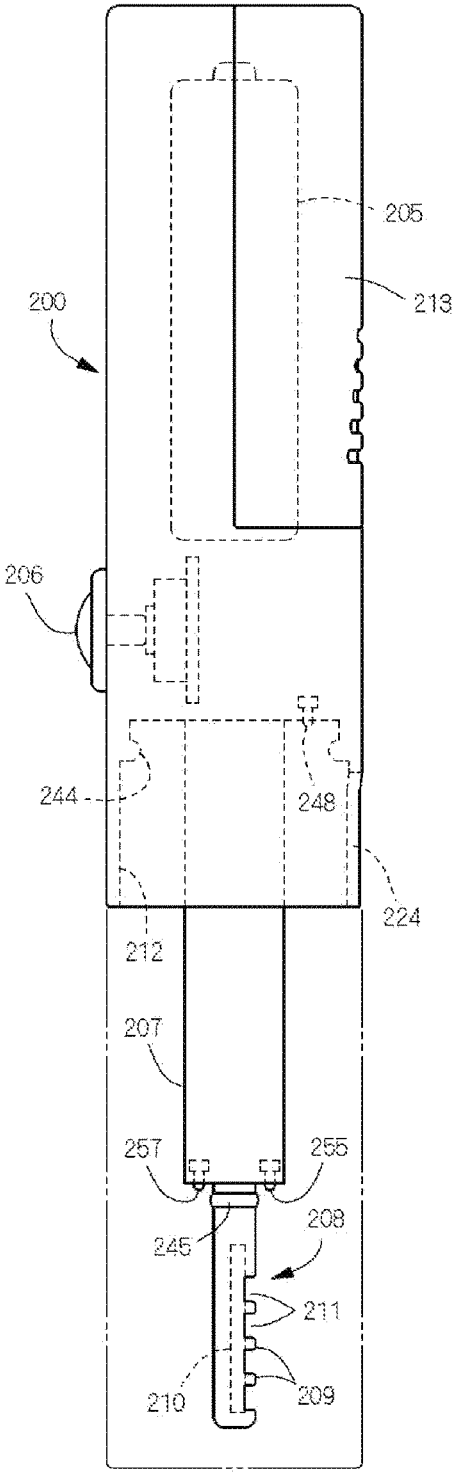
FIGS. 68A and 68B are partially cutaway side views showing a mode of use of a heating shaping portion.
Figure 68B:
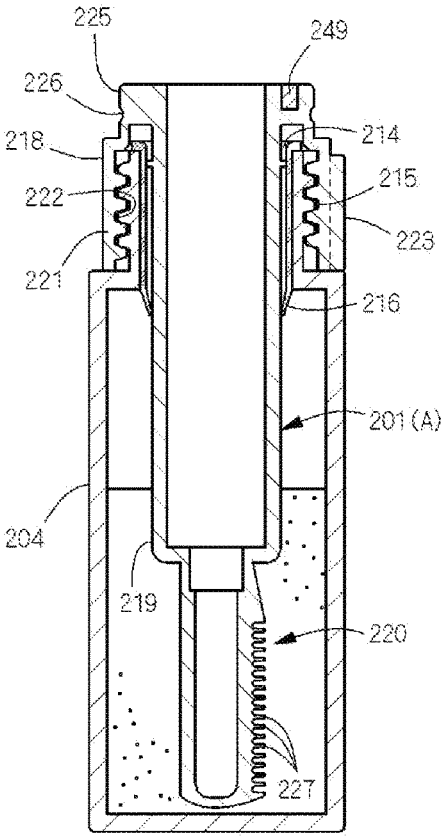

The connection portion between the main body portion 200 and the application body 201 is provided with a sensor structure for sensing whether the application body 201 is attached to the heating shaping portion 208. The sensor structure is formed by paired connection terminals 248 provided at a dead end of an inside of the cylindrical wall 212 and a conductive terminal 249 embedded in an upper end face of the connection boss 225. As shown in FIG. 66, the respective connection terminals 248 are housed in terminal recessed portions 250 provided at the dead end of the inside of the cylindrical wall 212 and biased by springs 251 to be pushed out. An opening face of each of the terminal recessed portions 250 is closed with a receiving plate 252. The receiving plate 252 receives the connection terminal 248, which has been biased to be pushed out by the receiving plate 252, so that only a contact end portion of the connection terminal 248 is exposed from an outer face of the receiving plate 252. The conductive terminal 249 is formed into a partial arc shape so as to be able to simultaneously come in contact with the paired connection terminals 248. The respective connection terminals 248 and the conductive terminal 249 are made of metal having electrical conductivity.

The connection portion between the heating shaping portion 208 and each of the eyelash shaping bodies 202 and 203 is provided with a sensor structure for sensing whether each of the eyelash shaping bodies 202 and 203 is attached to the heating shaping portion 208. The sensor structure is formed by paired connection terminals 255 for the first eyelash shaping body 202 and disposed at a lower end face of the heating rod 207, a conductive terminal 256 embedded in an upper end face of the comb frame 230, paired connection terminals 257 for the second eyelash shaping body 203, and a conductive terminal 258 embedded in an upper end face of the comb frame 237. The respective connection terminals 255 and 257 and the conductive terminals 256 and 258 are made of metal having electrical conductivity. The respective connection terminals 255 and 257 are housed in terminal recessed portions similar to those for the above-described connection terminals 248 and biased by springs to be pushed out. The respective connection terminals 255 and 257 are different from the connection terminals 248 only in that the terminal recessed portions are formed in the lower end face of the heating rod 207 and will not be described. The conductive terminals 256 and 258 are formed into partial arc shapes similarly to the above-described conductive terminal 249.

The mascara applicator formed as described above can be used in four kinds of modes, i.e., a state in which the three kinds of attachments A are detached, a state in which the application body 201 is attached to the heating shaping portion 208, and states in which one of the eyelash shaping bodies 202 and 203 is attached to the heating shaping portion 208. In the four kinds of modes, a voltage to be supplied to the sheet heater 210 is adjusted by a control circuit according to the respective modes of use so that suitable temperature states for the respective modes of use can be maintained.

To put it concretely, in the state in which all the attachments A are detached from the heating shaping portion 208 when the power switch 206 is in the ON state (state shown in FIGS. 68A and 68B), all the three sensor structures are in OFF states out of conduction. Therefore, the control circuit determines that the attachments A are not attached and maintains the sheet heater 210 in a temperature state (70° C.) suitable for use of the heating shaping portion 208. To shape the eyelashes with the heating shaping portion 208, while the main body portion 200 is supported horizontally with the comb teeth 209 oriented upward and the comb teeth 209 are combed through central portions of curves of the eyelashes, the eyelashes are brought in contact with the outer surface of the sheet heater 210. In this state, the eyelashes are scooped upward and the heating windows 211 are further turned toward an eyebrow to curl the eyelashes. Furthermore, by pushing the entire heating shaping portion 208 upward while heating the curled portions with the sheet heater 210, it is possible to reliably curl the eyelashes to their tips.

Figure 69:
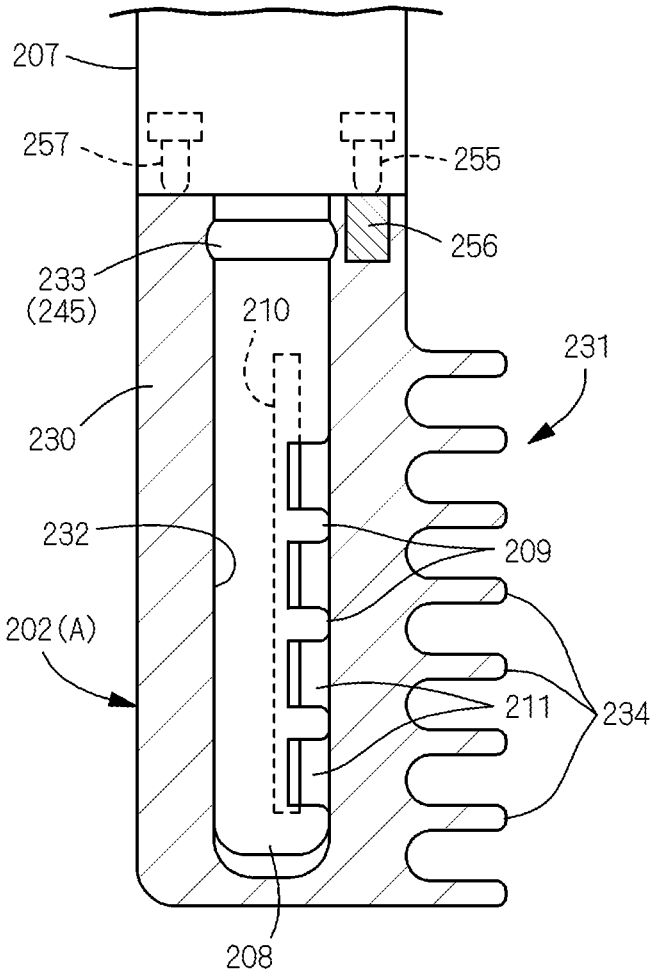
FIG. 69 is a vertical sectional view showing a mode of use of an attachment.

Next, as shown in FIG. 69, the first eyelash shaping body 202 is attached to the heating shaping portion 208 to shape the upper eyelashes while combed through them. In this mode of use, the paired connection terminals 255 are brought into conduction by the conductive terminal 256 provided to the comb frame 230. Therefore, the control circuit determines that the first eyelash shaping body 202 is attached and maintains the sheet heater 210 in a temperature state (80° C.) suitable for use of the first eyelash shaping body 202. In the state in which the first eyelash shaping body 202 is attached to the heating shaping portion 208, the attachment hole 232 in the comb frame 230 is in close contact with the heating shaping portion 208 and therefore the heat of the sheet heater 210 can be transferred to the comb teeth 234 via the comb frame 230. The first eyelash shaping body 202 shapes the upper eyelashes while scooping them upward and combed through the respective upper eyelashes similarly to the heating shaping portion 208.

When shaping of the upper eyelashes is completed, the second eyelash shaping body 203 in place of the first eyelash shaping body 202 is attached to the heating shaping portion 208 to be combed through lower eyelashes or eyelashes at inner and outer corners of an eye. In this mode of use, the paired connection terminals 257 are brought into conduction by the conductive terminal 258 provided to the comb frame 237. Therefore, the control circuit determines that the second eyelash shaping body 203 is attached and maintains the sheet heater 210 in a temperature state (75° C.) suitable for use of the second eyelash shaping body 203. The second eyelash shaping body 203 is combed downward through the eyelashes or combed through the respective eyelashes at the inner and outer corners of the eye similarly to the first eyelash shaping body 202. The temperature state of the first eyelash shaping body 202 is set to be slightly higher than the temperature state of the second eyelash shaping body 203, because the number of comb teeth 234 of the first eyelash shaping body 202 is greater than that of the comb teeth 241 of the second eyelash shaping body 203 and a heat radiation amount of the first eyelash shaping body 202 is large.

When shaping of the eyelashes is completed in the above manner, the second eyelash shaping body 203 is detached from the heating shaping portion 208. Then, the main body portion 200 is connected to the application body 201 with the positioning rib 223 and the positioning groove 224 engaged with each other and the connection groove 226 and the connection rib 244 are engaged with each other. By turning the main body portion 200 in this state, the application body 201 is turned together and can be detached from the container 204 as shown in FIG. 70.

Because the paired connection terminals 248 are made electrically continuous with each other by the conductive terminal 249 provided to the connection boss 225 in this mode of use, the control circuit determines that the application body 201 is attached and maintains the sheet heater 210 in a temperature state (40° C.) suitable for use of the application body 201. In the state in which the application body 201 is attached to the heating shaping portion 208, an inner wall of the application portion 220 is in close contact with the heating shaping portion 208 and therefore the heat of the sheet heater 210 can be transferred to the comb teeth 227 via the cylindrical wall of the application portion 220.

Next, by putting and taking the application rod 219 of the application body 201 into and out of the container 204 to cause the mascara liquid to adhere to the application portion 220, squeezing off the surplus mascara liquid by use of the wiper 216, and combing the comb teeth 227 through the eyelashes, it is possible to cause the mascara liquid held between the comb teeth 227 to adhere to the eyelashes. The mascara liquid held between the comb teeth 227 is heated by the heat of the heating shaping portion 208 and adjusted into a state in which the mascara liquid is uniformly diffused and likely to flow. Therefore, it is possible to apply just the right amount of mascara liquid to the eyelashes. Lastly, by combing the eyelashes a few times by using the mascara comb, it is possible to arrange curled shapes of the eyelashes.

With the mascara applicator having the above-described structure, it is possible to carryout shaping of the eyelashes and application of the mascara liquid in the four modes, i.e., the state in which the three kinds of attachments A are detached from the heating shaping portion 208 and the states in each of which one of the three kinds of attachments A is attached to the heating shaping portion 208. Therefore, by replacing the attachment A depending on the cosmetic treatments carried out in an orderly sequence, it is possible to deftly carry out the series of cosmetic treatments. Moreover, because the attachment A attached to the main body portion 200 or the heating shaping portion 208 is identified by the sensor structure and the temperature of each of the attachments A is controlled to be the temperature suitable to the treatment of the eyelashes, it is possible to properly and suitably carry out the treatment of the eyelashes by using each of the attachments A. Moreover, because the attachment A attached to the main body portion 200 or the heating shaping portion 208 can be identified by the sensor structure, it is only necessary for a user to attach each of the attachments A in a predetermined attitude into a predetermined position to heat each of the attachments A to a suitable temperature without the necessity of carrying out complicated operations such as switching of a switch.

Figure 71:
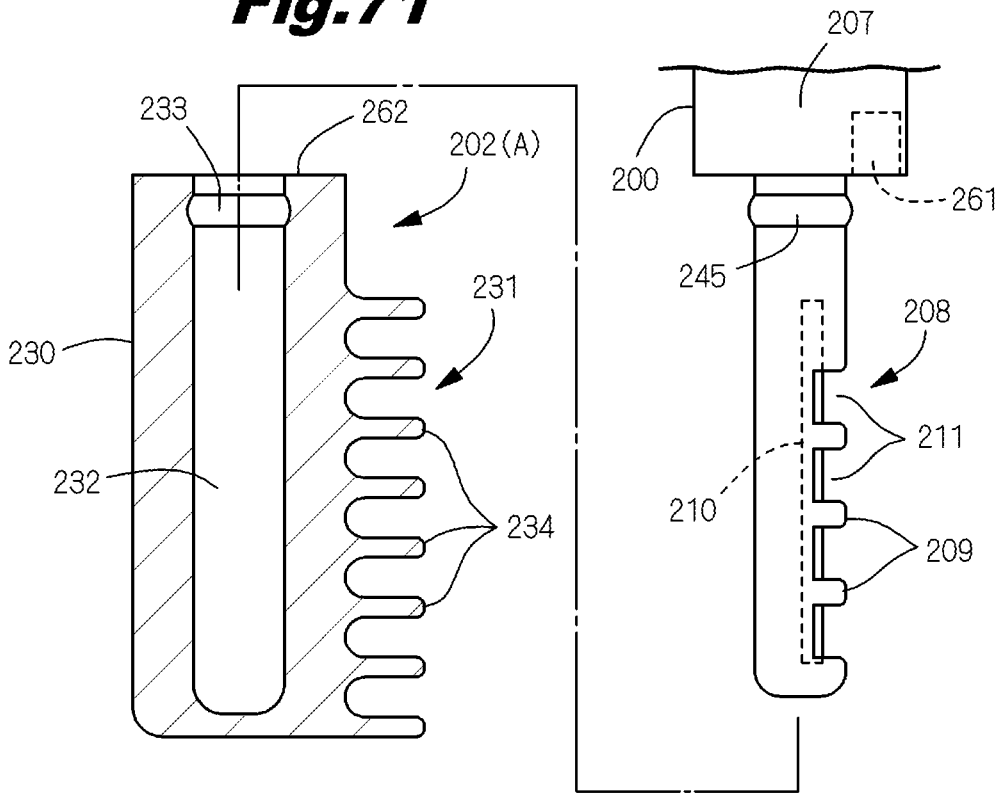
FIG. 71 is a partially cutaway side view showing another embodiment of an eyelash shaper according to the fifth invention group.
Figure 72:
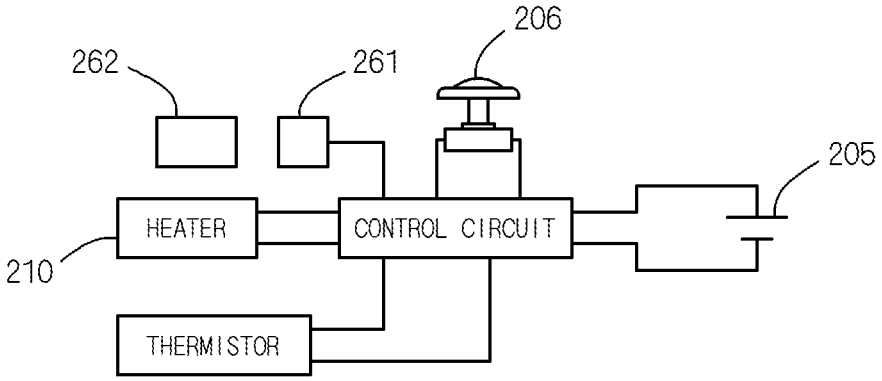
FIG. 72 is a block diagram showing a relationship between a sensor structure and a control circuit in FIG. 71.

FIGS. 71 and 72 show another embodiment obtained by modifying the sensor structure in the embodiment shown in FIGS. 64 to 70. The embodiment is different from that shown in FIGS. 64 to 70 in that an attachment A is formed by a first eyelash shaping body 202 and that a sensor structure is formed by a light-amount-sensing light sensor (CDS sensor) 261 and a light shielding wall (light shielding body) 262 provided to the first eyelash shaping body 202. The light sensor 261 is embedded in a lower end face of a heating rod 207 with a light receiving face of the optical sensor 261 exposed. Therefore, in a state in which the first eyelash shaping body 202 is attached to a heating shaping portion 208, the light receiving face is covered with the light shielding wall 262 and a light receiving amount becomes substantially zero. In a state in which the first eyelash shaping body 202 is detached from the heating shaping portion 208, the light receiving face is exposed and therefore the light receiving amount increases. Alight receiving signal corresponding to the light receiving amount is output to a control circuit.

In the sensor structure in the present embodiment, in the state in which the first eyelash shaping body 202 is detached from the heating shaping portion 208, the light receiving signal is output from the light sensor 261. Therefore, the control circuit determines that the first eyelash shaping body 202 is not attached to the heating shaping portion 208 and maintains a sheet heater 210 in a temperature state (70° C.) suitable for use of the heating shaping portion 208. In the state in which the first eyelash shaping body 202 is attached to the heating shaping portion 208, the light receiving signal is not output from the light sensor 261. Therefore, the control circuit determines that the first eyelash shaping body 202 is attached to the heating shaping portion 208 and maintains the sheet heater 210 in a temperature state (80° C.) suitable for use of the first eyelash shaping body 202. Because the other structures are the same as those in the above-described embodiment, the same members are provided with the same reference signs and will not be described. This holds true for the following embodiments.

Figure 73:
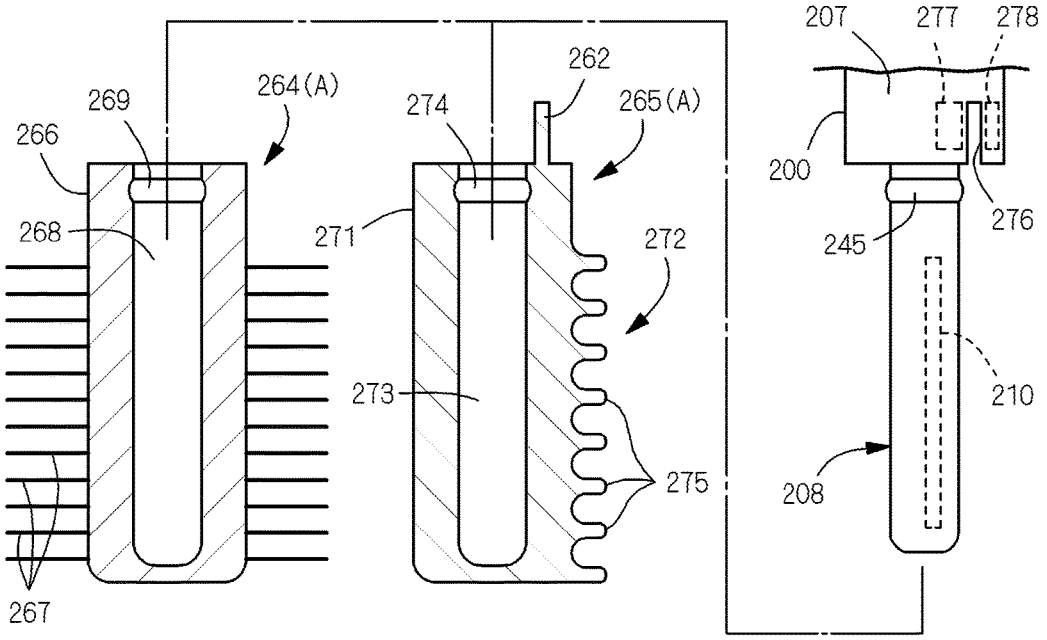
FIG. 73 is a partially cutaway side view showing another embodiment of the eyelash shaper according to the fifth invention group.
Figure 74:
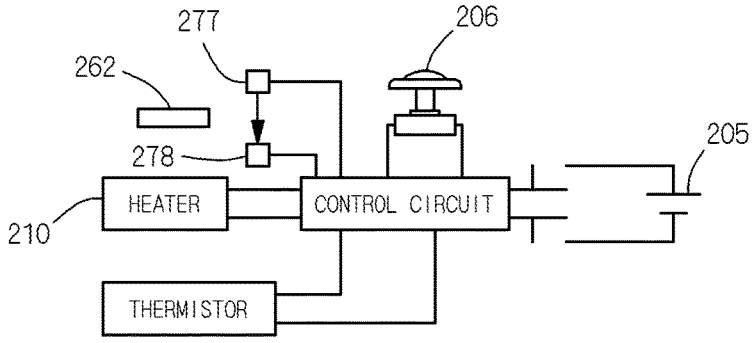
FIG. 74 is a block diagram showing a relationship between a sensor structure and a control circuit in FIG. 73.

FIGS. 73 and 74 show another embodiment of the mascara applicator in which the structure of the attachment A and the sensor structure in the embodiment shown in FIGS. 64 to 70 are modified. In the embodiment, the comb teeth 209 of the heating shaping portion 208 in the embodiment shown in FIGS. 64 to 70 are omitted and a portion below the heating rod 207 is formed as a heating head (heating portion) 208. Moreover, the attachments A are formed by a second application body 264 and a third application body 265 so that the respective application bodies 264 and 265 can be replaced and attached to the heating head 208. The second application body 264 is formed by radially implanting bristles 267 in a periphery of an application frame 266 in a cylindrical shape having a bottom. An attachment hole 268 into which the entire heating head 208 can be inserted is formed inside the application frame 266 and a connection groove 269 is formed in an annular recessed shape near an upper opening of the attachment hole 268.

The third application body 265 integrally includes an application frame 271 in a cylindrical shape having a bottom and an application comb portion 272 provided on one side of an outer face of the application frame 271. An attachment hole 273 into which the entire heating head 208 can be inserted is formed inside the application frame 271 and a connection groove 274 is formed in an annular recessed shape near an upper opening of the attachment hole 273. The application comb portion 272 is formed by eight comb teeth 275. A light shielding wall (light shielding body) 262 is formed to protrude from an upper end face of the application frame 271. A sensor structure is formed by a light emitting portion 277 and a light receiving portion 278 disposed on opposite sides of a slit 276 formed in a lower portion of the heating rod 207 and the light shielding wall 262 to be inserted into the slit 276 to intercept a light path between the light sensors.

Each of the second application body 264 and the third application body 265 is used while attached to the heating head 208 and inserted into a mascara container so that the bristles 267 are soaked with mascara liquid or the comb teeth 275 of the application comb portion 272 are soaked with the mascara liquid. In a state in which the second application body 264 is attached to the heating head 208, a sensor light emitted from the light emitting portion 277 is received by the light receiving portion 278 and a light receiving signal is output to a control circuit. Therefore, the control circuit determines that the second application body 264 is attached to the heating head 208 and maintains a sheet heater 210 in a temperature state (45° C.) suitable for use of the second application body 264. In a state in which the third application body 265 is attached to the heating head 208, the sensor light emitted from the light emitting portion 277 is intercepted by the light shielding wall 262 and therefore the light receiving signal is not output to the control circuit. Therefore, the control circuit determines that the third application body 265 is attached to the heating head 208 and maintains the sheet heater 210 in a temperature state (40° C.) suitable for use of the third application body 265. The temperature state of the second application body 264 is set to be slightly higher than the temperature state of the third application body 265, because comb teeth 275 have larger surface areas than the bristles 267 and heat radiation amounts of the bristles 267 are large.

Figure 75:
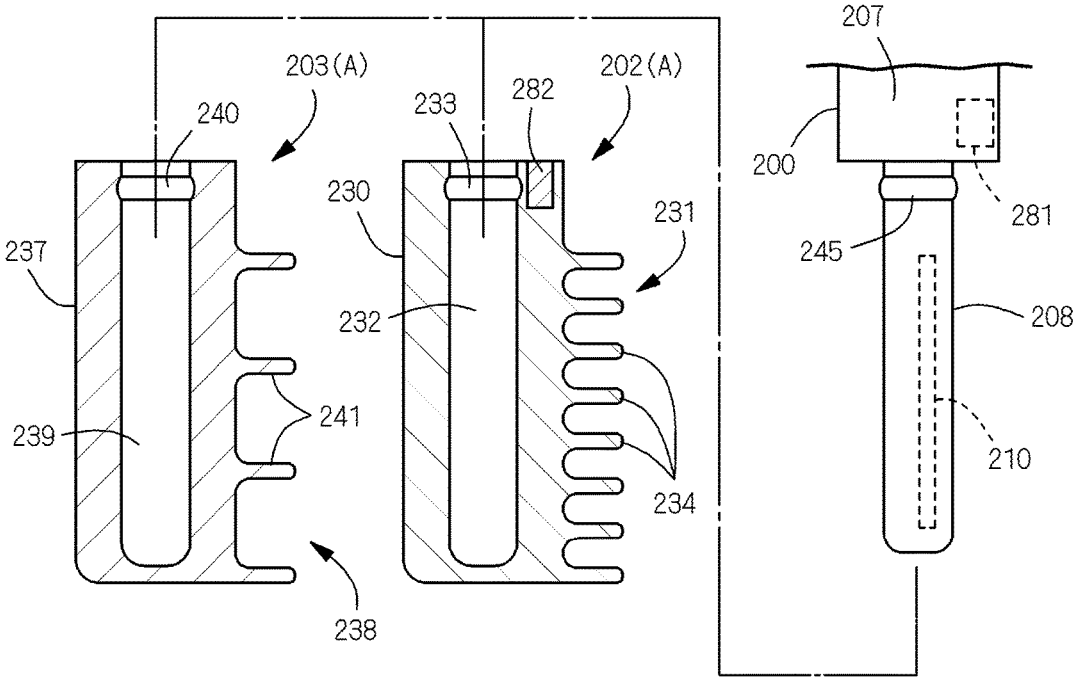
FIG. 75 is a partially cutaway side view showing another embodiment of the eyelash shaper according to the fifth invention group.
Figure 76:
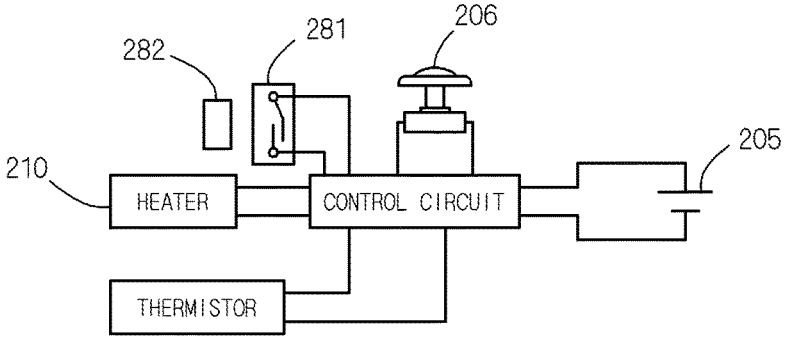
FIG. 76 is a block diagram showing a relationship between a sensor structure and a control circuit in FIG. 75.

FIGS. 75 and 76 show another embodiment of an eyelash shaper in which the structures of the attachments A and the sensor structures in the embodiments shown in FIGS. 64 to 70 are modified. In the present embodiment, the comb teeth 209 of the heating head 208 in the embodiments shown in FIGS. 64 to 70 are omitted and a portion below a heating rod 207 is formed as a heating head (heating portion) 208. Moreover, the attachments A are formed by a first eyelash shaping body 202 for shaping eyelashes while finely combed through the bunched eyelashes and a second eyelash shaping body 203 for increasing volume by retaining and shaping large bunches of eyelashes so that the respective eyelash shaping bodies 202 and 203 can be replaced and attached to the heating head 208. Structures of the first eyelash shaping body 202 and the second eyelash shaping body 203 are substantially similar to those described in FIGS. 64 to 70 but are different in that intervals of adjacent comb teeth 241 of the second eyelash shaping body 203 are greater than those of adjacent comb teeth 234 of the first eyelash shaping body 202.

The sensor structure is formed by a reed switch 281 disposed below the heating head 208 and a magnet 282 for switching the reed switch 281 into an ON state and the magnet 282 is embedded in an upper end of a comb frame 230 of the first eyelash shaping body 202. In a state in which the first eyelash shaping body 202 is attached to the heating head 208, the reed switch 281 is switched into the ON state by magnetism of the magnet 282 and an ON signal is output to a control circuit. Therefore, the control circuit determines that the first eyelash shaping body 202 is attached to the heating head 208 and maintains a sheet heater 210 in a temperature state (80° C.) suitable for use of the first eyelash shaping body 202. Moreover, in a state in which the second eyelash shaping body 203 is attached to the heating head 208, the reed switch 281 remains in an OFF state and therefore the control circuit determines that the second eyelash shaping body 203 is attached to the heating head 208 and maintains the sheet heater 210 in a temperature state (75° C.) suitable for use of the second eyelash shaping body 203.

Although the temperature states of the respective attachments A and the heating shaping portion 208 are described as examples in the above embodiments, the temperature states of the respective attachments A and the heating shaping portion 208 may be suitably set according to structures and functions of the respective members.

DESCRIPTION OF REFERENCE SIGNS

1 Container
2 Application body
3 Shaping body
10 Cap
11 Application rod
12 Application portion
20 Shaping grip
21 Shaping rod
22 Heating shaping portion
29 Heater
33 Battery
34 Switch knob
52 Threaded cap
54 Connection boss
55 Connection groove
56 Restricting portion
64 Connection ring
92 Knob seat
93 Stopper
110 Sensor switch

The invention claimed is:

1. A cosmetic tool system comprising:

a main body portion forming a proximal end of the cosmetic tool for grasping by a user;

a heating rod provided at a distal end of the main body portion and extending distally away from the main body portion, the heating rod having a heating portion formed at a distal-most portion thereof, the heating portion including a heater disposed within the heating portion;

at least two combing attachments having a plurality of comb teeth or bristles on an exterior surface thereof for combing and/or applying a composition to eyelashes, the at least two combing attachments being detachably coupled to the main body portion or the heating rod such that only one of the at least two combing attachments can be coupled at a time, the at least two applicator attachments include a first combing attachment and a second combing attachment, wherein:

the first combing attachment is detachably coupled to the main body portion through a first connection structure such that when coupled, the first combing attachment covers the heating rod and heating portion thereof; and the second combing attachment is detachably coupled to the heating rod through a second connection structure such that when coupled, the second combing attachment covers the heating portion and a majority of the heating rod is exposed;

each of the at least two combing attachments having a sensor structure at a connection portion between the respective combing attachment and the main body portion or the heating rod, the main body portion having a sensor structure at the connection portion thereof which cooperatively functions with the sensor structure of the first combing attachment to sense whether or not the first combing attachment is attached to the main body portion and the heating rod having at least one sensor structure at the connection portion thereof which cooperatively functions with the sensor structure of the second combing attachment to sense whether or not the second combing attachment is attached to the heating rod;

wherein the heater is configured to set a first heating temperature of the heating rod such that the heating rod is heated at the first heating temperature when the first combing attachment is sensed to be attached to the main body portion, the heater is configured to set a second heating temperature of the heating rod such that the heating rod is heated at the second heating temperature when the second combing attachment is sensed to be attached to the heating rod, and the first heating temperature is different from the second heating temperature.

2. The cosmetic tool according to claim 1, wherein the heating portion is formed as a heating shaping portion for shaping eyelashes, the first combing attachment is formed as an application body for applying mascara liquid, the application body having:

a cap to be attached to the main body portion by the first connection structure, an application rod in a shape of a hollow shaft supported by the cap, and an application portion provided at an end portion of the application rod, and an outer face of the heating shaping portion is covered with the application portion in a state in which the application body is attached to the main body portion.

3. The cosmetic tool according to claim 1, wherein the heating rod extends along a longitudinal direction thereof, having a proximal end portion and a distal end portion in the longitudinal direction wherein the proximal end portion is closer to the main body portion than the distal end portion, the heating portion is disposed at the distal end portion of the heating rod and formed as a heating shaping portion for shaping eyelashes, the second attachment is formed as an eyelash shaping body for shaping the eyelashes, the eyelash shaping body having:

a comb frame that is configured to be attached to the heating shaping portion by the second connection structure and a shaping comb portion that is provided to an outer face of the comb frame to shape the eyelashes, and an outer face of the heating shaping portion is covered with the comb frame in a state in which the eyelash shaping body is attached to the heating rod.

4. The cosmetic tool according to claim 1, wherein the first sensor structure is formed by paired connection terminals provided to the main body portion and the sensor structure of the first combing attachment is a conductive terminal and the conductive terminal makes the paired connection terminals electrically continuous with each other so that an attached state of the first combing attachment is sensed in a state in which the first combing attachment is attached to the main body portion.

5. The cosmetic tool according to claim 1, wherein the first sensor structure is formed by a light sensor provided to the main body portion and the sensor structure of the first combing attachment is a light shielding body and a light receiving state of the light sensor is switched by the light shielding body so that an attached state of the first attachment is sensed in a state in which the first attachment is attached to the main body portion.

6. The cosmetic tool according to claim 1, wherein the first sensor structure is formed by a reed switch provided to the main body portion and the sensor structure of the first combing attachment is a magnet and the reed switch is switched by the magnet so that an attached state of the first attachment is sensed in a state in which the first attachment is attached to the main body portion.

7. The cosmetic tool according to claim 1, wherein the second sensor structure is formed by paired connection terminals provided to the heating rod and the sensor structure of the second combing attachment is a conductive terminal and the conductive terminal makes the paired connection terminals electrically continuous with each other so that an attached state of the second attachment is sensed in a state in which the second attachment is attached to the heating portion.

8. The cosmetic tool according to claim 1, wherein the second sensor structure is formed by a light sensor provided to the heating rod and the sensor structure of the second combing attachment is a light shielding body and a light receiving state of the light sensor is switched by the light shielding body so that an attached state of the second attachment is sensed in a state in which the second attachment is attached to the heating portion.

9. The cosmetic tool according to claim 1, wherein the second sensor structure is formed by a reed switch provided to the heating rod and the sensor structure of the second combing attachment is a magnet and the reed switch is switched by the magnet so that an attached state of the second attachment is sensed in a state in which the second attachment is attached to the heating portion.

10. The cosmetic tool according to claim 1, wherein the heater sets another heating temperature of the heating rod, which is different from any of the first and second heating temperatures, when none of the first and second attachments is sensed and while power is on to the heater.

11. The cosmetic tool according to claim 1, further comprising:

a third combing attachment having a hollow frame with a plurality of comb teeth or bristles on an exterior surface thereof, the third combing attachment is detachably coupled to the heating rod through a third connection structure such that when coupled, the heating portion is disposed within the hollow frame of the third combing attachment and a remaining portion of the heating rod is exposed;

and the third combing attachment having a sensor structure at the third connection portion and the heating rod having a third sensor structure to sense whether or not the third attachment is attached to the heating rod, the third connection portion being located different from the first connection portion, wherein a portion of the third connection structure on the heating rod is shared with the second connection structure, the heater is configured to set a third heating temperature of the heating rod such that the heating rod is heated at the third heating temperature when the third attachment is sensed to be attached to the heating rod, and the third heating temperature is different from the first heating temperature or the second heating temperature.

12. The cosmetic tool according to claim 11, wherein the first heating temperature for the first combing attachment is lower than the second and third heating temperatures.

13. The cosmetic tool according to claim 11, wherein the plurality of comb teeth or bristles of the second and third combing attachments are each arranged in a row extending longitudinally from a distal end portion towards a proximal direction to define second and third shaping comb portions, respectively, where the second shaping comb portion is longer than the third shaping comb portion in the longitudinal direction, and the second heating temperature for the second combing attachment is higher than the third heating temperature for the third attachment.

* * * * *